US009240632B2

(12) United States Patent
Puente Baliarda et al.

(10) Patent No.: US 9,240,632 B2
(45) Date of Patent: Jan. 19, 2016

(54) MULTILEVEL ANTENNAE

(71) Applicant: Fractus, S.A., Barcelona (ES)

(72) Inventors: Carles Puente Baliarda, Sant Cugat del Valles (ES); Carmen Borja Borau, Barcelona (ES); Jaume Anguera Pros, Vinaros (ES); Jordi Soler Castany, Mataro (ES)

(73) Assignee: Fractus, S.A., Barcelona (ES)

( * ) Notice: Subject to any disclaimer, the term of this patent is extended or adjusted under 35 U.S.C. 154(b) by 176 days.

(21) Appl. No.: 13/929,441

(22) Filed: Jun. 27, 2013

(65) Prior Publication Data

US 2013/0285859 A1 Oct. 31, 2013

Related U.S. Application Data

(63) Continuation of application No. 13/732,743, filed on Jan. 2, 2013, now Pat. No. 8,976,069, which is a continuation of application No. 13/669,916, filed on Nov. 6, 2012, now abandoned, which is a continuation (Continued)

(51) Int. Cl.
*H01Q 1/38* (2006.01)
*H01Q 1/50* (2006.01)
(Continued)

(52) U.S. Cl.
CPC . *H01Q 1/50* (2013.01); *H01Q 1/36* (2013.01); *H01Q 1/38* (2013.01); *H01Q 5/001* (2013.01);
(Continued)

(58) Field of Classification Search
CPC ..... H01Q 1/36; H01Q 1/38; H01Q 5/20; H01Q 5/357; H01Q 5/40; H01Q 5/50; H01Q 9/065; H01Q 9/28; H01Q 15/0093; H01Q 19/005
USPC ..... 343/700 MS, 702, 829, 846
See application file for complete search history.

(56) References Cited

U.S. PATENT DOCUMENTS 621,455 A 3/1899 Hess
646,850 A 4/1900 Lindemeyr
(Continued)

FOREIGN PATENT DOCUMENTS

AU 2438199 9/1999
CA 2416437 1/2002
(Continued)

OTHER PUBLICATIONS

Infringement Chart—Samsung SCH-R600. U.S. Pat. No. 7,528,782. Fractus, 2009.
(Continued)

*Primary Examiner* — Tho G Phan
(74) *Attorney, Agent, or Firm* — Edell, Shapiro & Finnan LLC

(57) ABSTRACT

A multi-band antenna includes at least one structure useable at multiple frequency ranges. The structure includes at least two levels of detail, with one level of detail making up another level of detail. The levels of detail are composed of closed plane figures bounded by the same number of sides. An interconnection circuit links the multi-band antenna to an input/output connector and incorporates adaptation networks, filters or diplexers. Each of the closed plane figures is linked to at least one other closed plane figure to exchange electromagnetic power. For at least 75% of the closed plane figures, the region or area of contact, intersection, or interconnection between the closed plane figures is less than 50% of their perimeter or area. Not all of the closed plane figures have the same size, and the perimeter of the structure has a different number of sides than its constituent closed plane figures.

21 Claims, 14 Drawing Sheets

Related U.S. Application Data of application No. 13/411,212, filed on Mar. 2, 2012, now Pat. No. 8,330,659, which is a continuation of application No. 13/044,189, filed on Mar. 9, 2011, now Pat. No. 8,154,463, which is a continuation of application No. 12/400,888, filed on Mar. 10, 2009, now Pat. No. 8,009,111, which is a continuation of application No. 11/780,932, filed on Jul. 20, 2007, now Pat. No. 7,528,782, which is a continuation of application No. 11/179,257, filed on Jul. 12, 2005, now Pat. No. 7,397,431, which is a continuation of application No. 11/102,390, filed on Apr. 8, 2005, now Pat. No. 7,123,208, which is a continuation of application No. 10/963,080, filed on Oct. 12, 2004, now Pat. No. 7,015,868, which is a continuation of application No. 10/102,568, filed on Mar. 18, 2002, now abandoned, which is a continuation of application No. PCT/ES99/00296, filed on Sep. 20, 1999.

(51) Int. Cl.

| | |
|---|---|
| ***H01Q 1/36*** | (2006.01) |
| ***H01Q 9/04*** | (2006.01) |
| ***H01Q 9/06*** | (2006.01) |
| ***H01Q 9/28*** | (2006.01) |
| ***H01Q 9/40*** | (2006.01) |
| ***H01Q 5/10*** | (2015.01) |
| ***H01Q 5/20*** | (2015.01) |
| ***H01Q 5/357*** | (2015.01) |
| ***H01Q 5/307*** | (2015.01) |
| ***H01Q 5/00*** | (2015.01) |
| ***H01Q 5/01*** | (2006.01) |
| ***H01Q 5/40*** | (2015.01) |
| ***H01Q 5/50*** | (2015.01) |

(52) U.S. Cl.

CPC ..... *H01Q 5/0051* (2013.01); *H01Q 5/01* (2013.01); *H01Q 5/10* (2015.01); *H01Q 5/20* (2015.01); *H01Q 5/307* (2015.01); *H01Q 5/357* (2015.01); *H01Q 5/40* (2015.01); *H01Q 5/50* (2015.01); *H01Q 9/04* (2013.01); *H01Q 9/0407* (2013.01); *H01Q 9/065* (2013.01); *H01Q 9/28* (2013.01); *H01Q 9/40* (2013.01)

(56) References Cited

U.S. PATENT DOCUMENTS

| | | | |
|---|---|---|---|
| 2,759,183 | A | 8/1956 | Woodward |
| 3,079,602 | A | 2/1963 | Du Hamel |
| 3,521,284 | A | 7/1970 | Shelton et al. |
| 3,599,214 | A | 8/1971 | Altmayer |
| 3,605,102 | A | 9/1971 | Frye |
| 3,622,890 | A | 11/1971 | Fujimoto |
| 3,680,135 | A | 7/1972 | Boyer |
| 3,683,376 | A | 8/1972 | Pronovost |
| 3,689,929 | A | 9/1972 | Moody |
| 3,818,490 | A | 6/1974 | Leahy |
| 3,858,221 | A | 12/1974 | Harrison et al. |
| 3,967,276 | A | 6/1976 | Goubau |
| 3,969,730 | A | 7/1976 | Fuchser |
| 4,021,810 | A | 5/1977 | Urpo et al. |
| 4,024,542 | A | 5/1977 | Ikawa et al. |
| 4,038,662 | A | 7/1977 | Turner |
| 4,131,893 | A | 12/1978 | Munson et al. |
| 4,141,014 | A | 2/1979 | Sletten |
| 4,141,016 | A | 2/1979 | Nelson |
| 4,157,548 | A | 6/1979 | Kaloi |
| 4,218,682 | A | 8/1980 | Yu |
| 4,243,990 | A | 1/1981 | Nemit |
| 4,290,071 | A | 9/1981 | Fenwick |
| 4,318,109 | A | 3/1982 | Weathers |
| 4,356,492 | A | 10/1982 | Kaloi |
| 4,398,199 | A | 8/1983 | Makimoto |
| 4,424,500 | A | 1/1984 | Viola et al. |
| 4,471,358 | A | 9/1984 | Glasser |
| 4,471,493 | A | 9/1984 | Schober |
| 4,504,834 | A | 3/1985 | Garay et al. |
| 4,509,056 | A | 4/1985 | Ploussios |
| 4,517,572 | A | 5/1985 | Dixon |
| 4,518,968 | A | 5/1985 | Hately |
| 4,521,784 | A | 6/1985 | Nemet |
| 4,527,164 | A | 7/1985 | Cestaro et al. |
| 4,531,130 | A | 7/1985 | Powers et al. |
| 4,536,725 | A | 8/1985 | Hubler |
| 4,543,581 | A | 9/1985 | Nemet |
| 4,553,146 | A | 11/1985 | Butler |
| 4,571,595 | A | 2/1986 | Phillips et al. |
| 4,584,709 | A | 4/1986 | Kneisel et al. |
| 4,590,614 | A | 5/1986 | Erat |
| 4,608,572 | A | 8/1986 | Blakney |
| 4,623,894 | A | 11/1986 | Lee et al. |
| 4,656,642 | A | 4/1987 | Apostolos et al. |
| 4,673,948 | A | 6/1987 | Kuo |
| 4,709,239 | A | 11/1987 | Herrick |
| 4,723,305 | A | 2/1988 | Phillips et al. |
| 4,730,195 | A | 3/1988 | Phillips et al. |
| 4,792,809 | A | 12/1988 | Gilbert et al. |
| 4,794,396 | A | 12/1988 | Pothier |
| 4,799,156 | A | 1/1989 | Shavit et al. |
| 4,827,271 | A | 5/1989 | Berneking |
| 4,839,660 | A | 6/1989 | Hadzoglou |
| 4,843,468 | A | 6/1989 | Drewery |
| 4,847,629 | A | 7/1989 | Shimazaki |
| 4,849,766 | A | 7/1989 | Inaba et al. |
| 4,857,939 | A | 8/1989 | Shimazaki |
| 4,860,019 | A | 8/1989 | Jiang |
| 4,890,114 | A | 12/1989 | Egashira |
| 4,894,663 | A | 1/1990 | Urbish et al. |
| 4,907,011 | A | 3/1990 | Kuo |
| 4,912,481 | A | 3/1990 | Mace et al. |
| 4,975,711 | A | 12/1990 | Lee |
| 5,014,346 | A | 5/1991 | Phillips |
| 5,030,963 | A | 7/1991 | Tadama |
| 5,033,385 | A | 7/1991 | Zeren |
| 5,046,080 | A | 9/1991 | Lee et al. |
| 5,061,944 | A | 10/1991 | Powers et al. |
| 5,074,214 | A | 12/1991 | Zeren |
| 5,075,691 | A | 12/1991 | Garay |
| 5,138,328 | A | 8/1992 | Zibrik et al. |
| 5,164,980 | A | 11/1992 | Bush et al. |
| 5,168,472 | A | 12/1992 | Lockwood |
| 5,172,084 | A | 12/1992 | Fiedziuszko et al. |
| 5,197,140 | A | 3/1993 | Balmer |
| 5,200,756 | A | 4/1993 | Feller |
| 5,210,542 | A | 5/1993 | Pett et al. |
| 5,212,742 | A | 5/1993 | Normile et al. |
| 5,212,777 | A | 5/1993 | Gove et al. |
| 5,214,434 | A | 5/1993 | Hsu |
| 5,218,370 | A | 6/1993 | Blaese |
| 5,227,804 | A | 7/1993 | Oda |
| 5,227,808 | A | 7/1993 | Davis |
| 5,245,350 | A | 9/1993 | Sroka |
| 5,248,988 | A | 9/1993 | Makino |
| 5,255,002 | A | 10/1993 | Day |
| 5,257,032 | A | 10/1993 | Diamond et al. |
| 5,258,765 | A | 11/1993 | Dorrie et al. |
| 5,262,791 | A | 11/1993 | Tsuda et al. |
| 5,300,936 | A | 4/1994 | Izadian |
| 5,307,075 | A | 4/1994 | Huynh |
| 5,337,063 | A | 8/1994 | Takahira |
| 5,337,065 | A | 8/1994 | Bonnet |
| 5,347,291 | A | 9/1994 | Moore |
| 5,355,144 | A | 10/1994 | Walton |
| 5,355,318 | A | 10/1994 | Dionnet et al. |
| 5,361,061 | A | 11/1994 | Mays |
| 5,363,114 | A | 11/1994 | Shoemaker |
| 5,373,300 | A | 12/1994 | Jenness et al. |
| 5,394,163 | A | 2/1995 | Bullen et al. |
| 5,402,134 | A | 3/1995 | Miller et al. |

(56) References Cited

U.S. PATENT DOCUMENTS 5,410,322 A 4/1995 Sonoda
5,420,599 A 5/1995 Erkocevic
5,422,651 A 6/1995 Chang
5,438,357 A 8/1995 McNelley
5,451,965 A 9/1995 Matsumoto
5,451,968 A 9/1995 Emery
5,453,751 A 9/1995 Tsukamoto et al.
5,453,752 A 9/1995 Wang
5,457,469 A 10/1995 Diamond et al.
5,471,224 A 11/1995 Barkeshli
5,493,702 A 2/1996 Crowley et al.
5,495,261 A 2/1996 Baker et al.
5,508,709 A 4/1996 Krenz et al.
5,534,877 A 7/1996 Sorbello et al.
5,537,367 A 7/1996 Lockwood et al.
5,557,293 A 9/1996 McCoy
5,559,524 A 9/1996 Takei et al.
5,563,882 A 10/1996 Bruno et al.
5,569,879 A 10/1996 Gloton
5,572,223 A 11/1996 Phillips
H001631 H 2/1997 Montgomery
5,600,844 A 2/1997 Shaw et al.
5,608,417 A 3/1997 De Vall
5,619,205 A 4/1997 Johnson
5,621,913 A 4/1997 Tuttle et al.
5,627,550 A 5/1997 Sanad
5,646,635 A 7/1997 Cockson et al.
5,646,637 A 7/1997 Miller
5,657,028 A 8/1997 Sanad
5,672,345 A 9/1997 Curtiss
5,680,144 A 10/1997 Sanad
5,684,672 A 11/1997 Karidis et al.
5,703,600 A 12/1997 Burrell et al.
5,710,458 A 1/1998 Iwasaki
5,712,640 A 1/1998 Andou et al.
5,734,352 A 3/1998 Seward et al.
5,742,258 A 4/1998 Kumpfbeck et al.
5,764,190 A 6/1998 Murch et al.
5,767,811 A 6/1998 Mandai et al.
5,767,814 A 6/1998 Conroy et al.
5,790,080 A 8/1998 Apostolos
5,798,688 A 8/1998 Shofield
5,805,113 A 9/1998 Ogino et al.
5,808,586 A 9/1998 Phillips et al.
5,809,433 A 9/1998 Thompson
5,821,907 A 10/1998 Zhu et al.
5,841,403 A 11/1998 West
5,861,845 A 1/1999 Lee et al.
5,870,066 A 2/1999 Asakura et al.
5,872,546 A 2/1999 Ihara et al.
5,898,404 A 4/1999 Jou
5,903,240 A 5/1999 Kawahata et al.
5,913,174 A 6/1999 Casarez et al.
5,918,183 A 6/1999 Janky
5,926,139 A 7/1999 Korisch
5,926,141 A 7/1999 Lindenmeier et al.
5,926,208 A 7/1999 Noonen et al.
5,929,822 A 7/1999 Kumpfbeck et al.
5,929,825 A 7/1999 Niu et al.
5,936,583 A 8/1999 Sekine et al.
5,936,587 A 8/1999 Gudilev
5,943,020 A 8/1999 Liebendoerfer et al.
5,945,954 A 8/1999 Johnson
5,963,871 A 10/1999 Zhinong et al.
5,966,097 A 10/1999 Fukasawa et al.
5,966,098 A 10/1999 Qi et al.
5,969,689 A 10/1999 Martek
5,973,648 A 10/1999 Lindenmeier
5,973,651 A 10/1999 Suesada et al.
5,982,337 A 11/1999 Newman et al.
5,986,609 A 11/1999 Spall
5,986,610 A 11/1999 Miron
5,986,615 A 11/1999 Westfall et al.
5,990,838 A 11/1999 Burns et al.
5,995,052 A 11/1999 Sadler et al.
5,995,064 A 11/1999 Yanagisawa
6,002,367 A 12/1999 Engblom et al.
6,005,524 A 12/1999 Hayes et al.
6,008,764 A 12/1999 Ollikainen et al.
6,008,774 A 12/1999 Wu
6,011,518 A 1/2000 Yamagishi
6,011,699 A 1/2000 Murray
6,014,114 A 1/2000 Westfall et al.
6,018,319 A 1/2000 Lindmark
6,028,568 A 2/2000 Asakura et al.
6,031,495 A 2/2000 Simmons et al.
6,031,499 A 2/2000 Dichter
6,031,505 A 2/2000 Qi et al.
6,034,645 A 3/2000 Legay et al.
6,037,902 A 3/2000 Pinhas et al.
6,037,907 A 3/2000 Ha
6,039,583 A 3/2000 Korsunsky et al.
6,040,803 A 3/2000 Spall
6,043,783 A 3/2000 Endo et al.
6,049,314 A 4/2000 Munson et al.
6,054,953 A 4/2000 Lindmark
6,057,801 A 5/2000 Declos et al.
6,069,592 A 5/2000 Wass
6,072,434 A 6/2000 Papatheodorou
6,075,485 A 6/2000 Lilly et al.
6,075,494 A 6/2000 Milroy
6,075,500 A 6/2000 Kurz et al.
6,078,294 A 6/2000 Mitarai
6,081,237 A 6/2000 Sato et al.
6,087,990 A 7/2000 Thill et al.
6,091,365 A 7/2000 Derneryd et al.
6,094,179 A 7/2000 Davidson
6,097,339 A 8/2000 Filipovic
6,097,345 A 8/2000 Walton
6,100,855 A 8/2000 Vinson et al.
6,104,347 A 8/2000 Snygg
6,104,349 A 8/2000 Cohen
6,107,920 A 8/2000 Eberhardt et al.
6,111,545 A 8/2000 Saari
6,112,102 A 8/2000 Zhinong
6,114,674 A 9/2000 Baugh et al.
6,122,533 A 9/2000 Zhang et al.
6,124,830 A 9/2000 Yuanzhu
6,127,977 A 10/2000 Cohen
6,130,651 A 10/2000 Yanagisawa et al.
6,131,042 A 10/2000 Lee et al.
6,133,879 A 10/2000 Grangeat
6,133,883 A 10/2000 Munson et al.
6,140,966 A 10/2000 Pankinaho
6,140,969 A 10/2000 Lindenmeier et al.
6,140,975 A 10/2000 Cohen
6,141,540 A 10/2000 Richards et al.
6,147,652 A 11/2000 Sekine
6,147,655 A 11/2000 Roesner
6,154,176 A * 11/2000 Fathy et al. ..... 343/700 MS
6,154,180 A 11/2000 Padrick
6,157,348 A 12/2000 Openlander
6,160,513 A 12/2000 Davidson et al.
6,166,694 A 12/2000 Ying
6,172,618 B1 1/2001 Hakozaki et al.
6,175,333 B1 1/2001 Smith et al.
6,181,281 B1 1/2001 Desclos et al.
6,195,048 B1 2/2001 Chiba et al.
6,198,442 B1 3/2001 Rutkowski
6,198,943 B1 3/2001 Sadler et al.
6,201,501 B1 3/2001 Arkko et al.
6,204,826 B1 3/2001 Rutkowski et al.
6,211,824 B1 4/2001 Holden et al.
6,211,826 B1 4/2001 Aoki
6,211,834 B1 4/2001 Durham et al.
6,211,889 B1 4/2001 Stoutamire
6,215,447 B1 4/2001 Johnson
6,215,474 B1 4/2001 Shah
6,218,989 B1 4/2001 Schneider et al.
6,218,991 B1 4/2001 Sanad
6,218,992 B1 4/2001 Sadler et al.
6,222,497 B1 4/2001 Hu et al.
6,236,366 B1 5/2001 Yamamoto et al.
6,236,372 B1 5/2001 Lindenmeier et al.

(56) References Cited

U.S. PATENT DOCUMENTS 6,239,752 B1 5/2001 Blanchard
6,239,765 B1 5/2001 Johnson et al.
6,243,592 B1 6/2001 Nakada et al.
6,255,994 B1 7/2001 Saito
6,255,995 B1 7/2001 Asano et al.
6,259,407 B1 7/2001 Tran
6,260,088 B1 7/2001 Gove et al.
6,266,023 B1 7/2001 Nagy et al.
6,266,538 B1 7/2001 Waldron
6,268,836 B1 7/2001 Faulkner et al.
6,271,794 B1 8/2001 Geeraert
6,281,846 B1 8/2001 Puente Baliarda et al.
6,285,326 B1 9/2001 Diximus et al.
6,285,342 B1 9/2001 Brady et al.
6,288,680 B1 9/2001 Tsuru et al.
6,292,154 B1 9/2001 Deguchi et al.
6,297,711 B1 10/2001 Seward et al.
6,300,910 B1 10/2001 Kim
6,300,914 B1 10/2001 Yang
6,304,220 B1 10/2001 Herve et al.
6,304,222 B1 10/2001 Smith et al.
6,307,511 B1 10/2001 Ying et al.
6,307,512 B1 10/2001 Geeraert
6,310,578 B1 10/2001 Ying
6,317,083 B1 11/2001 Johnson et al.
6,320,543 B1 11/2001 Ohata et al.
6,323,811 B1 11/2001 Tsubaki et al.
6,326,919 B1 12/2001 Diximus et al.
6,326,927 B1 12/2001 Johnson et al.
6,327,485 B1 12/2001 Waldron
6,329,951 B1 12/2001 Wen et al.
6,329,954 B1 12/2001 Fuchs et al.
6,329,962 B2 12/2001 Ying
6,333,716 B1 12/2001 Pontoppidan
6,333,720 B1 12/2001 Gottl et al.
6,342,861 B1 1/2002 Packard
6,343,208 B1 1/2002 Ying
6,346,914 B1 2/2002 Annamaa
6,348,892 B1 2/2002 Annamaa et al.
6,351,241 B1 2/2002 Wass
6,352,434 B1 3/2002 Emmert
6,353,443 B1 3/2002 Ying
6,360,105 B2 3/2002 Nakada et al.
6,362,790 B1 3/2002 Proctor, Jr. et al.
6,366,243 B1 4/2002 Isohatala et al.
6,367,939 B1 4/2002 Carter et al.
6,373,447 B1 4/2002 Rostoker et al.
6,377,217 B1 4/2002 Zhu et al.
6,380,895 B1 4/2002 Moren et al.
6,380,902 B2 4/2002 Duroux
6,381,471 B1 4/2002 Dvorkin
6,384,790 B2 5/2002 Dishart et al.
6,384,793 B2 5/2002 Scordilis
6,388,626 B1 5/2002 Gamalielsson et al.
6,396,444 B1 5/2002 Goward
6,400,339 B1 6/2002 Edvardsson et al.
6,407,710 B2 6/2002 Keilen
6,408,190 B1 6/2002 Ying
6,417,810 B1 7/2002 Huels et al.
6,417,816 B2 7/2002 Sadler et al.
6,421,014 B1 7/2002 Sanad
6,421,024 B1 7/2002 Stolle
6,424,315 B1 7/2002 Glenn
6,429,818 B1 8/2002 Johnson et al.
6,431,712 B1 8/2002 Turnbull
6,445,352 B1 9/2002 Cohen
6,452,549 B1 9/2002 Lo
6,452,553 B1 9/2002 Cohen
6,456,249 B1 9/2002 Johnson et al.
6,470,174 B1 10/2002 Schefte et al.
6,476,766 B1 11/2002 Cohen
6,480,158 B2 11/2002 Apostolos
6,483,462 B2 11/2002 Weinberger
6,489,925 B2 12/2002 Thursby
6,492,952 B1 12/2002 Hu
6,496,154 B2 12/2002 Gyenes
6,498,586 B2 12/2002 Pankinaho
6,498,588 B1 12/2002 Callaghan
6,525,691 B2 2/2003 Varadan et al.
6,538,604 B1 3/2003 Isohatala et al.
6,539,608 B2 4/2003 McKinnon et al.
6,545,640 B1 4/2003 Herve et al.
6,552,690 B2 4/2003 Veerasamy
6,570,538 B2 5/2003 Vaisanen
6,603,434 B2 8/2003 Lindenmeier
6,628,784 B1 9/2003 Montane Condemines
6,639,560 B1 10/2003 Kadambi
6,650,294 B2 11/2003 Ying et al.
6,683,571 B2 1/2004 Ghosh
6,693,603 B1 2/2004 Smith et al.
6,697,024 B2 2/2004 Fuerst
6,707,428 B2 3/2004 Gram
6,727,855 B1 * 4/2004 Nalbandian ..... 343/700 MS
6,741,210 B2 5/2004 Brachat et al.
6,756,944 B2 6/2004 Tessier
6,812,893 B2 11/2004 Waterman
6,831,606 B2 12/2004 Sajadinia
6,897,830 B2 5/2005 Bae
6,937,191 B2 8/2005 Puente
6,937,196 B2 8/2005 Korva
6,943,730 B2 9/2005 Poilasne
6,977,808 B2 12/2005 Lam
6,980,158 B2 12/2005 Iguchi
6,995,720 B2 2/2006 Shikata
7,015,868 B2 3/2006 Puente
7,047,040 B2 5/2006 Kim
7,072,698 B2 7/2006 Underbrink
7,075,483 B2 7/2006 Okado
7,091,911 B2 8/2006 Qi
7,095,372 B2 8/2006 Soler Castany et al.
7,102,577 B2 9/2006 Richard
7,116,273 B2 10/2006 Morikawa et al.
7,119,748 B2 10/2006 Autti
7,123,208 B2 10/2006 Puente Baliarda et al.
7,126,537 B2 10/2006 Cohen
7,202,818 B2 4/2007 Anguera Pros et al.
7,209,081 B2 4/2007 Chang
7,256,743 B2 8/2007 Korva
7,256,751 B2 8/2007 Cohen
7,265,724 B1 9/2007 Tan
7,312,762 B2 12/2007 Puente Ballarda et al.
7,342,553 B2 3/2008 Soler
7,388,549 B2 6/2008 Chiang
7,394,432 B2 7/2008 Baliarda et al.
7,397,431 B2 7/2008 Baliarda et al.
7,403,159 B2 7/2008 Gooshchin
7,403,165 B2 7/2008 Qi
7,528,782 B2 5/2009 Baliarda et al.
7,659,864 B2 * 2/2010 Chen et al. ..... 343/860
7,663,556 B2 2/2010 Desclos
7,755,546 B2 7/2010 Ishimiya
7,903,034 B2 3/2011 Anguera
7,911,014 B2 3/2011 Doan
8,369,950 B2 * 2/2013 Rawat et al. ..... 607/32
8,427,373 B2 * 4/2013 Jiang et al. ..... 343/700 MS
2001/0011964 A1 8/2001 Sadler
2001/0018793 A1 9/2001 McKinnon et al.
2001/0050635 A1 12/2001 Weinberger
2001/0050636 A1 12/2001 Weinberger
2001/0050638 A1 12/2001 Ishitobi et al.
2002/0000940 A1 1/2002 Moren et al.
2002/0000942 A1 1/2002 Duroux
2002/0025839 A1 2/2002 Usui
2002/0036594 A1 3/2002 Gyenes
2002/0058539 A1 5/2002 Underbrink
2002/0105468 A1 8/2002 Tessier
2002/0109633 A1 8/2002 Ow
2002/0126054 A1 9/2002 Fuerst et al.
2002/0126055 A1 9/2002 Lindenmeier et al.
2002/0140615 A1 10/2002 Carles et al.
2002/0171601 A1 11/2002 Puente
2002/0175866 A1 11/2002 Gram
2002/0190904 A1 12/2002 Cohen
2003/0160723 A1 8/2003 Cohen

(56) References Cited

U.S. PATENT DOCUMENTS

| | | | |
|---|---|---|---|
| 2003/0201942 | A1 | 10/2003 | Poilasne et al. |
| 2004/0145529 | A1 | 7/2004 | Iguchi et al. |
| 2006/0001576 | A1 | 1/2006 | Contopanagos |
| 2006/0033664 | A1 | 2/2006 | Soler |
| 2006/0077101 | A1 | 4/2006 | Puente |
| 2008/0252536 | A1 | 10/2008 | Anguera |

FOREIGN PATENT DOCUMENTS

| | | |
|---|---|---|
| CN | 2224466 | 4/1996 |
| CN | 1559093 | 12/2004 |
| DE | 3337941 | 5/1985 |
| DE | 4313397 | 11/1994 |
| DE | 19511300 | 10/1996 |
| DE | 19929689 | 1/2001 |
| DE | 10206426 | 11/2002 |
| DE | 10138265 | 7/2003 |
| DE | 10204079 | 8/2003 |
| EP | 0096847 | 12/1983 |
| EP | 0297813 | 1/1989 |
| EP | 0358090 | 3/1990 |
| EP | 0431764 | 6/1991 |
| EP | 0543645 | 5/1993 |
| EP | 0590671 | 9/1993 |
| EP | 0571124 | 11/1993 |
| EP | 0688040 | 12/1995 |
| EP | 0765001 | 9/1996 |
| EP | 0753897 | 1/1997 |
| EP | 0814536 | 12/1997 |
| EP | 0856907 | 8/1998 |
| EP | 0871238 | 10/1998 |
| EP | 0892459 | 1/1999 |
| EP | 0902472 | 3/1999 |
| EP | 0929121 | 7/1999 |
| EP | 0932219 | 7/1999 |
| EP | 0938158 | 8/1999 |
| EP | 0942488 | 9/1999 |
| EP | 0969375 | 1/2000 |
| EP | 1024552 | 1/2000 |
| EP | 0986130 | 3/2000 |
| EP | 0997972 | 3/2000 |
| EP | 0993070 | 4/2000 |
| EP | 0997974 | 5/2000 |
| EP | 1018777 | 7/2000 |
| EP | 1018779 | 7/2000 |
| EP | 1026774 | 8/2000 |
| EP | 1063721 | 12/2000 |
| EP | 1067627 | 1/2001 |
| EP | 1071161 | 1/2001 |
| EP | 1077508 | 2/2001 |
| EP | 1079462 | 2/2001 |
| EP | 1083624 | 3/2001 |
| EP | 1094545 | 4/2001 |
| EP | 1096602 | 5/2001 |
| EP | 1148581 | 10/2001 |
| EP | 1198027 | 10/2001 |
| EP | 0749176 | 9/2002 |
| EP | 1237224 | 9/2002 |
| EP | 1258054 | 11/2002 |
| EP | 1267438 | 12/2002 |
| EP | 1326302 | 11/2003 |
| EP | 1378961 | 1/2004 |
| EP | 1317018 | 2/2004 |
| EP | 1396906 | 3/2004 |
| EP | 1401050 | 3/2004 |
| EP | 1414106 | 4/2004 |
| EP | 1424747 | 6/2004 |
| EP | 1443595 | 8/2004 |
| EP | 1453140 | 9/2004 |
| EP | 1465291 | 10/2004 |
| EP | 0843905 | 12/2004 |
| EP | 1515392 | 3/2005 |
| ES | 2112163 | 3/1998 |
| ES | 2142280 | 5/2000 |
| ES | 2156832 | 1/2002 |
| FR | 2543744 | 10/1984 |
| FR | 2704359 | 11/1994 |
| FR | 2837339 | 9/2003 |
| GB | 2112579 | 7/1983 |
| GB | 2161026 | 1/1986 |
| GB | 2215136 | 9/1989 |
| GB | 2289163 | 11/1995 |
| GB | 2317994 | 4/1998 |
| GB | 2330951 | 5/1999 |
| GB | 2355116 | 4/2001 |
| GB | 2361584 | 10/2001 |
| JP | 53009451 | 1/1978 |
| JP | 55123203 | 9/1980 |
| JP | 5129816 | 10/1991 |
| JP | 5007109 | 1/1993 |
| JP | 5147806 | 6/1993 |
| JP | 5267916 | 10/1993 |
| JP | 5308223 | 11/1993 |
| JP | 5347507 | 12/1993 |
| JP | 6037531 | 2/1994 |
| JP | 6085530 | 3/1994 |
| JP | 6204908 | 7/1994 |
| JP | 6252629 | 9/1994 |
| JP | 1997-246852 | 9/1997 |
| JP | 9252214 | 9/1997 |
| JP | 10093332 | 4/1998 |
| JP | 10163748 | 6/1998 |
| JP | 10-209744 | 8/1998 |
| JP | 10-303637 | 11/1998 |
| JP | 11-004113 | 1/1999 |
| JP | 11-027042 | 1/1999 |
| JP | 11088032 | 3/1999 |
| JP | 11136015 | 5/1999 |
| JP | 11-220319 | 8/1999 |
| JP | 11317610 | 11/1999 |
| JP | 2002-158529 | 5/2002 |
| JP | 3449484 | 9/2003 |
| JP | 2003283230 | 10/2003 |
| NZ | 508835 | 11/2002 |
| RU | 2170478 | 7/2001 |
| SE | 518988 | 12/2002 |
| TW | 554571 | 9/2003 |
| WO | 88/09065 | 11/1988 |
| WO | 93/12559 | 6/1993 |
| WO | 94/24722 | 10/1994 |
| WO | 94/24723 | 10/1994 |
| WO | 95/05012 | 2/1995 |
| WO | 95/11530 | 4/1995 |
| WO | 96/03783 | 2/1996 |
| WO | 96/04691 | 2/1996 |
| WO | 96/10276 | 4/1996 |
| WO | 96/27219 | 9/1996 |
| WO | 96/29755 | 9/1996 |
| WO | 96/38881 | 12/1996 |
| WO | 97/06578 | 2/1997 |
| WO | 97/11507 | 3/1997 |
| WO | 97/32355 | 9/1997 |
| WO | 97/33338 | 11/1997 |
| WO | 97/35360 | 11/1997 |
| WO | 97/47054 | 12/1997 |
| WO | 98/05088 | 2/1998 |
| WO | 98/12771 | 3/1998 |
| WO | 98/20578 | 5/1998 |
| WO | 98/31067 | 7/1998 |
| WO | 98/33234 | 7/1998 |
| WO | 98/36469 | 8/1998 |
| WO | 98/39814 | 9/1998 |
| WO | 99/03166 | 1/1999 |
| WO | 99/03167 | 1/1999 |
| WO | 99/03168 | 1/1999 |
| WO | 99/22420 | 5/1999 |
| WO | 99/25042 | 5/1999 |
| WO | 99/25044 | 5/1999 |
| WO | 99/27607 | 6/1999 |
| WO | 99/27608 | 6/1999 |
| WO | 99/31757 | 6/1999 |
| WO | 99/35691 | 7/1999 |
| WO | 99/43048 | 8/1999 |

(56) References Cited

FOREIGN PATENT DOCUMENTS

| | | |
|---|---|---|
| WO | 99/56345 | 11/1999 |
| WO | 99/56347 | 11/1999 |
| WO | 99/57785 | 11/1999 |
| WO | 99/60665 | 11/1999 |
| WO | 99/62139 | 12/1999 |
| WO | 99/65102 | 12/1999 |
| WO | 00/01028 | 1/2000 |
| WO | 00/03451 | 1/2000 |
| WO | 00/03453 | 1/2000 |
| WO | 00/08712 | 2/2000 |
| WO | 00/22695 | 4/2000 |
| WO | 00/30267 | 5/2000 |
| WO | 00/31825 | 6/2000 |
| WO | 00/36700 | 6/2000 |
| WO | 00/49680 | 8/2000 |
| WO | 00/52784 | 9/2000 |
| WO | 00/52787 | 9/2000 |
| WO | 00/55939 | 9/2000 |
| WO | 00/57511 | 9/2000 |
| WO | 00/67342 | 11/2000 |
| WO | 00/74172 | 12/2000 |
| WO | 00/77884 | 12/2000 |
| WO | 01/03238 | 1/2001 |
| WO | 01/05048 | 1/2001 |
| WO | 01/06594 | 1/2001 |
| WO | 01/08255 | 2/2001 |
| WO | 01/08257 | 2/2001 |
| WO | 01/08260 | 2/2001 |
| WO | 01/09976 | 2/2001 |
| WO | 01/11721 | 2/2001 |
| WO | 01/13464 | 2/2001 |
| WO | 01/15270 | 3/2001 |
| WO | 01/15271 | 3/2001 |
| WO | 01/17061 | 3/2001 |
| WO | 01/17063 | 3/2001 |
| WO | 01/17064 | 3/2001 |
| WO | 01/18904 | 3/2001 |
| WO | 01/18909 | 3/2001 |
| WO | 01/20714 | 3/2001 |
| WO | 01/20927 | 3/2001 |
| WO | 01/22528 | 3/2001 |
| WO | 01/24314 | 4/2001 |
| WO | 01/24316 | 4/2001 |
| WO | 01/26182 | 4/2001 |
| WO | 01/28035 | 4/2001 |
| WO | 01/29927 | 4/2001 |
| WO | 01/31739 | 5/2001 |
| WO | 01/33665 | 5/2001 |
| WO | 01/35491 | 5/2001 |
| WO | 01/37369 | 5/2001 |
| WO | 01/37370 | 5/2001 |
| WO | 01/39321 | 5/2001 |
| WO | 01/41252 | 6/2001 |
| WO | 01/48861 | 7/2001 |
| WO | 01/54225 | 7/2001 |
| WO | 01/65636 | 9/2001 |
| WO | 01/73890 | 10/2001 |
| WO | 01/78192 | 10/2001 |
| WO | 01/82410 | 11/2001 |
| WO | 01/86753 | 11/2001 |
| WO | 01/89031 | 11/2001 |
| WO | 02/01668 | 1/2002 |
| WO | 02/35646 | 5/2002 |
| WO | 02/35652 | 5/2002 |
| WO | 02/054538 | 7/2002 |
| WO | 02/065583 | 8/2002 |
| WO | 02/071535 | 9/2002 |
| WO | 02/078123 | 10/2002 |
| WO | 02/078124 | 10/2002 |
| WO | 02/080306 | 10/2002 |
| WO | 02/087014 | 10/2002 |
| WO | 02/089254 | 11/2002 |
| WO | 02/091518 | 11/2002 |
| WO | 02/096166 | 11/2002 |
| WO | 02/103843 | 12/2002 |
| WO | 03/003503 | 1/2003 |
| WO | 03/017421 | 2/2003 |
| WO | 03/023900 | 3/2003 |
| WO | 03/026064 | 3/2003 |
| WO | 2004/075011 | 9/2004 |

OTHER PUBLICATIONS

Infringement Chart—Samsung SCH-R800. Fractus, 2009.
Infringement Chart—Samsung SCH-R800. U.S. Pat. No. 7,015,868. Fractus, 2009.
Infringement Chart—Samsung SCH-R800. U.S. Pat. No. 7,123,208. Fractus, 2009.
Infringement Chart—Samsung SCH-R800. U.S. Pat. No. 7,397,431. Fractus, 2009.
Infringement Chart—Samsung SCH-R800. U.S. Pat. No. 7,528,782. Fractus, 2009.
Infringement Chart—Samsung SCH-U310. U.S. Pat. No. 7,528,782. Fractus, 2009.
Infringement Chart—Samsung SCH-U310. Fractus, 2009.
Infringement Chart—Samsung SCH-U310. U.S. Pat. No. 7,015,868. Fractus, 2009.
Infringement Chart—Samsung SCH-U310. U.S. Pat. No. 7,123,208. Fractus, 2009.
Infringement Chart—Samsung SCH-U310. U.S. Pat. No. 7,397,431. Fractus, 2009.
Infringement Chart—Samsung SCH-U430. Fractus, 2009.
Infringement Chart—Samsung SCH-U430. U.S. Pat. No. 7,015,868. Fractus, 2009.
Infringement Chart—Samsung SCH-U430. U.S. Pat. No. 7,123,208. Fractus, 2009.
Infringement Chart—Samsung SCH-U430. U.S. Pat. No. 7,397,431. Fractus, 2009.
Infringement Chart—Samsung SCH-U430. U.S. Pat. No. 7,528,782. Fractus, 2009.
Infringement Chart—Samsung SCH-U470. Fractus, 2009.
Infringement Chart—Samsung SCH-U470. U.S. Pat. No. 7,397,431. Fractus, 2009.
Infringement Chart—Samsung SCH-U470. U.S. Pat. No. 7,015,868. Fractus, 2009.
Infringement Chart—Samsung SCH-U470. U.S. Pat. No. 7,123,208. Fractus, 2009.
Infringement Chart—Samsung SCH-U470. U.S. Pat. No. 7,528,782. Fractus, 2009.
Infringement Chart—Samsung SCH-U520. Fractus, 2009.
Infringement Chart—Samsung SCH-U520. U.S. Pat. No. 7,015,868. Fractus, 2009.
Infringement Chart—Samsung SCH-U520. U.S. Pat. No. 7,123,208. Fractus, 2009.
Infringement Chart—Samsung SCH-U520. U.S. Pat. No. 7,394,432. Fractus, 2009.
Infringement Chart—Samsung SCH-U520. U.S. Pat. No. 7,397,431. Fractus, 2009.
Infringement Chart—Samsung SCH-U520. U.S. Pat. No. 7,528,782. Fractus, 2009.
Infringement Chart—Samsung SCH-U740. Fractus, 2009.
Infringement Chart—Samsung SCH-U740. U.S. Pat. No. 7,015,868. Fractus, 2009.
Infringement Chart—Samsung SCH-U740. U.S. Pat. No. 7,123,208. Fractus, 2009.
Infringement Chart—Samsung SCH-U740. U.S. Pat. No. 7,397,431. Fractus, 2009.
Infringement Chart—Samsung SCH-U740. U.S. Pat. No. 7,728,782. Fractus, 2009.
Infringement Chart—Samsung SCH-U750. Fractus, 2009.
Infringement Chart—Samsung SCH-U750. U.S. Pat. No. 7,015,868. Fractus, 2009.
Infringement Chart—Samsung SCH-U750. U.S. Pat. No. 7,123,208. Fractus, 2009.
Infringement Chart—Samsung SCH-U750. U.S. Pat. No. 7,397,431. Fractus, 2009.
Infringement Chart—Samsung SCH-U750. U.S. Pat. No. 7,528,782. Fractus, 2009.

(56) References Cited

OTHER PUBLICATIONS

Infringement Chart—Samsung SCH-U940. Fractus, 2009.
Infringement Chart—Samsung SCH-U940. U.S. Pat. No. 7,015,868. Fractus, 2009.
Infringement Chart—Samsung SCH-U940. U.S. Pat. No. 7,123,208. Fractus, 2009.
Infringement Chart—Samsung SCH-U940. U.S. Pat. No. 7,397,431. Fractus, 2009.
Infringement Chart—Samsung SCH-U940. U.S. Pat. No. 7,528,782. Fractus, 2009.
Infringement Chart—Samsung SCH A127. Fractus, 2009.
Infringement Chart—Samsung SCH U340. Fractus, 2009.
Infringement Chart—Samsung SCH U340. U.S. Pat. No. 7,015,868. Fractus, 2009.
Infringement Chart—Samsung SCH U340. U.S. Pat. No. 7,123,208 Fractus, 2009.
Infringement Chart—Samsung SCH U340. U.S. Pat. No. 7,397,431. Fractus, 2009.
Infringement Chart—Samsung SCH U340. U.S. Pat. No. 7,528,782. Fractus, 2009.
Infringement Chart—Samsung SCH U410. U.S. Pat. No. 7,015,868. Fractus, 2009.
Infringement Chart—Samsung SCH U410. U.S. Pat. No. 7,123,208. Fractus, 2009.
Infringement Chart—Samsung SCHU410. U.S. Pat. No. 7,397,431. Fractus, 2009.
Infringement Chart—Samsung SCH U410. U.S. Pat. No. 7,528,782. Fractus, 2009.
Infringement Chart—Samsung SCH U700. Fractus, 2009.
Infringement Chart—Samsung SCH U700. U.S. Pat. No. 7,015,868. Fractus, 2009.
Infringement Chart—Samsung SCH U700. U.S. Pat. No. 7,123,208. Fractus, 2009.
Infringement Chart—Samsung SCH U700. U.S. Pat. No. 7,394,432. Fractus, 2009.
Infringement Chart—Samsung SCH U700. U.S. Pat. No. 7,397,431. Fractus, 2009.
Infringement Chart—Samsung SCH U700. U.S. Pat. No. 7,528,782. Fractus, 2009.
Infringement Chart—Samsung SCH U410. Fractus, 2009.
Infringement Chart—Samsung SGH-A237. Fractus, 2009.
Infringement Chart—Samsung SGH-A237. U.S. Pat. No. 7,015,868. Fractus, 2009.
Infringement Chart—Samsung SGH-A237. U.S. Pat. No. 7,123,208. Fractus, 2009.
Infringement Chart—Samsung SGH-A237. U.S. Pat. No. 7,394,432. Fractus, 2009.
Infringement Chart—Samsung SGH-A237. U.S. Pat. No. 7,397,431. Fractus, 2009.
Infringement Chart—Samsung SGH-A237. U.S. Pat. No. 7,528,782. Fractus, 2009.
Infringement Chart—Samsung SGH-A257. Fractus, 2009.
Infringement Chart—Samsung SGH-A257. U.S. Pat. No. 7,394,432. Fractus, 2009.
Infringement Chart—Samsung SGH-A257. U.S. Pat. No. 7,397,431 Fractus, 2009.
Infringement Chart—Samsung SGH-A257. U.S. Pat. No. 7,528,782. Fractus, 2009.
Infringement Chart—Samsung SGH-A630. U.S. Pat. No. 7,123,208. Fractus, 2009.
Infringement Chart—Samsung SGH-A837. Fractus, 2009.
Infringement Chart—Samsung SGH-A837. U.S. Pat. No. 7,015,868. Fractus, 2009.
Infringement Chart—Samsung SGH-A837. U.S. Pat. No. 7,123,208. Fractus, 2009.
Infringement Chart—Samsung SGH-A837. U.S. Pat. No. 7,394,432. Fractus, 2009.
Infringement Chart—Samsung SGH-A837. U.S. Pat. No. 7,397,431. Fractus, 2009.
Infringement Chart—Samsung SGH-A837. U.S. Pat. No. 7,528,782. Fractus, 2009.
Infringement Chart—Samsung SGH-A887. Fractus, 2009.
Infringement Chart—Samsung SGH-A887. U.S. Pat. No. 7,123,208. Fractus, 2009.
Infringement Chart—Samsung SGH-A887. U.S. Pat. No. 7,397,431. Fractus, 2009.
Infringement Chart—Samsung SGH-A887. U.S. Pat. No. 7,528,782. Fractus, 2009.
Infringement Chart—Samsung SGH-I907. U.S. Pat. No. 7,015,868. Fractus, 2009.
Infringement Chart—Samsung SGH-I907. U.S. Pat. No. 7,123,208. Fractus, 2009.
Infringement Chart—Samsung SGH-I907. U.S. Pat. No. 7,394,432. Fractus, 2009.
Infringement Chart—Samsung SGH-I907. U.S. Pat. No. 7,397,431. Fractus, 2009.
Infringement Chart—Samsung SGH-I907. U.S. Pat. No. 7,528,782 Fractus, 2009.
Infringement Chart—Samsung SGH-T219. Fractus, 2009.
Infringement Chart—Samsung SGH-T219. U.S. Pat. No. 7,394,432. Fractus, 2009.
Infringement Chart—Samsung SGH-T219. U.S. Pat. No. 7,015,868. Fractus, 2009.
Infringement Chart—Samsung SGH-T219. U.S. Pat. No. 7,123,208. Fractus, 2009.
Infringement Chart—Samsung SGH-T219. U.S. Pat. No. 7,397,431. Fractus, 2009.
Infringement Chart—Samsung SGH-T219. U.S. Pat. No. 7,528,782 Fractus, 2009.
Infringement Chart—Samsung SGH-T239. Fractus, 2009.
Infringement Chart—Samsung SGH-T239. U.S. Pat. No. 7,123,208. Fractus, 2009.
Infringement Chart—Samsung SGH-T239. U.S. Pat. No. 7,015,868. Fractus, 2009.
Infringement Chart—Samsung SGH-T239. U.S. Pat. No. 7,397,431. Fractus, 2009.
Infringement Chart—Samsung SGH-T239. U.S. Pat. No. 7,528,782. Fractus, 2009.
Infringement Chart—Samsung SGH-T559. Fractus, 2009.
Infringement Chart—Samsung SGH-T559. U.S. Pat. No. 7,015,868. Fractus, 2009.
Infringement Chart—Samsung SGH-T559. U.S. Pat. No. 7,123,208. Fractus, 2009.
Infringement Chart—Samsung SGH-T559. U.S. Pat. No. 7,394,432. Fractus, 2009.
Infringement Chart—LG VX5500. U.S. Pat. No. 7,528,782. Fractus, 2009.
Infringement Chart—LG VX8350. Fractus, 2009.
Infringement Chart—LG VX8350. U.S. Pat. No. 7,015,868. Fractus, 2009.
Infringement Chart—LG VX8350. U.S. Pat. No. 7,123,208. Fractus, 2009.
Infringement Chart—LG VX8350. U.S. Pat. No. 7,397,431. Fractus, 2009.
Infringement Chart—LG VX8350. U.S. Pat. No. 7,528,782. Fractus, 2009.
Infringement Chart—LG VX8360.. Fractus, 2009.
Infringement Chart—LG VX8360. U.S. Pat. No. 7,015,868. Fractus, 2009.
Infringement Chart—LG VX8360. U.S. Pat. No. 7,123,208. Fractus, 2009.
Infringement Chart—LG VX8360. U.S. Pat. No. 7,397,431. Fractus, 2009.
Infringement Chart—LG VX8360. U.S. Pat. No. 7,528,782. Fractus, 2009.
Infringement Chart—LG VX8360. U.S. Pat. No. 7,394,432. Fractus, 2009.
Infringement Chart—LG VX8500. Fractus, 2009.
Infringement Chart—LG VX8500. U.S. Pat. No. 7,015,868. Fractus, 2009.
Infringement Chart—LG VX8500. U.S. Pat. No. 7,123,208. Fractus, 2009.

(56) References Cited

OTHER PUBLICATIONS

Infringement Chart—LG VX8500. U.S. Pat. No. 7,397,431. Fractus, 2009.
Infringement Chart—LG VX8500. U.S. Pat. No. 7,528,782. Fractus, 2009.
Infringement Chart—LG VX8560 Chocolate 3. Fractus, 2009.
Infringement Chart —LG VX8560 Chocolate 3. U.S. Pat. No. 7,015,868. Fractus, 2009.
Infringement Chart—LG VX8560 Chocolate 3. U.S. Pat. No. 7,123,208. Fractus, 2009.
Infringement Chart—LG VX8560 Chocolate 3. U.S. Pat. No. 7,394,432. Fractus, 2009.
Infringement Chart—LG VX8560 Chocolate 3. U.S. Pat. No. 7,397,431. Fractus, 2009.
Infringement Chart—LG VX8560 Chocolate 3. U.S. Pat. No. 7,528,782. Fractus, 2009.
Infringement Chart—LG VX8610. Fractus, 2009.
Infringement Chart—LG VX8610. U.S. Pat. No. 7,015,868. Fractus, 2009.
Infringement Chart—LG VX8610. U.S. Pat. No. 7,123,208. Fractus, 2009.
Infringement Chart—LG VX8610. U.S. Pat. No. 7,397,431. Fractus, 2009.
Infringement Chart—LG VX8610. U.S. Pat. No. 7,528,782. Fractus, 2009.
Infringement Chart—LG VX8800. Fractus, 2009.
Infringement Chart—LG VX8800. U.S. Pat. No. 7,015,868. Fractus, 2009.
Infringement Chart—LG VX8800. U.S. Pat. No. 7,123,208. Fractus, 2009.
Infringement Chart—LG VX8800. U.S. Pat. No. 7,528,782. Fractus, 2009.
Infringement Chart—LG VX9400. Fractus, 2009.
Infringement Chart—LG VX9400. U.S. Pat. No. 7,015,868. Fractus, 2009.
Infringement Chart—LG VX9400. U.S. Pat. No. 7,123,208. Fractus, 2009.
Infringement Chart—LG VX9400. U.S. Pat. No. 7,394,432. Fractus, 2009.
Infringement Chart—LG VX9400. U.S. Pat. No. 7,397,431. Fractus, 2009.
Infringement Chart—LG VX9400. U.S. Pat. No. 7,528,782. Fractus, 2009.
Infringement Chart—LG Xenon GR500. Fractus, 2009.
Infringement Chart—LG Xenon GR500. U.S. Pat. No. 7,015,868. Fractus, 2009.
Infringement Chart—LG Xenon GR500. U.S. Pat. No. 7,123,208. Fractus, 2009.
Infringement Chart—LG Xenon GR500. U.S. Pat. No. 7,394,432. Fractus, 2009.
Infringement Chart—LG Xenon GR500. U.S. Pat. No. 7,397,431. Fractus, 2009.
Infringement Chart—LG Xenon GR500. U.S. Pat. No. 7,528,782. Fractus, 2009.
Infringement Chart—Palm Centro 685. Fractus, 2009.
Infringement Chart—Palm Centro 685. U.S. Pat. No. 7,015,868. Fractus, 2009.
Infringement Chart—Palm Centro 685. U.S. Pat. No. 7,123,208. Fractus, 2009.
Infringement Chart—Palm Centro 685. U.S. Pat. No. 7,394,432. Fractus, 2009.
Infringement Chart—Palm Centro 685. U.S. Pat. No. 7,397,431. Fractus, 2009.
Infringement Chart—Palm Centro 685. U.S. Pat. No. 7,528,782. Fractus, 2009.
Infringement Chart—RIM Blackberry 8120. U.S. Pat. No. 7,123,208. Fractus, 2009.
Infringement Chart—RIM Blackberry 8120. U.S. Pat. No. 7,394,432. Fractus, 2009.
Infringement Chart—RIM Blackberry 8120. U.S. Pat. No. 7,397,431. Fractus, 2009.
Infringement Chart—RIM Blackberry 8120. U.S. Pat. No. 7,528,782. Fractus, 2009.
Infringement Chart—RIM Blackberry 8130. Fractus, 2009.
Infringement Chart—RIM Blackberry 8130. U.S. Pat. No. 7,015,868. Fractus, 2009.
Infringement Chart—RIM Blackberry 8130. U.S. Pat. No. 7,123,208. Fractus, 2009.
Infringement Chart—RIM Blackberry 8130. U.S. Pat. No. 7,528,782. Fractus, 2009.
Infringement Chart—RIM Blackberry 8220. Fractus, 2009.
Infringement Chart—RIM Blackberry 8220. U.S. Pat. No. 7,015,868. Fractus, 2009.
Infringement Chart—RIM Blackberry 8220. U.S. Pat. No. 7,123,208. Fractus, 2009.
Infringement Chart—RIM Blackberry 8220. U.S. Pat. No. 7,394,432. Fractus, 2009.
Infringement Chart—RIM Blackberry 8220. U.S. Pat. No. 7,397,431. Fractus, 2009.
Infringement Chart—RIM Blackberry 8220. U.S. Pat. No. 7,528,782. Fractus, 2009.
Infringement Chart—RIM Blackberry 8310. Fractus, 2009.
Infringement Chart—RIM Blackberry 8310. U.S. Pat. No. 7,015,868. Fractus, 2009.
Infringement Chart—RIM Blackberry 8310. U.S. Pat. No. 7,123,208. Fractus, 2009.
Infringement Chart—RIM Blackberry 8310. U.S. Pat. No. 7,394,432. Fractus, 2009.
Infringement Chart—RIM Blackberry 8310. U.S. Pat. No. 7,397,431. Fractus, 2009.
Infringement Chart—RIM Blackberry 8310. U.S. Pat. No. 7,528,782. Fractus, 2009.
Infringement Chart—RIM Blackberry 8320. Fractus, 2009.
Infringement Chart—RIM Blackberry 8320. U.S. Pat. No. 7,015,868. Fractus, 2009.
Infringement Chart—RIM Blackberry 8320. U.S. Pat. No. 7,123,208. Fractus, 2009.
Infringement Chart—RIM Blackberry 8320. U.S. Pat. No. 7,394,432. Fractus, 2009.
Infringement Chart—RIM Blackberry 8320. U.S. Pat. No. 7,397,431. Fractus, 2009.
Infringement Chart—RIM Blackberry 8320. U.S. Pat. No. 7,528,782. Fractus, 2009.
Infringement Chart—RIM Blackberry 8330. Fractus, 2009.
Infringement Chart—RIM Blackberry 8330. U.S. Pat. No. 7,015,868. Fractus, 2009.
Infringement Chart—RIM Blackberry 8330. U.S. Pat. No. 7,123,208. Fractus, 2009.
Infringement Chart—RIM Blackberry 8330. U.S. Pat. No. 7,397,431. Fractus, 2009.
Infringement Chart—RIM Blackberry 8330. U.S. Pat. No. 7,528,782. Fractus, 2009.
Infringement Chart—RIM Blackberry 8820. Fractus, 2009.
Infringement Chart—RIM Blackberry 8820. U.S. Pat. No. 7,015,868. Fractus, 2009.
Infringement Chart—RIM Blackberry 8820. U.S. Pat. No. 7,123,208. Fractus, 2009.
Infringement Chart—RIM Blackberry 8820. U.S. Pat. No. 7,394,432. Fractus, 2009.
Infringement Chart—RIM Blackberry 8820. U.S. Pat. No. 7,397,431. Fractus, 2009.
Infringement Chart—RIM Blackberry 8820. U.S. Pat. No. 7,528,782. Fractus, 2009.
Infringement Chart—RIM Blackberry 8830. Fractus, 2009.
Infringement Chart—RIM Blackberry 8830. U.S. Pat. No. 7,015,868. Fractus, 2009.
Infringement Chart—RIM Blackberry 8830. U.S. Pat. No. 7,123,208. Fractus, 2009.
Infringement Chart—RIM Blackberry 8830. U.S. Pat. No. 7,394,432. Fractus, 2009.
Infringement Chart—RIM Blackberry 8830. U.S. Pat. No. 7,397,431. Fractus, 2009.

(56) References Cited

OTHER PUBLICATIONS

Infringement Chart—RIM Blackberry 8830. U.S. Pat. No. 7,528,782. Fractus, 2009.
Infringement Chart—RIM Blackberry 8900. Fractus, 2009.
Infringement Chart—RIM Blackberry 8900. U.S. Pat. No. 7,015,868. Fractus, 2009.
Infringement Chart—RIM Blackberry 8900. U.S. Pat. No. 7,123,208. Fractus, 2009.
Infringement Chart—RIM Blackberry 8900. U.S. Pat. No. 7,394,432. Fractus, 2009.
Infringement Chart—RIM Blackberry 8900. U.S. Pat. No. 7,397,431. Fractus, 2009.
Infringement Chart—RIM Blackberry 8900. U.S. Pat. No. 7,528,782. Fractus, 2009.
Infringement Chart—RIM Blackberry 9630. Fractus, 2009.
Infringement Chart—LG 300G. U.S. Pat. No. 7,528,782. Fractus, 2009.
Infringement Chart—LG 300G. U.S. Pat. No. 7,397,431. Fractus, 2009.
Infringement Chart—LG Aloha LX140. Fractus, 2009.
Infringement Chart—LG Aloha LX140. U.S. Pat. No. 7,015,868. Fractus, 2009.
Infringement Chart—LG Aloha LX140. U.S. Pat. No. 7,123,208. Fractus, 2009.
Infringement Chart—LG Aloha LX140. U.S. Pat. No. 7,397,431. Fractus, 2009.
Infringement Chart—LG Aloha LX140. U.S. Pat. No. 7,528,782. Fractus, 2009.
Infringement Chart—LG AX155. Fractus, 2009.
Infringement Chart—LG AX155. U.S. Pat. No. 7,015,868. Fractus, 2009.
Infringement Chart—LG AX155. U.S. Pat. No. 7,123,208. Fractus, 2009.
Infringement Chart—LG AX155. U.S. Pat. No. 7,397,431. Fractus, 2009.
Infringement Chart—LG AX155. U.S. Pat. No. 7,528,782. Fractus, 2009.
Infringement Chart—LG AX300. Fractus, 2009.
Infringement Chart—LG AX300. U.S. Pat. No. 7,123,208. Fractus, 2009.
Infringement Chart—LG AX300. U.S. Pat. No. 7,397,431. Fractus, 2009.
Infringement Chart—LG AX300. U.S. Pat. No. 7,528,782. Fractus, 2009.
Infringement Chart—LG AX300. U.S. Pat. No. 7,015,868. Fractus, 2009.
Infringement Chart—LG AX380. Fractus, 2009.
Infringement Chart—LG AX380. U.S. Pat. No. 7,015,868. Fractus, 2009.
Infringement Chart—LG AX380. U.S. Pat. No. 7,123,208. Fractus, 2009.
Infringement Chart—LG AX380. U.S. Pat. No. 7,394,432. Fractus, 2009.
Infringement Chart—LG AX380. U.S. Pat. No. 7,397,431. Fractus, 2009.
Infringement Chart—LG AX380. U.S. Pat. No. 7,528,782. Fractus, 2009.
Infringement Chart—LG AX585. Fractus, 2009.
Infringement Chart—LG AX585. U.S. Pat. No. 7,015,868. Fractus, 2009.
Infringement Chart—LG AX585. U.S. Pat. No. 7,394,432. Fractus, 2009.
Infringement Chart—LG AX585. U.S. Pat. No. 7,397,431. Fractus, 2009.
Infringement Chart—LG AX585. U.S. Pat. No. 7,528,782. Fractus, 2009.
Infringement Chart—LG AX585. U.S. Pat. No. 7,123,208. Fractus, 2009.
Infringement Chart—LG AX8600. Fractus, 2009.
Infringement Chart—LG AX8600. U.S. Pat. No. 7,015,868. Fractus, 2009.
Infringement Chart—LG AX8600. U.S. Pat. No. 7,123,208. Fractus, 2009.
Infringement Chart—LG AX8600. U.S. Pat. No. 7,394,432. Fractus, 2009.
Infringement Chart—LG AX8600. U.S. Pat. No. 7,397,431. Fractus, 2009.
Infringement Chart—LG AX8600. U.S. Pat. No. 7,528,782. Fractus, 2009.
Infringement Chart—LG CF360. Fractus, 2009.
Infringement Chart—LG CF360. U.S. Pat. No. 7,015,868. Fractus, 2009.
Infringement Chart—LG CF360. U.S. Pat. No. 7,123,208. Fractus, 2009.
Infringement Chart—LG CF360. U.S. Pat. No. 7,394,432. Fractus, 2009.
Infringement Chart—LG CF360. U.S. Pat. No. 7,397,431. Fractus, 2009.
Infringement Chart—LG CF360. U.S. Pat. No. 7,528,782. Fractus, 2009.
Infringement Chart—LG Chocolate VX8550. Fractus, 2009.
Infringement Chart—LG Chocolate VX8550. U.S. Pat. No. 7,015,868. Fractus, 2009.
Infringement Chart—LG Chocolate VX8550. U.S. Pat. No. 7,123,208. Fractus, 2009.
Infringement Chart—LG Chocolate VX8550. U.S. Pat. No. 7,528,782. Fractus, 2009.
Infringement Chart—LG Chocolate VX8550. U.S. Pat. No. 7,397,431. Fractus, 2009.
Infringement Chart—LG CU515. Fractus, 2009.
Infringement Chart—LG CU515. U.S. Pat. No. 7,015,868. Fractus, 2009.
Infringement Chart—LG CU515. U.S. Pat. No. 7,123,208. Fractus, 2009.
Infringement Chart—LG CU515. U.S. Pat. No. 7,394,432. Fractus, 2009.
Infringement Chart—HTC Dash. Fractus, 2009.
Infringement Chart—HTC Dash. U.S. Pat. No. 7,015,868. Fractus, 2009.
Infringement Chart—HTC Dash. U.S. Pat. No. 7,123,208. Fractus, 2009.
Infringement Chart—HTC Dash. U.S. Pat. No. 7,394,432. Fractus, 2009.
Infringement Chart—HTC Dash. U.S. Pat. No. 7,397,431. Fractus, 2009.
Infringement Chart—HTC Dash. U.S. Pat. No. 7,528,782. Fractus, 2009.
Infringement Chart—HTC Diamond. Fractus, 2009.
Infringement Chart—HTC Diamond. U.S. Pat. No. 7,015,868. Fractus, 2009.
Infringement Chart—HTC Diamond. U.S. Pat. No. 7,123,208. Fractus, 2009.
Infringement Chart—HTC Diamond. U.S. Pat. No. 7,397,431. Fractus, 2009.
Infringement Chart—HTC Diamond. U.S. Pat. No. 7,528,782. Fractus, 2009.
Infringement Chart—HTC G1 Google. Fractus, 2009.
Infringement Chart—HTC G1 Google. U.S. Pat. No. 7,015,868. Fractus, 2009.
Infringement Chart—HTC G1 Google. U.S. Pat. No. 7,123,208. Fractus, 2009.
Infringement Chart—HTC G1 Google. U.S. Pat. No. 7,394,432. Fractus, 2009.
Infringement Chart—HTC G1 Google. U.S. Pat. No. 7,397,431. Fractus, 2009.
Infringement Chart—HTC G1 Google. U.S. Pat. No. 7,528,782. Fractus, 2009.
Infringement Chart—HTC My Touch. Fractus, 2009.
Infringement Chart—HTC My Touch. U.S. Pat. No. 7,123,208. Fractus, 2009.
Infringement Chart—HTC My Touch. U.S. Pat. No. 7,394,432. Fractus, 2009.

(56) References Cited

OTHER PUBLICATIONS

Infringement Chart—HTC My Touch. U.S. Pat. No. 7,397,431. Fractus, 2009.
Infringement Chart—HTC My Touch. U.S. Pat. No. 7,528,782. Fractus, 2009.
Infringement Chart—HTC Ozone. Fractus, 2009.
Infringement Chart—HTC Ozone. U.S. Pat. No. 7,015,868. Fractus, 2009.
Infringement Chart—HTC Ozone. U.S. Pat. No. 7,123,208. Fractus, 2009.
Infringement Chart—HTC Ozone. U.S. Pat. No. 7,394,432. Fractus, 2009.
Infringement Chart—HTC Ozone. U.S. Pat. No. 7,397,431. Fractus, 2009.
Infringement Chart—HTC Ozone. U.S. Pat. No. 7,528,782. Fractus, 2009.
Infringement Chart—HTC Pure. Fractus, 2009.
Infringement Chart—HTC Pure. U.S. Pat. No. 7,015,868. Fractus, 2009.
Infringement Chart—HTC Pure. U.S. Pat. No. 7,123,208. Fractus, 2009.
Infringement Chart—HTC Pure. U.S. Pat. No. 7,394,432. Fractus, 2009.
Infringement Chart—HTC Pure. U.S. Pat. No. 7,397,431. Fractus, 2009.
Infringement Chart—HTC Pure. U.S. Pat. No. 7,528,782. Fractus, 2009.
Infringement Chart—HTC Snap. Fractus, 2009.
Infringement Chart—HTC Snap. U.S. Pat. No. 7,015,868. Fractus, 2009.
Infringement Chart—HTC Snap. U.S. Pat. No. 7,123,208. Fractus, 2009.
Infringement Chart—HTC Snap. U.S. Pat. No. 7,397,431. Fractus, 2009.
Infringement Chart—HTC Snap. U.S. Pat. No. 7,528,782. Fractus, 2009.
Infringement Chart—HTC TILT 8925. Fractus, 2009.
Infringement Chart—HTC TILT 8925. U.S. Pat. No. 7,015,868. Fractus, 2009.
Infringement Chart—HTC TILT 8925. U.S. Pat. No. 7,123,208. Fractus, 2009.
Infringement Chart—HTC TILT 8925. U.S. Pat. No. 7,394,432. Fractus, 2009.
Infringement Chart—HTC TILT 8925. U.S. Pat. No. 7,397,431. Fractus, 2009.
Infringement Chart—HTC TILT 8925. U.S. Pat. No. 7,528,782. Fractus, 2009.
Infringement Chart—HTC Touch Pro 2. Fractus, 2009.
Infringement Chart—HTC Touch Pro 2. U.S. Pat. No. 7,123,208. Fractus, 2009.
Infringement Chart—HTC Touch Pro 2. U.S. Pat. No. 7,394,432. Fractus, 2009.
Infringement Chart—HTC Touch Pro 2. U.S. Pat. No. 7,397,431. Fractus, 2009.
Infringement Chart—LG CU515. U.S. Pat. No. 7,397,431. Fractus, 2009.
Infringement Chart—LG CU515. U.S. Pat. No. 7,528,782. Fractus, 2009.
Infringement Chart—LG Dare VX9700. Fractus, 2009.
Infringement Chart—LG Dare VX9700. U.S. Pat. No. 7,015,868. Fractus, 2009.
Inlnfringement Chart—LG Dare VX9700. U.S. Pat. No. 7,123,208. Fractus, 2009.
Infringement Chart—LG Dare VX9700. U.S. Pat. No. 7,397,431. Fractus, 2009.
Infringement Chart—LG enV Touch VX1100. Fractus, 2009.1.
Infringement Chart—LG enV Touch VX1100. U.S. Pat. No. 7,015,868. Fractus, 2009.
Infringement Chart—LG enV Touch VX1100. U.S. Pat. No. 7,123,208. Fractus, 2009.
Infringement Chart—LG enV Touch VX1100. U.S. Pat. No. 7,394,432. Fractus, 2009.
Infringement Chart—LG enV Touch VX1100. U.S. Pat. No. 7,397,431. Fractus, 2009.
Infringement Chart—LG enV Touch VX1100. U.S. Pat. No. 7,528,782. Fractus, 2009.
Infringement Chart—LG enV VX-9900. U.S. Pat. No. 7,123,208. Fractus, 2009.
Infringement Chart—LG enV VX-9900. U.S. Pat. No. 7,015,868. Fractus, 2009.
Infringement Chart—LG enV VX-9900. U.S. Pat. No. 7,397,431. Fractus, 2009.
Infringement Chart—LG enV VX-9900. U.S. Pat. No. 7,528,782. Fractus, 2009.
Infringement Chart—LG enV VX-9900. Fractus, 2009.
Infringement Chart—LG EnV2 VX9100. Fractus, 2009.
IInfringement Chart—LG EnV2 VX9100. U.S. Pat. No. 7,123,208. Fractus, 2009.
Infringement Chart—LG EnV2 VX9100. U.S. Pat. No. 7,397,431. Fractus, 2009.
Infringement Chart—LG EnV2 VX9100. U.S. Pat. No. 7,528,782. Fractus, 2009.
Infringement Chart—LG EnV2. U.S. Pat. No. 7,015,868. Fractus, 2009.
Infringement Chart—LG EnV3 VX9200. Fractus, 2009.
Infringement Chart—LG ENV3 VX9200. U.S. Pat. No. 7,015,868. Fractus, 2009.
Infringement Chart—LG EnV3 VX9200. U.S. Pat. No. 7,123,208. Fractus, 2009.
Infringement Chart—LG EnV3 VX9200. U.S. Pat. No. 7,394,432. Fractus, 2009.
Infringement Chart—LG EnV3 VX9200. U.S. Pat. No. 7,397,431. Fractus, 2009.
Infringement Chart—LG EnV3 VX9200. U.S. Pat. No. 7,528,782. Fractus, 2009.
Infringement Chart—LG Flare LX165. Fractus, 2009.
Infringement Chart—LG Flare LX165. U.S. Pat. No. 7,015,868. Fractus, 2009.
Infringement Chart—LG Flare LX165. U.S. Pat. No. 7,123,208. Fractus, 2009.
Infringement Chart—LG Flare LX165. U.S. Pat. No. 7,397,431. Fractus, 2009.
Infringement Chart—LG Flare LX165. U.S. Pat. No. 7,528,782. Fractus, 2009.
Infringement Chart—LG GT365 NEON. Fractus, 2009.
Infringement Chart—LG GT365 NEON. U.S. Pat. No. 7,015,868. Fractus, 2009.
Infringement Chart—LG GT365 NEON. U.S. Pat. No. 7,123,208. Fractus, 2009.
Infringement Chart—LG GT365 NEON. U.S. Pat. No. 7,394,432. Fractus, 2009.
Infringement Chart—LG GT365 NEON. U.S. Pat. No. 7,397,431. Fractus, 2009.
Infringement Chart—LG GT365 NEON. U.S. Pat. No. 7,528,782. Fractus, 2009.
Infringement Chart—LG Lotus. Fractus, 2009.
Infringement Chart—LG Lotus. U.S. Pat. No. 7,015,868. Fractus, 2009.
Infringement Chart—LG Lotus. U.S. Pat. No. 7,123,208. Fractus, 2009.
Infringement Chart—LG Lotus. U.S. Pat. No. 7,397,431. Fractus, 2009.
Infringement Chart—LG Lotus. U.S. Pat. No. 7,528,782. Fractus, 2009.
Infringement Chart—LG MUZIQ LX. U.S. Pat. No. 7,015,868. Fractus, 2009.
Infringement Chart—LG MUZIQ LX570. Fractus, 2009.
Infringement Chart—LG MUZIQ LX570. U.S. Pat. No. 7,123,208. Fractus, 2009.
Infringement Chart—LG MUZIQ LX570. U.S. Pat. No. 7,394,432. Fractus, 2009.
Infringement Chart—LG MUZIQ LX570. U.S. Pat. No. 7,397,341. Fractus, 2009.

(56) References Cited

OTHER PUBLICATIONS

Infringement Chart—Palm Centro 690. Fractus, 2009.
Infringement Chart—Palm Centro 690. U.S. Pat. No. 7,015,868. Fractus, 2009.
Infringement Chart—Palm Centro 690. U.S. Pat. No. 7,123,208. Fractus, 2009.
Infringement Chart—Palm Centro 690. U.S. Pat. No. 7,397,431. Fractus, 2009.
Infringement Chart—Palm Centro 690. U.S. Pat. No. 7,528,782. Fractus, 2009.
Infringement Chart—Palm Pre. Fractus, 2009.
Infringement Chart—Palm Pre. U.S. Pat. No. 7,015,868. Fractus, 2009.
Infringement Chart—Palm Pre. U.S. Pat. No. 7,123,208. Fractus, 2009.
Infringement Chart—Palm Pre. U.S. Pat. No. 7,397,431. Fractus, 2009.
Infringement Chart—Palm Pre. U.S. Pat. No. 7,528,782. Fractus, 2009.
Infringement Chart—Pantech Breeze C520. Fractus, 2009.
Infringement Chart—Pantech Breeze C520. U.S. Pat. No. 7,015,868. Fractus, 2009.
Infringement Chart—Pantech Breeze C520. U.S. Pat. No. 7,123,208. Fractus, 2009.
Infringement Chart—Pantech C610. Fractus, 2009.
Infringement Chart—Pantech C610. U.S. Pat. No. 7,015,868. Fractus, 2009.
Infringement Chart—Pantech C610. U.S. Pat. No. 7,123,208. Fractus, 2009.
Infringement Chart—Pantech C610. U.S. Pat. No. 7,394,432. Fractus, 2009.
Infringement Chart—Pantech C610. U.S. Pat. No. 7,397,431. Fractus, 2009.
Infringement Chart—Pantech C610. U.S. Pat. No. 7,528,782. Fractus, 2009.
Infringement Chart—Pantech C740. Fractus, 2009.
Infringement Chart—Pantech C740. U.S. Pat. No. 7,015,868. Fractus, 2009.
Infringement Chart—Pantech C740. U.S. Pat. No. 7,123,208. Fractus, 2009.
Infringement Chart—Pantech C740. U.S. Pat. No. 7,394,432. Fractus, 2009.
Infringement Chart—Pantech C740. U.S. Pat. No. 7,397,431. Fractus, 2009.
Infringement Chart—Pantech C740. U.S. Pat. No. 7,528,782. Fractus, 2009.
Infringement Chart—Pantech DUO C810. Fractus, 2009.
Infringement Chart—Pantech DUO C810. U.S. Pat. No. 7,015,868. Fractus, 2009.
Infringement Chart—Pantech DUO C810. U.S. Pat. No. 7,123,208. Fractus, 2009.
Infringement Chart—Pantech DUO C810. U.S. Pat. No. 7,394,432. Fractus, 2009.
Infringement Chart—Pantech DUO C810. U.S. Pat. No. 7,397,431. Fractus, 2009.
Infringement Chart—Pantech DUO C810. U.S. Pat. No. 7,528,782. Fractus, 2009.
Infringement Chart—Pantech Slate C530. Fractus, 2009.
Infringement Chart—Pantech Slate C530. U.S. Pat. No. 7,015,868. Fractus, 2009.
Infringement Chart—Pantech Slate C530. U.S. Pat. No. 7,123,208. Fractus, 2009.
Infringement Chart—Pantech Slate C530. U.S. Pat. No. 7,394,432. Fractus, 2009.
Infringement Chart—Pantech Slate C530. U.S. Pat. No. 7,397,431. Fractus, 2009.
Infringement Chart—Pantech Slate C530. U.S. Pat. No. 7,528,782. Fractus, 2009.
Infringement Chart—RIM Blackberry 8100. U.S. Pat. No. 7,015,868. Fractus, 2009.
Infringement Chart—RIM Blackberry 8100. U.S. Pat. No. 7,394,432. Fractus, 2009.
Infringement Chart—RIM Blackberry 8100. U.S. Pat. No. 7,397,431. Fractus, 2009.
Infringement Chart—RIM Blackberry 8100. U.S. Pat. No. 7,528,782. Fractus, 2009.
Infringement Chart—RIM Blackberry 8100. U.S. Pat. No. 7,123,208. Fractus, 2009.
Infringement Chart—RIM Blackberry 8110. Fractus, 2009.
Infringement Chart—RIM Blackberry 8110. U.S. Pat. No. 7,015,868. Fractus, 2009.
Infringement Chart—RIM Blackberry 8110. U.S. Pat. No. 7,123,208. Fractus, 2009.
Infringement Chart—RIM Blackberry 8110. U.S. Pat. No. 7,397,431. Fractus, 2009.
Infringement Chart—RIM Blackberry 8110. U.S. Pat. No. 7,528,782. Fractus, 2009.
Infringement Chart—RIM Blackberry 8120. Fractus, 2009.
Infringement Chart—RIM Blackberry 8120. U.S. Pat. No. 7,015,868. Fractus, 2009.
Infringement Chart—Samsung Magnet (SGH-A257). U.S. Pat. No. 7,123,208. Fractus, 2009.
Infringement Chart—Samsung Messager. Fractus, 2009.
Infringement Chart—Samsung Messager. U.S. Pat. No. 7,015,868. Fractus, 2009.
Infringement Chart—Samsung Messager. U.S. Pat. No. 7,123,208. Fractus, 2009.
Infringement Chart—Samsung Messager. U.S. Pat. No. 7,394,432. Fractus, 2009.
Infringement Chart—Samsung Messager. U.S. Pat. No. 7,397,431. Fractus, 2009.
Infringement Chart—Samsung Messager. U.S. Pat. No. 7,528,782. Fractus, 2009.
Infringement Chart—Samsung Omnia SGH-I900. Fractus, 2009.
Infringement Chart—Samsung Omnia SGH-I900. U.S. Pat. No. 7,015,868. Fractus, 2009.
Infringement Chart—Samsung Omnia SGH-I900. U.S. Pat. No. 7,123,208. Fractus, 2009.
Infringement Chart—Samsung Omnia SGH-I900. U.S. Pat. No. 7,394,432. Fractus, 2009.
Infringement Chart—Samsung Omnia SGH-I900. U.S. Pat. No. 7,397,431. Fractus, 2009.
Infringement Chart—Samsung Omnia SGH-I900. U.S. Pat. No. 7,528,782. Fractus, 2009.
Infringement Chart—Samsung SCH-A630. Fractus, 2009.
Infringement Chart—Samsung SCH-A630. U.S. Pat. No. 7,015,868. Fractus, 2009.
Infringement Chart—Samsung SCH-A630. U.S. Pat. No. 7,397,431. Fractus, 2009.
Infringement Chart—Samsung SCH-A630. U.S. Pat. No. 7,528,782. Fractus, 2009.
Infringement Chart—Samsung SCH-A645. Fractus, 2009.
Infringement Chart—Samsung SCH-A645. U.S. Pat. No. 7,394,32. Fractus, 2009.
Infringement Chart—Samsung SCH-A645. U.S. Pat. No. 7,015,868. Fractus, 2009.
Infringement Chart—Samsung SCH-A645. U.S. Pat. No. 7,123,208. Fractus, 2009.
Infringement Chart—Samsung SCH-A645. U.S. Pat. No. 7,397,431. Fractus, 2009.
Infringement Chart—Samsung SCH-A645. U.S. Pat. No. 7,528,782. Fractus, 2009.
Infringement Chart—Samsung SCH-A870. Fractus, 2009.
Infringement Chart—Samsung SCH-A870. U.S. Pat. No. 7,015,868. Fractus, 2009.
Infringement Chart—Samsung SCH-A870. U.S. Pat. No. 7,123,208. Fractus, 2009.
Infringement Chart—Samsung SCH-A870. U.S. Pat. No. 7,397,431. Fractus, 2009.
Infringement Chart—Samsung SCH-A870. U.S. Pat. No. 7,528,782. Fractus, 2009.
Infringement Chart—Samsung SCH-A887. U.S. Pat. No. 7,394,432. Fractus, 2009.

(56) References Cited

OTHER PUBLICATIONS

Infringement Chart—Samsung SCH-I910. Fractus, 2009.
Infringement Chart—Samsung SCH-I910. U.S. Pat. No. 7,015,868. Fractus, 2009.
Infringement Chart—Samsung SCH-I910. U.S. Pat. No. 7,123,208. Fractus, 2009.
Infringement Chart—Samsung SCH-I910. U.S. Pat. No. 7,394,432. Fractus, 2009.
Infringement Chart—Samsung SCH-I910. U.S. Pat. No. 7,397,431. Fractus, 2009.
Infringement Chart—Samsung SCH-I910. U.S. Pat. No. 7,528,782. Fractus, 2009.
Infringement Chart—Samsung SCH-R430. Fractus, 2009.
Infringement Chart—Samsung SCH-R430. U.S. Pat. No. 7,015,868. Fractus, 2009.
Infringement Chart—Samsung SCH-R430. U.S. Pat. No. 7,123,208. Fractus, 2009.
Infringement Chart—Samsung SCH-R430. U.S. Pat. No. 7,394,432. Fractus, 2009.
Infringement Chart—Samsung SCH-R430. U.S. Pat. No. 7,397,431. Fractus, 2009.
Infringement Chart—Samsung SCH-R430. U.S. Pat. No. 7,528,782. Fractus, 2009.
Infringement Chart—Samsung SCH-R500.. Fractus, 2009.
Infringement Chart—Samsung SCH-R500. U.S. Pat. No. 7,015,868. Fractus, 2009.
Infringement Chart—Samsung SCH-R500. U.S. Pat. No. 7,123,208. Fractus, 2009.
Infringement Chart—Samsung SCH-R500. U.S. Pat. No. 7,397,431. Fractus, 2009.
Infringement Chart—Samsung SCH-R500. U.S. Pat. No. 7,528,782. Fractus, 2009.
Infringement Chart—Samsung SCH-R600. Fractus, 2009.
Infringement Chart—Samsung SCH-R600. U.S. Pat. No. 7,015,868. Fractus, 2009.
Infringement Chart—Samsung SCH-R600. U.S. Pat. No. 7,123,208. Fractus, 2009.
Infringement Chart—Samsung SCH-R600. U.S. Pat. No. 7,397,431. Fractus, 2009.
Infringement Chart—HTC Touch Pro 2. U.S. Pat. No. 7,528,782. Fractus, 2009.
Infringement Chart—HTC Touch Pro Fuze. Fractus, 2009.
Infringement Chart—HTC Touch Pro Fuze. U.S. Pat. No. 7,015,868. Fractus, 2009.
Infringement Chart—HTC Touch Pro Fuze. U.S. Pat. No. 7,123,208. Fractus, 2009.
Infringement Chart—HTC Touch Pro Fuze. U.S. Pat. No. 7,394,432. Fractus, 2009.
Infringement Chart—HTC Touch Pro Fuze. U.S. Pat. No. 7,397,431. Fractus, 2009.
Infringement Chart—HTC Touch Pro Fuze. U.S. Pat. No. 7,528,782. Fractus, 2009.
Infringement Chart—HTC Touch Pro. Fractus, 2009.
Infringement Chart—HTC Touch Pro. U.S. Pat. No. 7,015,868. Fractus, 2009.
Infringement Chart—HTC Touch Pro. U.S. Pat. No. 7,123,208. Fractus, 2009.
Infringement Chart—HTC Touch Pro. U.S. Pat. No. 7,397,431. Fractus, 2009.
Infringement Chart—HTC Touch Pro. U.S. Pat. No. 7,528,782. Fractus, 2009.
Infringement Chart—HTC Wing. Fractus, 2009.
Infringement Chart—HTC Wing. U.S. Pat. No. 7,015,868. Fractus, 2009.
Infringement Chart—HTC Wing. U.S. Pat. No. 7,123,208. Fractus, 2009.
Infringement Chart—HTC Wing. U.S. Pat. No. 7,394,432. Fractus, 2009.
Infringement Chart—HTC Wing. U.S. Pat. No. 7,397,431. Fractus, 2009.
Infringement Chart—HTC Wing. U.S. Pat. No. 7,528,782. Fractus, 2009.
Infringement Chart—Kyocera Jax. Fractus, 2009.
Infringement Chart—Kyocera Jax. U.S. Pat. No. 7,015,868. Fractus, 2009.
Infringement Chart—Kyocera Jax. U.S. Pat. No. 7,123,208. Fractus, 2009.
Infringement Chart—Kyocera Jax. U.S. Pat. No. 7,394,432. Fractus, 2009.
Infringement Chart—Kyocera Jax. U.S. Pat. No. 7,397,431. Fractus, 2009.
Infringement Chart—Kyocera Jax. U.S. Pat. No. 7,528,782. Fractus, 2009.
Infringement Chart—Kyocera MARBL. Fractus, 2009.
Infringement Chart—Kyocera MARBL. U.S. Pat. No. 7,015,868. Fractus, 2009.
Infringement Chart—Kyocera MARBL. U.S. Pat. No. 7,123,208. Fractus, 2009.
Infringement Chart—Kyocera MARBL. U.S. Pat. No. 7,397,431. Fractus, 2009.
Infringement Chart—Kyocera MARBL. U.S. Pat. No. 7,528,782. Fractus, 2009.
Infringement Chart—Kyocera NEO E1100. Fractus, 2009.
Infringement Chart—Kyocera NEO E1100. U.S. Pat. No. 7,015,868. Fractus, 2009.
Infringement Chart—Kyocera NEO E1100. U.S. Pat. No. 7,123,208. Fractus, 2009.
Infringement Chart—Kyocera NEO E1100. U.S. Pat. No. 7,394,432. Fractus, 2009.
Infringement Chart—Kyocera NEO E1100. U.S. Pat. No. 7,397,431. Fractus, 2009.
Infringement Chart—Kyocera NEO E1100. U.S. Pat. No. 7,528,782. Fractus, 2009.
Infringement Chart—Kyocera S2400. Fractus, 2009.
Infringement Chart—Kyocera S2400. U.S. Pat. No. 7,015,868. Fractus, 2009.
Infringement Chart—Kyocera S2400. U.S. Pat. No. 7,123,208. Fractus, 2009.
Infringement Chart—Kyocera S2400. U.S. Pat. No. 7,394,432. Fractus, 2009.
Infringement Chart—Kyocera S2400. U.S. Pat. No. 7,397,431. Fractus, 2009.
Infringement Chart—Kyocera S2400. U.S. Pat. No. 7,528,782. Fractus, 2009.
Infringement Chart—Kyocera Wildcard M1000. Fractus, 2009.
Infringement Chart—Kyocera Wildcard M1000. U.S. Pat. No. 7,015,868. Fractus, 2009.
Infringement Chart—Kyocera Wildcard M1000. U.S. Pat. No. 7,123,208. Fractus, 2009.
Infringement Chart—Kyocera Wildcard M1000. U.S. Pat. No. 7,397,431. Fractus, 2009.
Infringement Chart—Kyocera Wildcard M1000. U.S. Pat. No. 7,528,782. Fractus, 2009.
Infringement Chart—LG 300G. Fractus, 2009.
Infringement Chart—LG 300G. U.S. Pat. No. 7,015,868. Fractus, 2009.
Infringement Chart—LG 300G. U.S. Pat. No. 7,123,208. Fractus, 2009.
Infringement Chart—HTC Touch Pro 2. U.S. Pat. No. 7,015,868. Fractus. Nov. 5, 2009.
Infringement Chart—Samsung SGH-T559. U.S. Pat. No. 7,397,431. Fractus, 2009.
Infringement Chart—Samsung SGH-T559. U.S. Pat. No. 7,528,782. Fractus, 2009.
Infringement Chart—Samsung SGH-T639. Fractus, 2009.
Infringement Chart—Samsung SGH-T639. U.S. Pat. No. 7,015,868. Fractus, 2009.
Infringement Chart—Samsung SGH-T639. U.S. Pat. No. 7,123,208. Fractus, 2009.
Infringement Chart—Samsung SGH-T639. U.S. Pat. No. 7,394,432. Fractus, 2009.
Infringement Chart—Samsung SGH-T639. U.S. Pat. No. 7,397,431. Fractus, 2009.

(56) References Cited

OTHER PUBLICATIONS

Infringement Chart—Samsung SGH-T639. U.S. Pat. No. 7,528,782. Fractus, 2009.
Infringement Chart—Samsung SGH-T739. Fractus, 2009.
Infringement Chart—Samsung SGH-T739. U.S. Pat. No. 7,015,868. Fractus, 2009.
Infringement Chart—Samsung SGH-T739. U.S. Pat. No. 7,123,208. Fractus, 2009.
Infringement Chart—Samsung SGH-T739. U.S. Pat. No. 7,394,432. Fractus, 2009.
Infringement Chart—Samsung SGH-T739. U.S. Pat. No. 7,397,431. Fractus, 2009.
Infringement Chart—Samsung SGH-T739. U.S. Pat. No. 7,528,782. Fractus, 2009.
Infringement Chart—Samsung SGH-T819. Fractus, 2009.
Infringement Chart—Samsung SGH-T819. U.S. Pat. No. 7,015,868. Fractus, 2009.
Infringement Chart—Samsung SGH-T819. U.S. Pat. No. 7,123,208. Fractus, 2009.
Infringement Chart—Samsung SGH-T819. U.S. Pat. No. 7,394,432. Fractus, 2009.
Infringement Chart—Samsung SGH-T819. U.S. Pat. No. 7,397,431. Fractus, 2009.
Infringement Chart—Samsung SGH-T819. U.S. Pat. No. 7,528,782. Fractus, 2009.
Infringement Chart—Samsung SGH-T929. Fractus, 2009.
Infringement Chart—Samsung SGH-T929. U.S. Pat. No. 7,015,868. Fractus, 2009.
Infringement Chart—Samsung SGH-T929. U.S. Pat. No. 7,123,208. Fractus, 2009.
Infringement Chart—Samsung SGH-T929. U.S. Pat. No. 7,394,432. Fractus, 2009.
Infringement Chart—Samsung SGH-T929. U.S. Pat. No. 7,397,431. Fractus, 2009.
Infringement Chart—Samsung SGH-T929. U.S. Pat. No. 7,528,782. Fractus, 2009.
Infringement Chart—Samsung SGH A 437. U.S. Pat. No. 7,015,868. Fractus, 2009.
Infringement Chart—Samsung SGH A 437. U.S. Pat. No. 7,394,432. Fractus, 2009.
Infringement Chart—Samsung SGH A117. Fractus, 2009.
Infringement Chart—Samsung SGH A117. U.S. Pat. No. 7,015,868. Fractus, 2009.
Infringement Chart—Samsung SGH A117. U.S. Pat. No. 7,123,208. Fractus, 2009.
Infringement Chart—Samsung SGH A117. U.S. Pat. No. 7,397,431. Fractus, 2009.
Infringement Chart—Samsung SGH A117. U.S. Pat. No. 7,528,782. Fractus, 2009.
Infringement Chart—Samsung SGH A127. U.S. Pat. No. 7,123,208. Fractus, 2009.
Infringement Chart—Samsung SGH A127. U.S. Pat. No. 7,015,868. Fractus, 2009.
Infringement Chart—Samsung SGH A127. U.S. Pat. No. 7,397,431. Fractus, 2009.
Infringement Chart—Samsung SGH A127. U.S. Pat. No. 7,528,782. Fractus, 2009.
Infringement Chart—Samsung SGH A437. Fractus, 2009.
Infringement Chart—Samsung SGH A437. U.S. Pat. No. 7,123,208. Fractus, 2009.
Infringement Chart—Samsung SGH A437. U.S. Pat. No. 7,397,431. Fractus, 2009.
Infringement Chart—Samsung SGH A437. U.S. Pat. No. 7,528,782. Fractus, 2009.
Infringement Chart—Samsung SGH A737. Fractus, 2009.
Infringement Chart—Samsung SGH A737. U.S. Pat. No. 7,015,868. Fractus, 2009.
Infringement Chart—Samsung SGH A737. U.S. Pat. No. 7,123,208. Fractus, 2009.
Infringement Chart—Samsung SGH A737. U.S. Pat. No. 7,394,432. Fractus, 2009.
Infringement Chart—Samsung SGH A737. U.S. Pat. No. 7,397,431. Fractus, 2009.
Infringement Chart—Samsung SGH A737. U.S. Pat. No. 7,528,782. Fractus, 2009.
Infringement Chart—Samsung SGH A867. Fractus, 2009.
Infringement Chart—Samsung SGH A867. U.S. Pat. No. 7,015,868. Fractus, 2009.
Infringement Chart—Samsung SGH A867. U.S. Pat. No. 7,123,208. Fractus, 2009.
Carver, K. R. et al. Microstrip antenna technology. in "Microstrip antennas" to D.M. Pozar; IEEE Antennas and Propagation Society.. pp. 3-26. Jan. 1, 1995.
Carver, K. R. et al. Microstrip antenna technology. Antennas and Propagation, IEEE Transactions on. vol. 29. No. 1. Jan. 1, 1981.
Caswell, W. E. Invisible errors in dimensions calculations: geometric and systematic effects. Dimensions and Entropies in Chaotic Systems.. pp. 123-136. Jan. 1, 1986.
Chang, Jungming et al Hybrid fractal cross antenna. Microwave and Optical Technology Letters. Jun. 20, 2000.
Chen, H. Dual frequency microstrip antenna with embedded reactive loading. Microwave and Optical Technology Letters. vol. 23. No. 3. Nov. 5, 1999.
Chen, M.H. A compact EHF/SHF dual frequency antenna. IEEE International Symposium on Antennas and Propagation. May 7, 1990.
Chen, S. et al. On the calculation of Fractal features from images. IEEE Transactions on Pattern Analysis and Machine Intelligence. vol. 15. No. 10. Oct. 1, 1993.
Chen, Wen-Shyang Square-ring microstrip antenna with a cross strip for compact circular polarization operation. Antennas and Propagation, IEEE Transactions on. Oct. 1, 1999.
Chen, X.; Ying, Z. Small Antenna Design for Mobile Handsets (part I). Sony Ericsson. Mar. 25, 2009.
Chen, Zhi Ning; Chia, Michael Y.W. Broadband rectangular slotted plate antenna. Antennas and Propagation Society International Symposium, 2000. IEEE. Jul. 16, 2000.
Chiba, N. et al Dual frequency planar antenna for handsets. Electronic Letters. Dec. 10, 1998.
Cho, M. et al Modified slot-loaded triple-band microstrip patch antenna. Antennas and Propagation Society International Symposium, 2002. IEEE. Jun. 16, 2002.
Cohen, N. Fractal element antennas. Journal of Electronic Defense. Jul. 1, 1997.
Cohen, N. Fractal and shaped dipoles—Some simple fractal dipoles, their benefits and limitations. Communications Quarterly. Mar. 1, 1996.
Cohen, N. Fractal antenna applications in wireless telecommunications. IEEE Electronic Industries Forum of New England. Professional Program Proceedings Boston. pp. 43-49. May 6, 1997.
Cohen, N. Fractal antennas—Part 1—Introduction and the fractal quad. Communications quarterly. Jul. 1, 1995.
Cohen, N. Fractal antennas—Part 2—A discussion of relevant, but disparate, qualities. Communications quarterly. Jul. 1, 1996.
Cohen, N. NEC4 analysis of a fractalized monofiliar helix in an axial mode. ACES Conference Procedings. p. 1051. Apr. 1, 1998.
Cohn, S. B. Flush airborne radar antennas. Symposium on the USAF antenna research and development program, 3rd. Oct. 18, 1953.
Collier, C. P. Geometry for teachers. Waveland Press, Inc.. Jan. 1, 1984.
Collier, D.; Shnitkin, H. The monopole as a wideband array antenna element. Antenna Applications Symposium. Sep. 22, 1993.
Counter, V. A. Flush, re-entrant, impedance phased, circularly polarized cavity antenna for missiles. Symposium on the USAF antenna research and development program, 2nd. Oct. 19, 1952.
Counter, V. A.; Margerum, D. L. Flush dielectric disc antenna for radar. Symposium on the USAF antenna research and development program, 2nd. Oct. 19, 1952.
Cristal, E. G. et al Hairpin-line and hybrid hairpin-line / Half-wave parallel-coupled-line filers. Microwave Theory and Techniques, IEEE Transactions on. Nov. 1, 1972.

(56) References Cited

OTHER PUBLICATIONS

Croq, F.; Pozar, David M. Multifrequency operation of microstrip antennas using aperture coupled parallel resonators. Antennas and Propagation, IEEE Transactions on Nov. 1, 1992.
Daniel, A. E.; Kumar, G. Rectangular microstrip antennas with stub along the non-radiating edge for dual band operation. IEEE Antennas and Propagation Society International Symposium Digest. vol. 4. pp. 2136-2139. Jun. 18, 1995.
Deng, Sheng-Ming A t-strip loaded rectangular microstrip patch antenna for dual-frequency operation. Antennas and Propagation Society International Symposium, 1999. IEEE. Jul. 1, 1999.
Deschamps, G. Microstrip Microwave Antenna. Symposium on the USAF Antenna Research and Development Program. Oct. 18, 1953.
Dickstein, Harold D. Antenna system for a ground passive electronic reconnaissance facility. Symposium on the USAF Antenna Research and Development Program. Oct. 20, 1958.
Du Plessis, M.; Cloete, J. H. Tuning stubs for microstrip patch antennas. AP-S. Digest Antennas and Propagation Society International Symposium. vol. 2. pp. 964-967. Jun. 28, 1993.
Dubost, G. Wideband flat dipole and short-circuit microstrip patch elements and arrays. In Handbook of microstrip antennas—Chapter 7. Peter Peregrinus Ltd. James, J. R.; Hall, P. S. (ed.). vol. 1. pp. 354-359. Jan. 1, 1989.
DuHamel, R. H. Broadband logarithmically periodic antenna structures. IRE International Convention Record. vol. 5. pp. 119-128. Mar. 14, 1957.
Durgun, A. C.; Reese, M. S.; Balanis, C. A. et al Flexible bow-tie antennas with reduced metallization. IEEE Radio and Wireless Symposium (RWS). pp. 50-53. Jan. 16, 2011.
Dyson, J. D. The equiangular spiral antenna. Antennas and Propagation, IRE Transactions on Apr. 1, 1959.
Dyson, J. D. The non-planar equiangular spiral antenna. Symposium on the USAF Antenna Research and Development Program. Oct. 20, 1958.
Ellis, A. R. Airborne UHF antenna pattern improvements. Symposium on the USAF antenna research and development program, 3rd. Oct. 18, 1953.
Esteban, J.; Rebollar, J. M. Design and optimization of a compact Ka-Band antenna diplexer. AP-S. Digest Antennas and Propagation Society International Symposium. Jun. 18, 1995.
Falconer, K. Fractal geometry_Full. John Wiley Sons—2nd ed. Jan. 1, 2003.
Falconer, K. Fractal geometry. Mathematical foundations and applications. John Wiley and Sons. pp. 38-41. Jan. 1, 1990.
Falconer, K. Fractal Geometry: Mathematical Foundations and Applications. John Wiley & Sons. pp. 38-44. Jan. 1, 1990.
Feder, J. Fractals. Plenum Press. pp. 10-11, 15-17, and 25. Jan. 1, 1988.
Feng, J. Fractional box-counting approach to fractal dimension estimation. Pattern Recognition, 1996., Proceedings of the 13th International Conference on. Jan. 1, 1996.
Fenwick, R. C. A new class of electrically small antennas. Antennas and Propagation, IEEE Transactions on. May 1, 1965.
Ferris, J. E. A status report of an Azimuth and elevation direction finder. Symposium on the USAF Antenna Research and Development Program. Oct. 15, 1968.
Fleishmann, M.; Tildesley, DJ; Balls, RC Fractals in the natural sciences. Royal Society of London. Jan. 1, 1999.
Force, R. et al. Synthesis of multilayer walls for radomes of aerospace vehicles. Symposium on the USAF Antenna Research and Development Program. Nov. 14, 1967.
Foroutan-pour, K.; Dutilleul, P.; Smith, D.L. Advances in the implementation of the box-counting method of fractal dimension estimation. Applied Mathematics and Computation; Elsevier. vol. 105. pp. 195-210. May 1, 1999.
Fuhl, J. et al Improved internal antenna for handheld terminal. Electronic Letters. Oct. 27, 19945.
George, J.; Aanandan, C. K.; Mohanan, P. et al Analysis of a new compact microstrip antenna. Antennas and Propagation, IEEE Transactions on. Nov. 1, 1998.
Gianvittorio, John Paul et al. Fractal antenna research at UCLA. UCLA Antenna Lab. Nov. 19, 1999.
Kim, K. et al Integrated dipole antennas on silicon substrates for intra-chip communication. Antennas and Propagation, IEEE Transactions on. Jan. 1, 1999.
Kim, Kyu-Sung et al. Dual-frequency aperture-coupled square patch antenna with double notches. Microwave and Optical Technology Letters. vol. 24. No. 6. Mar. 20, 2000.
Kobayashi, K. Estimation of 3D fractal dimension of real electrical tree patterns. Proceedings of the 4th International Conference on Properties and Applications of Dielectric Materials. Jul. 1, 1994.
Kraus, John D. Antennas. McGraw-Hill Book Company.. Contents. Jan. 1, 1988.
Kraus, John D. Antennas—Chapter 2. McGraw-Hill Book Company. . pp. 17-19, 723-749. Jan. 1, 1988.
Kronberger, R. et al. Multiband planar inverted-F car antenna for mobile phone and GPS. Antennas and Propagation Society International Symposium, 1999. IEEE. Aug. 2, 1999.
Kuhlman, E. A. A directional flush mounted UHF communications antenna for high performance jet aircraft for the 225-400 MC frequency range. Symposium on The USAF Antenna Research and Development Program, 5th. Oct. 1, 1955.
Kumar, G.; Gupta, K. Nonradiating edges and four edges gap-coupled multiple resonator broadband microstrip antennas. Antennas and Propagation, IEEE Transactions on. Feb. 1, 1985.
Kumar, G.; Gupta, K. Directly coupled multiple resonator wide-band microstrip antennas. IEEE Transactions on Antennas and Propagation. Jun. 6, 1985.
Kumprasert, N. Theoretical study of dual resonant frequency and circular polarization of elliptical microstrip antennas. Antennas and Propagation Society International Symposium, 2000. IEEE. Jul. 1, 2000.
Kuo, Sam Frequency-independent log-periodic antenna arrays with increased directivity and gain. Symposium on USAF Antenna Research and Development, 21th Annual. Oct. 12, 1971.
Kurpis, G. P. The New IEEE standard dictionary of electrical and electronics terms. IEEE Standards. pp. 90, 352, 393. Jan. 1, 1993.
Kutter, R. E. Fractal antenna design. University of Dayton. Jan. 1, 1996.
Kyriacos, S.; Buczkowski, S. et al. A modified box-counting method. Fractals—World Scientific Publishing Company. vol. 2. No. 2. pp. 321-324. Jan. 1, 1994.
Lancaster, M. J. et al Superconducting filters using slow-wave transmission lines. Advances in superconductivity. New materials, critical current and devices. Proceedings of the international symposium. New age int, New Delhi, India. Jan. 1, 1996.
Lancaster, M. J. et al. Miniature superconducting filters. Microwave Theory and Techniques, IEEE Transactions on. Jul. 1, 1996.
Lauwerier, H. Fractals. Endlessly repeated geometrical figures. Princeton University Press. Jan. 1, 1991.
Lee, J. C. Analysis of differential line lenght diplexers and long-stub filters. Symposium on the USAF Antenna Research and Development, 23th. Oct. 12, 1971.
Liang, Xu Multiband characteristics of two fractal antennas. Microwave and Optical Technology Letters. Nov. 20, 1999, 1993.
Liu, D. A multi-branch monopole antenna for dual-band cellular applications. IEEE Antennas and Propagation Society International Symposium. Sep. 3, 1999.
Liu, Duixian A dual band antenna for cellular applications. Antennas and Propagation Society International Symposium, 1998. AP-S. Digest. Jun. 21, 1998.
Liu, Z.; Hall, P.S. A novel dual-band antenna for hand-held portable telephone. Antennas and Propagation Society International Symposium, 1996. AP-S. Digest. Jul. 21, 1996.
Liu, Z. D. et al Dual band antenna for handheld portable telephones. Electronic Letters. Mar. 28, 1996.
Liu, Zi Dong; Hall, Peter S.; Wake, David Dual-frequency planar inverted-f antenna. Antennas and Propagation, IEEE Transactions on. Oct. 1, 1997.
Lo, Y. T.; Solomon, D.; Richards, W. F. Theory and experiment on microstrip antennas. Antenna Applications Symposium. Sep. 20, 1978.

(56) References Cited

OTHER PUBLICATIONS

Locus, Stanley S. Antenna design for high performance missile environment. Symposium on the USAF Antenna Research and Development Program, 5th. Oct. 16, 1955.
Lu , J. H.; Wong, K. L. Dual-frequency rectangular microstrip antenna with embedded spur lines and integrated reactive loading. Microwave and Optical Technology Letters. May 20, 1999.
Lu, J. H.; Wong, K. L. Single-feed dual-frequency equilateral-triangular microstrip antenna with pair of spur lines. Electronic Letters. Jun. 11, 1998.
Lu, J.H.; Tang, C. L.; Wong, K. L. Novel dual-frequency and broadband designs of slot-loaded equilateral triangular; microstrip antennas. IEEE Transactions on Antennas and Propagation. Jul. 1, 2000.
Lu, Jui Han Single-feed circularly polarized triangular microstrip antenna with triangular slot for compact operation. Microwave and Optical Technology Letters. Aug. 20, 2002.
Lu, Jui Han Slot loaded rectangular microstrip antenna for dual frequency operation. Microwave and Optical Technology Letters. Feb. 20, 2000.
Lu, Jui-Han Single feed circularly polarized triangular microstrip antennas. Antennas and Propagation Society International Symposium, 1999. IEEE. Jul. 11, 1999.
Lu, Jui-Han Single-feed dual-frequency rectangular microstrip antenna. Antennas and Propagation Society International Symposium, 2000. IEEE. Jul. 1, 2000.
Lu, Jui-Han; Tang, Chia-Luan; Wong, Kin-Lu Single-feed slotted equilateral triangular microstrip antenna for circular polarization. Antennas and Propagation, IEEE Transactions on. Jul. 1, 1999.
Lu, Jui-Han et al. Slot-loaded, Meandered Rectangular Microstrip Antenna With Compact Dualfrequency Operation. IEEE Electronics Letters. vol. 34. No. 11. May 28, 1998.
Luk, K. M.; Guo, K. F. et al. L-probe proximity fed U-slot patch antenna. Electronic Letters. vol. 34. No. 19. pp. 1806-1807. Sep. 17, 1998.
Lyon, J.; Rassweiler, G.; Chen, C. Ferrite-loading effects on helical and spiral antennas. 15th Annual Symposium on the USAF antenna reserach and development program. Oct. 12, 1965.
Maci, S. et al. Dual-band Slot-loaded patch antenna. IEE Proceedings Microwave Antennas Propagation. vol. 142. pp. 225-232. Jun. 1, 1995.
Maci, S. et al. Dual-frequency patch antennas. Antennas and Propagation Magazine, IEEE. Dec. 1, 1997.
Maci, S. et al. Single-layer dual frequency patch antenna. Electronic letters. Aug. 3, 1993.
Mandelbrot, B. B. Opinions (Benoit B. Mandelbrot). World Scientific Publishing Company—Case 6:09-cv-00203-LED-JDL. Jan. 1, 1993.
Mandelbrot, B. B. The fractal geometry of nature. H. B. Fenn and Company. Contents. Jan. 1, 1977.
Mandelbrot, B. B. The fractal geometry of nature. Freeman and Company. pp. 32-35. Jan. 1, 1982.
Martin, R. W.; Stangel, J. J. An unfurlable, high-gain log-periodic antenna for space use. Symposium on The USAF Antenna Research and Development Program. Nov. 14, 1967.
Martin, W. R. Flush vor antenna for c-121 aircraft. Symposium on The USAF Antenna Research and Development Program, 2nd. Oct. 19, 1952.
Matthaei, George L. Microwave filters impedance-matching networks and coupling structures. Artech House. p. 1096. Jan. 1, 1980.
Matthaei, George L. et al. Hairpin-comb filters for HTS and other narrow-band applications. Microwave Theory and Techniques, IEEE Transactions on. vol. 45. No. 3. Aug. 1, 1997.
May, M. Aerial magic. New Scientist. Jan. 31, 1998.
Mayes, P. Some broadband, low-profile antennas. Antenna Applications Symposium. Sep. 18, 1985.
Mayes, P. E. High gain log-periodic antennas. Symposium on the USAF antenna research and development program, 10th. Oct. 3, 1960.
Pozar, David M. Microwave Engineering—Chapter 12: Introduction to Microwave Systems. Addison-Wesley. pp. 663-666, 675-676. Jan. 1, 1990.
Pozar, David M.; Newman, E. Analysis of a Monopole Mounted near or at the Edge of a Half-Plane. IEEE Transactions on Antennas and Propagation. vol. 29. No. 3. May 1, 1981.
Pozar, David M.; Schaubert, Daniel H. Microstrip antennas. The analysis and design of microstrip antennas and arrays. IEEE Press; Pozar, Schaubert. p. 431. Jan. 1, 1995.
Pribetich, P.; Combet, Y. et al Quasifractal planar microstrip resonators for microwave circuits. Microwave and Optical Technology Letters. vol. 21. No. 6. pp. 433-436. Jun. 20, 1999.
Puente, C. Fractal antennas. Universitat Politecnica de Catalunya. May 1, 1997.
Puente, C. Fractal design of multiband antenna arrays. University of Illinois at Urbana-Champaign—Universitat Politècnica de Catalunya. Jan. 1, 1994.
Puente, C. Fractal multiband antenna based on the Sierpinski gasket. Electronic letters. Jan. 4, 1996.
Puente, C.; Anguera, J.; Romeu, J.; Borja, C.; Navarro, M.; Soler, J. Fractal-shaped antennas and their application to gsm 900 1800. Antennas and Propagation Society International Symposium, 2000. IEEE. Apr. 1, 2000.
Puente, C.; Borja, C.; Navarro, M. et al an iterative model for fractal antennas—application to the Sierpinski gasket antenna. Antennas and Propagation, IEEE Transactions on. May 1, 2000.
Puente, C.; Claret, J.; Sagues, F. et al Multiband properties of a fractal tree antenna generated by electrochemical deposition. Electronic Letters. vol. 32. No. 25. pp. 2298-2299. Dec. 5, 1996.
Puente, C.; Navarro, M.; Romeu, J.; Pous, R. Variations on the fractal sierpinski antenna flare angle. Antennas and Propagation Society International Symposium, 1998. AP-S. Digest. Jun. 1, 1998.
Puente, C.; Navarro, M.; Romeu, J. et al Efecto de la variacion angular del vertice de alimentacion en la antena fractal de Sierpinski. XII Simposium Nacional de la Unión Cientifica Internacional de la Radio (URSI) :Bilbao, 1997. Sep. 1, 1997.
Puente, C.; Pous, R. Diseño fractal de agrupaciones de antenas—Fractal design of antenna arrays. IX Simposium Nacional de la Unión Cientifica Internacional de la Radio (URSI) : La Palma, 1994. Sep. 1, 1994.
Puente, C.; Pous, R. Fractal design of multiband and low side-lobe arrays. Antennas and Propagation, IEEE Transactions on. vol. 44. No. 5. May 1, 1996.
Puente, C.; Romeu, J.; Bartolome, R.; Pous, R. Perturbation of the Sierpinski antenna to allocate operating bands. Electronic Letters. vol. 32. No. 24. Nov. 21, 1996.
Puente, C.; Romeu, J.; Cardama, A. Fractal-shaped antennas. Frontiers in electromagnetics—IEEE Press. Chapter 2. pp. 48-50. Jan. 1, 2000.
Puente, C.; Romeu, J.; Cardama, A.; Pous, R. Multiband fractal antennas and arrays. Fractals engineering—from theory to industrial applications. Jan. 1, 1997.
Puente, C.; Romeu, J.; Cardama, A.; Pous, R. On the behavior of the Sierpinski multiband fractal antenna. Antennas and Propagation, IEEE Transactions on. vol. 46. No. 4. Apr. 1, 1998.
Puente, C.; Romeu, J.; Cardama, A. The Koch monopole—a small fractal antenna. Antennas and Propagation, IEEE Transactions on. vol. 48. No. 11. Nov. 1, 2000.
Puente, C. et al Small but long Koch fractal monopole. Electronic Letters. vol. 34. pp. 9-10. Jan. 8, 1998.
Qing, Xianming; Chia, Y.W.M. A novel single feed circular polarized slotted loop antenna. Antennas and Propagation Society International Symposium, 1999. IEEE. Jul. 11, 1999.
Rademacher, H.; Toeplitz, O. The Enjoyment of Math. Princeton Science Library. pp. 164-169. Jan. 1, 1957.
Rahman, M. et al Dual band strip sleeve monopole for handheld telephones. Microwave and Optical Technology Letters. Apr. 20, 1999.
Rathi, Vivek; Kumar, Girish; Ray, K. P. Improved coupling for aperture coupled microstrip antennas. Electronic Letters. Jun. 20, 1991.
Ray, K.; Kumar, G. Multi-frequency and broadband hybrid-coupled circular microstrip antennas. Electronic Letters. Mar. 13, 1997.

(56) References Cited

OTHER PUBLICATIONS

Rensh, Y. A. Broadband microstrip antenna. Proceedings of the Moscow International Conference on Antenna Theory and Tech. vol. 28. pp. 420-423. Sep. 22, 1998.
Rich, Barnett Review of Elementary Mathematics 2d ed.1997. McGraw—Hill—Case 6:09-cv-00203-LED-JDL.. pp. 245-247. Jan. 1, 1997.
Rikuta, Yuko; Arai, Hiroyuki A self-diplexing antenna using stacked patch antennas. Antennas and Propagation Society International Symposium, 2000. IEEE. Jul. 1, 2000.
Romeu, J.; Blanch, S. A three dimensional hilbert antenna. Antennas and Propagation Society International Symposium, 2002. IEEE. Jun. 16, 2002.
Romeu, J.; Navarro, M.; Puente, C.; Berenguer, J. Dual fractal antennas for cellular telephony. Dual monopole microcell application. Fractus II. Electromagnetic and Photonic Engineering Group (EEF) Dept. of Signal Theory and Communications. Polythecnic University of Catalonia. May 28, 1998.
Romeu, J.; Navarro, M.; Puente, C.; Berenguer, J. Dual Fractal antennas for cellular telephony. Correction of truncation effect (CET). Electromagnetic and photonic engineering group (EEF). Dept. of Signal Theory and Communications. Polytechnic University of Catalonia. Nov. 20, 1997.
Romeu, J.; Navarro, M.; Puente, C.; Berenguer, J. Dual fractal antennas for cellular telphony—Adjustment of input impedance. P2/3SPK dual monopole. Electromagnetic and Photonic Engineering Group (EEF). Dep. of Signal Theory and Communications. Polytechnic University of Catalonia. Apr. 2, 1998.
Romeu, J.; Puente, C.; Cardama, J. Small fractal antennas. Fractals in engineering conference, India.. pp. 35-36. Jun. 1, 1999.
Romeu, J.; Rahmat-Samii, Y. Dual band FSS with fractal elements. Electronic Letters. Apr. 29, 1999.
Romeu, J.; Rahmat-Samii, Yahya A fractal based FSS with dual band characteristics. Antennas and Propagation Society International Symposium, 1999. IEEE. Aug. 1, 1999.
Rosa, J.; Case E. W. A wide angle circularly polarized omnidirectional array antenna. Symposium on the USAF antenna Research and Development Program, 18th. Oct. 15, 1968.
Roscoe, D. J. et al Tunable dipole antennas. Antennas and Propagation Society International Symposium, 1993. AP-S. Digest. Jun. 28, 1993.
Rotman, W. Problems encountered in the design of flush-mounted antennas for high speed aircraft. Symposium on the USAF Antenna Research and Development Program, 2nd. Oct. 19, 1952.
Rouvier, R. et al. Fractal analysis of bidimensional profiles and application to electromagnetic scattering from soils. IEEE. Jan. 1, 19960.
Rowell, C. R.; Murch, R.D. A capacitively loaded PIFA for compact mobile telephone handsets. Antennas and Propagation, IEEE Transactions on. May 1, 1997.
Rowell, Corbett R.; Murch, R. D. A compact PIFA suitable for dual-frequency 900-1800-MHz operation. Antennas and Propagation, IEEE Transactions on. Apr. 1, 1998.
Rumsey, V. Frequency independent antennas. Academic Press. pp. 2-3. Jan. 1, 1996.
Russell, D. A. et al. Dimension of strange attractors. Physical Review Letters. vol. 45. No. 14. Oct. 6, 1980.
Salvador, C. et al. Dual frequency planar antenna at S and X bands. Electronic Letters. vol. 31. pp. 1706-1707. Sep. 1, 1995.
Samavati, Hirad; Hajimiri, Ali et al Fractal capacitors. IEEE Journal of solid state circuits. vol. 33. No. 12. pp. 2035-2041. Dec. 1, 1998.
Sanad, Mohamed A compact dual broadband microstrip antenna having both stacked and planar parasitic elements. Antennas and Propagation Society International Symposium, 1996. AP-S. Digest. pp. 6-9. Jul. 21, 1996.
Sanad, Mohamed et al. An internal integrated microstrip antenna for PCS/cellular telephones and other hand-held portable communication equipment. Microwave Journal. Jul. 1, 1998.
Sanad, Mohamed et al. Compact internal multiband microstrip antennas for portable GPS, PCS, cellular and satellite phones. Microwave Journal. Jan. 1, 1999.
Sanchez Hernandez, David Single-fed dual band circularly polarised microstrip patch antennas. 28th EuMC. Sep. 9, 1996.
Sanchez Hernandez, David A survey of broadband microstrip patch antennas. Microwave Journal. Sep. 1, 1996.
Infringement Chart—LG MUZIQ LX570. U.S. Pat. No. 7,528,782. Fractus, 2009.
Infringement Chart—LG Rumor. Fractus, 2009.
Infringement Chart—LG Rumor 2. Fractus, 2009.
Infringement Chart—Rumor 2. U.S. Pat. No. 7,015,868. Fractus, 2009.
Infringement Chart—LG Rumor 2. U.S. Pat. No. 7,123,208. Fractus, 2009.
Infringement Chart—LG Rumor 2. U.S. Pat. No. 7,394,432. Fractus, 2009.
Infringement Chart—LG Rumor 2. U.S. Pat. No. 7,397,431. Fractus, 2009.
Infringement Chart—LG Rumor 2. U.S. Pat. No. 7,528,782. Fractus, 2009.
Infringement Chart—LG Rumor. U.S. Pat. No. 7,015,868. Fractus, 2009.
Infringement Chart—LG Rumor. U.S. Pat. No. 7,123,208. Fractus, 2009.
Infringement Chart—LG Rumor. U.S. Pat. No. 7,397,431. Fractus, 2009.
Infringement Chart—LG Rumor. U.S. Pat. No. 7,528,782. Fractus, 2009.
Infringement Chart—LG Shine CU720. Fractus, 2009.
Infringement Chart—LG Shine CU720. U.S. Pat. No. 7,015,868. Fractus, 2009.
Infringement Chart—LG Shine CU720. U.S. Pat. No. 7,123,208. Fractus, 2009.
Infringement Chart—LG Shine CU720. U.S. Pat. No. 7,394,432. Fractus, 2009.
Infringement Chart—LG Shine CU720. U.S. Pat. No. 7,397,431. Fractus, 2009.
Infringement Chart—LG Shine CU720. U.S. Pat. No. 7,528,782. Fractus, 2009.
Infringement Chart—LG UX280. Fractus, 2009.
Infringement Chart—LG UX280. U.S. Pat. No. 7,015,868. Fractus, 2009.
Infringement Chart—LG UX280. U.S. Pat. No. 7,394,432. Fractus, 2009.
Infringement Chart—LG UX280. U.S. Pat. No. 7,397,431. Fractus, 2009.
Infringement Chart—LG UX280. U.S. Pat. No. 7,528,782. Fractus, 2009.
Infringement Chart—LG UX280. U.S. Pat. No. 7,123,208. Fractus, 2009.
Infringement Chart—LG Versa VX9600. Fractus, 2009.
Infringement Chart—LG Versa VX9600. U.S. Pat. No. 7,015,868. Fractus, 2009.
Infringement Chart—LG Versa VX9600. U.S. Pat. No. 7,123,208. Fractus, 2009.
Infringement Chart—LG Versa VX9600. U.S. Pat. No. 7,397,431. Fractus, 2009.
Infringement Chart—LG Versa VX9600. U.S. Pat. No. 7,528,782. Fractus, 2009.
Infringement Chart—LG Voyager VX 10000. U.S. Pat. No. 7,528,782. Fractus, 2009.
Infringement Chart—LG Voyager VX10000. Fractus, 2009.
Infringement Chart—LG Voyager VX10000. U.S. Pat. No. 7,015,868. Fractus, 2009.
Infringement Chart—LG Voyager VX10000. U.S. Pat. No. 7,123,208. Fractus, 2009.
Infringement Chart—LG Voyager VX10000. U.S. Pat. No. 7,397,431. Fractus, 2009.
Infringement Chart—LG VU CU920. Fractus, 2009.
Infringement Chart—LG Vu CU920. U.S. Pat. No. 7,015,868. Fractus, 2009.

(56) References Cited

OTHER PUBLICATIONS

Infringement Chart—LG Vu CU920. U.S. Pat. No. 7,123,208. Fractus, 2009.
Infringement Chart—LG VU CU920. U.S. Pat. No. 7,394,432. Fractus, 2009.
Infringement Chart—LG VU CU920. U.S. Pat. No. 7,397,431. Fractus, 2009.
Infringement Chart—LG VU CU920. U.S. Pat. No. 7,528,782. Fractus, 2009.
Infringement Chart—LG VX 8800. U.S. Pat. No. 7,397,431. Fractus, 2009.
Infringement Chart—LG VX5400. Fractus, 2009.
Infringement Chart—LG VX5400. U.S. Pat. No. 7,015,868. Fractus, 2009.
Infringement Chart—LG VX5400. U.S. Pat. No. 7,123,208. Fractus, 2009.
Infringement Chart—LG VX5400. U.S. Pat. No. 7,397,431. Fractus, 2009.
Infringement Chart—LG VX5400. U.S. Pat. No. 7,528,782. Fractus, 2009.
Infringement Chart—LG VX5500. Fractus, 2009.
Infringement Chart—LG VX5500. U.S. Pat. No. 7,015,868. Fractus, 2009.
Infringement Chart—LG VX5500. U.S. Pat. No. 7,123,208. Fractus, 2009.
Infringement Chart—LG VX5500. U.S. Pat. No. 7,397,431. Fractus, 2009.
CN00818542—Response to Office Action dated on Nov. 5, 2004. Herrero Asociados. Mar. 31, 2005.
CN01823716—Office action dated on Feb. 16, 2007. CCPIT Patent and Trademark Law Office—Chinese Patent Office. Feb. 16, 2007.
CN01823716—Response to the office action dated on Feb. 16, 2007. CCPIT Patent and Trademark Law Office—Chinese Patent Office. Aug. 21, 2007.
CN01823716—Office action dated Sep. 21, 2007. CCPIT Patent and Trademark Law Office—Chinese Patent Office. Sep. 21, 2007.
CN01823716—Response to the office action dated on Sep. 21, 2007. CCPIT Patent and Trademark Law Office—Chinese Patent Office. Dec. 3, 2007.
EP00909089—Office Action dated on Feb. 7, 2003. European Patent Office EPO. Feb. 7, 2003.
EP00909089—Response to Office Action dated on Feb. 7, 2003. Herrero y Asociados. Aug. 14, 2003.
EP00909089—Summons to attend oral proceedings. EPO. Oct. 28, 2004.
EP00909089—Written submissions. Herrero y Asociados. Dec. 15, 2004.
EP00909089—Response to the Office Action dated on Oct. 28, 2004. European Patent Office. Dec. 16, 2004.
EP00909089—Claims. Herrero y Asociados. Jan. 28, 2005.
EP00909089—Minutes from Oral Proceedings. EPO. Jan. 28, 2005.
EP05012854—Notice of appeal. Herrero y Asociados. Dec. 19, 2007.
EP05012854—Statement setting out the Grounds of appeal. Herrero y Asociados. Nov. 3, 2008.
EP99974041—European Patent Office Communication dated on Aug. 27, 2002, 4 pages EPO. Aug. 27, 2002.
EP99974041—European Patent Office Communication dated on Oct. 22, 2003, 4 pages EPO. Oct. 22, 2003.
EP99974041—European Patent Office communication dated on Feb. 9, 2004. 3 pages EPO. Feb. 9, 2004.
PCT/EP00/00411—International preliminary examination report dated Aug. 29, 2002—Invitation to restrict or to pay additional fees. EPO. Aug. 29, 2002.
PCT/ES99/00296—International Search Report. OEPM. Mar. 29, 2001.
PCT/ES99/00296—Reply to the Written Opinion dated on Nov. 15, 2001—Declaration of J. Baxter—Exhibit FFF-. Herrero & Asociados. Nov. 15, 2001.
PCT/ES99/00296—International Preliminary Examination Report. EPO. Dec. 19, 2001.
PCT/ES99/00296—Russian Patent Office Communication (with its English translation) from the corresponding Russian Patent Application, 10 pages Russian Patent Office. Aug. 4, 2003.
U.S. Appl. No. 10/102,568—Preliminary Amendment—Exhibit CCCC. Rosenman & Colin LLP. Mar. 18, 2002.
U.S. Appl. No. 10/102,568—Office Action dated on Jan. 23, 2004. USPTO. Jan. 23, 2004.
U.S. Appl. No. 10/102,568—Amendment and response to the Office Action dated on Jan. 23, 2004. Jones Day. May 26, 2004.
U.S. Appl. No. 10/102,568—Supplemental Amendment to correct and inadvertent typographical error in the amendment filed in May 24, 2004. USPTO. Jun. 14, 2004.
U.S. Appl. No. 10/102,568—Notice of allowance dated Jun. 28, 2004. USPTO. Jun. 28, 2004.
U.S. Appl. No. 10/181,790—Office action dated on Aug. 27, 2004. USPTO. Aug. 27, 2004.
U.S. Appl. No. 10/181,790—Response to office action dated on Aug. 27, 2004. Jones Day. Dec. 8, 2004.
U.S. Appl. No. 10/181,790—Office action dated on Mar. 2, 2005. USPTO. Mar. 2, 2005.
U.S. Appl. No. 10/181,790—Response to the office action dated on Mar. 2, 2005. Jones Day. Mar. 14, 2005.
U.S. Appl. No. 10/181,790—Office action dated on Jun. 2, 2005. USPTO. Jun. 2, 2005.
U.S. Appl. No. 10/181,790—Response to the office action dated on Jun. 2, 2005. Jones Day. Jul. 20, 2005.
U.S. Appl. No. 10/181,790—Office action dated on Aug. 4, 2005. USPTO. Aug. 4, 2005.
U.S. Appl. No. 10/182,635—Office action dated on Oct. 4, 2004. USPTO. Oct. 4, 2004.
U.S. Appl. No. 10/182,635—Amendment and response to office action dated on Oct. 4, 2004. Jones Day. Nov. 12, 2004.
U.S. Appl. No. 10/182,635—Office Action dated on Dec. 13, 2004. USPTO. Dec. 13, 2004.
U.S. Appl. No. 10/182,635—Amendment and response to office action dated on Dec. 13, 2004. Jones Day. Mar. 17, 2005.
U.S. Appl. No. 10/182,635—Notice of Allowance dated on Apr. 11, 2005. USPTO. Apr. 11, 2005.
U.S. Appl. No. 10/422,578—Office Action dated on Oct. 4, 2004. USPTO. Oct. 4, 2004.
U.S. Appl. No. 10/422,578—Response to the Office Action dated on Oct. 4, 2004. Jones Day. Jan. 6, 2005.
U.S. Appl. No. 10/422,578—Office Action dated on Apr. 7, 2005. USPTO. Apr. 7, 2005.
U.S. Appl. No. 10/422,578—Response to the Office Action dated on Apr. 7, 2005. Jones Day. May 31, 2005.
U.S. Appl. No. 10/422,578—Advisory Action before the filing of an Appeal Brief. USPTO. Jun. 23, 2005.
U.S. Appl. No. 10/422,578—Office Action dated on Jun. 23, 2005. USPTO. Jun. 23, 2005.
U.S. Appl. No. 10/422,578—Request for Continued Examination with response to the office action dated on Apr. 7, 2005 and the advisory action dated on Jun. 23, 2005. Jones Day. Aug. 8, 2005.
U.S. Appl. No. 10/422,578—Office Action dated on Aug. 24, 2005. USPTO. Aug. 24, 2005.
U.S. Appl. No. 10/422,578—Office Action dated on Jan. 26, 2006. USPTO. Jan. 26, 2006.
U.S. Appl. No. 10/422,578—Office Action dated on Mar. 12, 2007. USPTO. Mar. 12, 2007.
U.S. Appl. No. 10/422,578—Office Action dated on Aug. 23, 2007. USPTO. Aug. 23, 2007.
U.S. Appl. No. 10/422,578—Office action dated on Mar. 26, 2008. USPTO. Mar. 26, 2008.
U.S. Appl. No. 10/797,732—Office action dated on Aug. 9, 2007. USPTO. Aug. 9, 2007.
U.S. Appl. No. 10/822,933—Office Action dated on Oct. 5, 2006. USPTO. Oct. 5, 2006.
U.S. Appl. No. 10/822,933—Response to Office Action dated on Oct. 5, 2006. Jenkens & Gilchrist. Jan. 4, 2007.
U.S. Appl. No. 10/822,933—Notice of allowance dated on Oct. 18, 2007. USPTO. Oct. 18, 2007.

(56) References Cited

OTHER PUBLICATIONS

U.S. Appl. No. 10/963,080—Preliminary amendment—Declaration of J. Baxter—Exhibit W. Jones Day. Case 6:09-cv-00203-LED-JDL. Dec. 10, 2004.
U.S. Appl. No. 10/963,080—Office Action dated on Jun. 15, 2005. USPTO. Jun. 15, 2005.
U.S. Appl. No. 10/963,080—Amendment and response to Office Action dated on Jun. 15, 2005. Howison and Arnott. Aug. 8, 2005.
U.S. Appl. No. 10/963,080—Notice of allowance dated on Sep. 1, 2005.. USPTO. Sep. 1, 2005.
U.S. Appl. No. 11/021,597—Office Action dated on Mar. 12, 2007. USPTO. Mar. 12, 2007.
U.S. Appl. No. 11/021,597—Response to the Office Action dated Mar. 12, 2007. Winstead. Aug. 9, 2007.
U.S. Appl. No. 11/021,597—Office action dated Oct. 30, 2007. USPTO. Oct. 30, 2007.
U.S. Appl. No. 11/021,597—Response to the office action dated Oct. 30, 2007. Winstead. Dec. 28, 2007.
U.S. Appl. No. 11/033,788—Response to Office Action dated Feb. 7, 2006. Jenkens & Gilchrist. Jun. 1, 2006.
U.S. Appl. No. 11/102,390—Notice of allowance dated on Jul. 6, 2006.. USPTO. Jun. 25, 2006.
U.S. Appl. No. 11/110,052—Preliminary amendment dated on Apr. 18, 2005. Howison & Arnott. Apr. 18, 2005.
U.S. Appl. No. 11/110,052—Notice of Allowance dated on May 30, 2006. USPTO. May 30, 2006.
U.S. Appl. No. 11/124,768—Amendment in response to non-final office action dated Aug. 23, 2006. Jenkens & Gilchrist. Nov. 13, 2006.
U.S. Appl. No. 11/179,250—Response office action. Howison & Arnott—Case 6:09-cv-00203-LED-JDL. Jul. 12, 2005.
U.S. Appl. No. 11/179,257—Office Action dated on Aug. 23, 2006. USPTO. Aug. 23, 2006.
U.S. Appl. No. 11/179,257—Response to office action dated Aug. 23, 2006. Howison and Arnott. Sep. 12, 2006.
U.S. Appl. No. 11/179,257—Office Action dated on Sep. 21, 2006. USPTO. Sep. 21, 2006.
U.S. Appl. No. 11/179,257—Amendment and response to office action dated Sep. 21, 2006. Howison and Arnott. Oct. 4, 2006.
U.S. Appl. No. 11/179,257—Notice of allowance dated on Oct. 19, 2006. USPTO. Oct. 19, 2006.
U.S. Appl. No. 11/179,257—Notice of allowance dated on Apr. 23, 2007. USPTO. Apr. 23, 2007.
U.S. Appl. No. 11/179,257—Notice of Allowance dated on Jun. 18, 2007. USPTO. Jun. 18, 2007.
U.S. Appl. No. 11/179,257—Notice of allowance dated on Aug. 2, 2007. USPTO. Aug. 2, 2007.
U.S. Appl. No. 11/179,257—Notice of allowance dated on Nov. 26, 2007. USPTO. Nov. 26, 2007.
U.S. Appl. No. 11/179,257—Office Action dated on Feb. 4, 2008. USPTO. Feb. 4, 2008.
U.S. Appl. No. 11/179,257—Amendment and response to office action dated on Feb. 4, 2008. Howison and Arnott. Feb. 27, 2008.
U.S. Appl. No. 11/179,257—Notice of allowance dated on Apr. 15, 2008. United States Patent and Trademark Office. Apr. 15, 2008.
U.S. Appl. No. 11/550,256—Office Action dated on Jan. 15, 2008. USPTO. Jan. 15, 2008.
U.S. Appl. No. 11/550,256—Amendment and response to office action dated on Jan. 15, 2008. Howison and Arnott. Feb. 27, 2008.
U.S. Appl. No. 11/550,256—Notice of allowance dated on Mar. 28, 2008.. USPTO. Mar. 28, 2008.
U.S. Appl. No. 11/550,276—Office Action dated on Jun. 9, 2008. USPTO. Jun. 9, 2008.
U.S. Appl. No. 11/550,276—Amendment and response to Office Action dated on Jun. 9, 2008. Howison and Arnott. Jul. 7, 2008.
U.S. Appl. No. 11/550,276—Notice of allowance dated on Sep. 17, 2008.. USPTO. Sep. 17, 2008.
U.S. Appl. No. 11/550,276—Notice of allowance dated on Jan. 13, 2009.. USPTO. Jan. 13, 2009.
U.S. Appl. No. 11/780,932—Preliminary amendment dated on Jul. 20, 2007. Howison & Arnott—Case 6:09-cv-00203-LED-JDL. Jul. 20, 2007.
U.S. Appl. No. 11/780,932—Office Action dated on Jul. 22, 2008. USPTO. Jul. 22, 2008.
U.S. Appl. No. 11/780,932—Amendment and response to Office Action dated on Jul. 22, 2008. Howison and Arnott. Aug. 6, 2008.
U.S. Appl. No. 11/780,932—Notice of allowance dated on Oct. 1, 2008. USPTO. Oct. 1, 2008.
U.S. Appl. No. 11/780,932—Notice of allowance dated on Jan. 28, 2009.. USPTO. Jan. 28, 2009.
U.S. Appl. No. 11/796,368—Office Action dated on Jun. 25, 2010. USPTO. Jun. 25, 2010.
U.S. Appl. No. 11/796,368—Office Action dated on Aug. 10, 2010. USPTO. Aug. 10, 2010.
U.S. Appl. No. 12/347,462—Office Action dated on Oct. 28, 2009. USPTO. Oct. 28, 2009.
U.S. Appl. No. 12/400,888—Office action dated on Oct. 5, 2010. USPTO. Oct. 5, 2010.
U.S. Appl. No. 12/400,888—Response to Office Action dated on Oct. 5, 2010. Howison & Arnott. Nov. 2, 2010.
U.S. Appl. No. 12/400,888—Office action dated on Dec. 10, 2010. United States Patent and Trademark Office. Dec. 12, 2010.
U.S. Appl. No. 12/400,888—Amendment and response to Office Action dated on Dec. 10, 2010. Howison & Arnott, LLP. Dec. 22, 2010.
Document 1113—Memorandum Opinion and Order, dated Jun. 28, 2012.
Document 1114—Final Judgement, dated Jun. 28, 2012.
Document 1143—Notice of appeal dated on Aug. 23, 2012.USPTO. Aug. 8, 2012.
U.S. Appl. No. 95/001,389, U.S. Appl. No. 95/000,591—Response to the Action Closing Prosecution mailed on Apr. 27, 2012 for U.S. Pat. No. 7,123,208, dated on Jun. 27, 2012.
U.S. Appl. No. 95/001,389, U.S. Appl. No. 95/000,591—Action Closing Prosecution for U.S. Pat. No. 7,123,208, dated Jul. 26, 2012.
U.S. Appl. No. 95/001,389—U.S. Appl. No. 95/000,591—Patent owner's reply to action closing prosecution mailed on Jul. 26, 2012. Edell, Shapiro & Finnan, LLC. Aug. 27, 2012.
U.S. Appl. No. 95/001,389—U.S. Appl. No. 95/000,591—Third party requesters comments to patent owner's ACP reply of Aug. 27, 2012 dated on Aug. 31, 2012.Edell Shapiro & Finnan, LLC. Aug. 31, 2012.
U.S. Appl. No. 95/001,389—U.S. Appl. No. 95/000,591—Petition for suspension of inter-partes reexamination proceedings including exhibits O-1 through O-19.Edell, Shapiro & Finnan, LLC. Oct. 1, 2012.
U.S. Appl. No. 95/001,390, U.S. Appl. No. 95/000,589—Response to the Action Closing Prosecution mailed on Apr. 26, 2012 for U.S. Pat. No. 7,015,868, dated Jun. 26, 2012.
U.S. Appl. No. 95/001,390, U.S. Appl. No. 95/000,589—Action Closing Prosecution for U.S. Pat. No. 7,015,868, dated Jul. 26, 2012.
U.S. Appl. No. 95/001,390—U.S. Appl. No. 95/000,589—Patent owner's reply to action closing prosecution mailed on Jul. 26, 2012. Edell, Shapiro & Finnan, LLC. Aug. 27, 2012.
U.S. Appl. No. 95/001,390, U.S. Appl. No. 95/000,589—Third party requester's comments to patent owner's ACP reply of Aug. 27, 2012. Edell, Shapiro & Finnan LLC. Aug. 31, 2012.
U.S. Appl. No. 95/001,390—U.S. Appl. No. 95/000,589—Petition for suspension of interpartes reexamination proceedings including exhibits O-1 through O-19.Edell, Shapiro & Finnan, LLC. Oct. 1, 2012.
U.S. Appl. No. 95/001,455, U.S. Appl. No. 95/000,595—Response to the Action Closing Prosecution mailed on Apr. 26, 2012 for U.S. Pat. No. 7,528,782, dated Jun. 26, 2012.
U.S. Appl. No. 95/001,455, U.S. Appl. No. 95/000,595—Action Closing Prosecution for U.S. Pat. No. 7,528,782, dated Jul. 27, 2012.
U.S. Appl. No. 95/001,455—U.S. Appl. No. 95/000,595—Patent owner's reply to action closing prosecution mailed on Jul. 27, 2012. Edell, Shapiro & Finnan, LLC. Aug. 27, 2012.
U.S. Appl. No. 95/001,455, U.S. Appl. No. 95/001,595—Third party requester's comments to patent owner's reply of Aug. 27, 2012. Defendants. Sep. 26, 2012.

(56) References Cited

OTHER PUBLICATIONS

U.S. Appl. No. 95/001,482, U.S. Appl. No. 95/000,586—Right of Appeal Notice for U.S. Pat. No. 7,397,431, dated Jun. 1, 2012.
U.S. Appl. No. 95/001,482—U.S. Appl. No. 95/000,586—Patent Owner amendment in response to the right of appeal notice mailed on Jun. 1, 2012.Edell, Shapiro & Finnan, LLC. Jul. 2, 2012.
U.S. Appl. No. 95/001,482, U.S. Appl. No. 95/000,586—Third party requester's notice of cross-appeal US7397431, dated Jul. 6, 2012.
U.S. Appl. No. 95/001,482—U.S. Appl. No. 95/000,586—Petition to terminate Inter Partes Reexamination dated on Jul. 31, 2012.Edell, Shapiro and Finnan, LLC. Jul. 31, 2012.
U.S. Appl. No. 95/001,482—U.S. Appl. No. 95/000,586—Petition for suspension of inter partes reexamination proceedings dated on Aug. 1, 2012.Edell, Shapiro & Finnan, LLC. Aug. 1, 2012.
U.S. Appl. No. 95/001,482, U.S. Appl. No. 95/000,586—Right of appeal notice for U.S. Pat. No. 7,397,431, dated Aug. 9, 2012.
U.S. Appl. No. 95/001,482—U.S. Appl. No. 95/000,586—Third party requester's opposition to patent owner's petition for suspension for U.S. Pat. No. 7,397,431 dated on Aug. 30, 2012.Defendants. Aug. 30, 2012.
U.S. Appl. No. 95/001,482—U.S. Appl. No. 95/000,586—Response to the Right of Appeal Notice (RAN) mailed on Aug. 9, 2012.Edell, Shapiro & Finnan, LLC. Sep. 10, 2012.
U.S. Appl. No. 95/001,482—U.S. Appl. No. 95/000,586—Third party requesters notice of cross-appeal. Defendants. Sep. 11, 2012.
U.S. Appl. No. 95/001,483, U.S. Appl. No. 95/000,588—Corrected Third party requester's comments to patent owner's reply of Apr. 9, 2012 for the U.S. Pat. No. 7,394,432, dated May 9, 2012.
U.S. Appl. No. 95/001,483, U.S. Appl. No. 951/000,588—Action closing prosecution for U.S. Pat. No. 7,394,432, dated Aug. 2, 2012.
U.S. Appl. No. 95/001,483—U.S. Appl. No. 95/000,588—Reply to ACP including exhibits O-1 through O-10.Edell, Shapiro & Finnan , LLC. Oct. 2, 2012.
U.S. Appl. No. 95/001,483—U.S. Appl. No. 95/000,588—Petition for suspension of Interpartes Reexamination Proceedings including exhibits O-1 through O-19.Edell, Shapiro & Finnan, LLC. Oct. 5, 2012.
U.S. Appl. No. 95/001,389—U.S. Appl. No. 95/000,591—Right of appeal notice. USPTO. Dec. 10, 2012.
U.S. Appl. No. 95/001,389—U.S. Appl. No. 95/000,591—Patent owner's notice of appeal in interpartes reexamination for the U.S. Pat. No. 7,123,208. Edell, Finnan & Shapiro. Jan. 10, 2013.
U.S. Appl. No. 951/001,390—U.S. Appl. No. 95/000,589—Right of appeal notice. USPTO. Dec. 10, 2012.
U.S. Appl. No. 95/001,455—U.S. Appl. No. 95/000,595—Right of appeal notice. USPTO. Dec. 10, 2012.
U.S. Appl. No. 95/001,455—U.S. Appl. No. 95/000,595—Patent owner's notice of appeal in inter partes reexamination for the U.S. Pat. No. 7,528,782. Edell, Finnan & Shapiro. Jan. 10, 2013.
U.S. Appl. No. 95/001,482—U.S. Appl. No. 95/000,586—Third party requester's petition for limited waiver. USPTO. Dec. 13, 2012.
U.S. Appl. No. 95/001,482—U.S. Appl. No. 95/000,586—Patent owner's Appeal Brief for U.S. Pat. No. 7,397,431. Edell, Shapiro & Finnan, LLC. Nov. 13, 2012.
U.S. Appl. No. 95/001,482—U.S. Appl. No. 95/000,586—Patent owner's Appeal Brief—Exhibits—for U.S. Pat. No. 7,397,431. Edell, Shapiro & Finnan, LLC. Nov. 13, 2012.
U.S. Appl. No. 95/001,483—U.S. Appl. No. 95/000,588—Right of appeal notice. USPTO. Dec. 10, 2012.
U.S. Appl. No. 95/001,483—U.S. Appl. No. 95/000,588—Response to the right of appeal notice for the U.S. Pat. No. 7,394,432. Edell, Shapiro & Finnan. Jan. 13, 2013.
U.S. Appl. No. 13/411,212—Amendment and response to office action dated on May 31, 2012. Howison and Arnott, Jun. 21, 2012.
U.S. Appl. No. 13/411,212—Notice of allowance dated on Aug. 8, 2012. USPTO. Aug. 8, 2012.
U.S. Appl. No. 13/411,212—Office action dated on May 31, 2012. USPTO. May 31, 2012.
EP10185339—Grounds for decision at the oral proceedings dated on Nov. 20, 2012. EPO. Jan. 2, 2013.
U.S. Appl. No. 13/669,916—Notice of allowance. USPTO. Dec. 17, 2012.
Miltenyi, P. EP10185339—Substantiation of appeal. Grunecker. Apr. 24, 2013.
Menefee, J. A. U.S. Appl. No. 95/000,595—U.S. Appl. No. 95/001,455—Inter partes reexamination examiner's answer for the U.S. Pat. No. 7,528,782. USPTO. Jun. 7, 2013.
Finnan, P. J. U.S. Appl. No. 95/001,389—U.S. Appl. No. 95/000,591—Patents owner's appeal brief for the U.S. Pat. No. 7,123,208. Edell, Shapiro & Finnan. May 6, 2013.
U.S. Appl. No. 95/001,389—U.S. Appl. No. 95/000,591—Third party requester's respondent brief for the U.S. Pat. No. 7,123,208. Samsung -Kyocera. Jun. 6, 2013.
Menefee, J. A. U.S. Appl. No. 95/001,389—U.S. Appl. No. 95/000,591—Inter partes reexamination examiner's answer for the U.S. Pat. No. 7,123,208. USPTO. Jun. 25, 2013.
Finnan, P. J. U.S. Appl. No. 95/001,390—U.S. Appl. No. 95/000,589—Patents owner's appeal brief for the U.S. Pat. No. 7,015,868. Edell, Shapiro & Finnan. May 6, 2013.
U.S. Appl. No. 95/001,390—U.S. Appl. No. 95/000,589—Third party requester's respondent brief for the U.S. Pat. No. 7,015,868. Samsung—Kyocera. Jun. 6, 2013.
Menefee, J. A. U.S. Appl. No. 95/001,390—U.S. Appl. No. 95/000,589—Interpartes reexamination examiner's answer for the U.S. Pat. No. 7,015,868. USPTO. Jun. 21, 2013.
U.S. Appl. No. 95/001,455—U.S. Appl. No. 95/000,595—Third party requester's respondent brief for the U.S. Pat. No. 7,528,782. Samsung—Kyocera. Apr. 25, 2013.
Menefee, J. A. U.S. Appl. No. 95/001,455—U.S. Appl. No. 95/000,595—Interpartes reexamination examiner's answer for the U.S. Pat. No. 7,528,782. USPTO. Jun. 7, 2013.
Finnan, P. P J. U.S. Appl. No. 95/001,483—U.S. Appl. No. 95/000,588—Patents owner's appeal brief for the U.S. Pat. No. 7,394,432. Edell, Shapiro & . Finnan. May 6, 2013.
U.S. Appl. No. 95/001,483—U.S. Appl. No. 95/000,588—Third party requesters respondent brief for the U.S. Pat. No. 7,394,432. Samsung—Kyocera Jun. 6, 2013.
Infringement Chart—LG Dare VX9700. U.S. Pat. No. 7,528,782. Fractus. Nov. 5, 2009.
Document 0256—Plaintiff Fractus, S. A.'s answer to the counterclaims of defendants Research in Motion LTD. and Research in Motion Corporation to the Second Amended Complaint. Susman Godfrey. Jan. 4, 2010.
Document 0257—Plaintiff Fractus, S. A.'s answer to counterclaims of defendant Pantech Wireless, Inc. to the Second Amended Complaint. Susman Godfrey. Jan. 4, 2010.
Document 0258—Plaintiff Fractus, S. A.'s answer to defendant Kyocera Communications, Inc's Counterclaims to the Second Amended Complaint. Susman Godfrey. Jan. 4, 2010.
Document 0259—Plaintiff Fractus, S. A.'s answer to defendant Kyocera Wireless Corp's Counterclaims to the Second Amended Complaint. Susman Godfrey. Jan. 4, 2010.
Document 0260—Plaintiff Fractus, S. A.'s answer to defendant Palm, Inc's Counterclaims to the Second Amended Complaint. Susman Godfrey. Jan. 4, 2010.
Document 0261—Plaintiff Fractus, S. A.'s answer to defendant UTStarcom, Inc's Counterclaims to the Second Amended Complaint. Susman Godfrey. Jan. 4, 2010.
Document 0262—Plaintiff Fractus, S. A.'s answer to counterclaims of defendant Samsung Telecommunications America LLC to the Second Amended Complaint. Susman Godfrey. Jan. 4, 2010.
Document 0263—Plaintiff Fractus, S. A.'s answer to counterclaims of defendants LG Electronics Inc., Electronics USA, Inc., and LG Electronics Mobilecomm USA, Inc. to the Second Amended Complaint. Susman Godfrey. Jan. 4, 2010.
Document 0273—Plaintiff Fractus, S. A.'s answer to counterclaims of defendants HTC America, Inc to the Second Amended Complaint. Susman Godfrey. Jan. 14, 2010.
Document 0286—Amended answer of the Sharp defendants to plaintiff's second amended complaint. Defendants. Feb. 24, 2010.
Document 0287—Defendants Samsung Electronics Co., Ltd.'s; Samsung Electronics Research Institute's and Samsung Semicon-

(56) References Cited

OTHER PUBLICATIONS ductor Europe GMBH' s first amended answer; and Samsung Telecommunications America LLC' s first amended answer. Defendants. Feb. 24, 2010.
Document 0288—Defendants LG Electronics Inc., LG Electronics USA, Inc., and LG Electronics Mobilecomm USA Inc. First amended answer and counterclaim to second amended complaint. Defendants. Feb. 24, 2010.
Document 0290—Defendant HTC America, Inc.'s amended answer and counterclaim to plaintiffs second amended complaint. Defendants. Feb. 24, 2010.
Document 0291—Defendant HTC Corporation's amended answer and counterclaim to plaintiffs second amended complaint. Defendants. Feb. 24, 2010.
Document 0297—Defendant HTC Corporation's amended answer and counterclaim to plaintiffs second amended complaint. Defendants. Feb. 25, 2010.
Document 0298—Defendant HTC America, Inc.'s amended answer and counterclaim to plaintiffs second amended complaint. Defendants. Feb. 25, 2010.
Document 0351—Plaintiff Fractus, S. A.'s answer to amended counterclaims of defendant Samsung Telecommunications America LLC's to Fractus's Second Amended Complaint. Susman Godfrey. Apr. 1, 2010.
Document 0352—Plaintiff Fractus, S. A.'s answer to amended counterclaims of defendant HTC Corporation to Fractus's Second Amended Complaint. Susman Godfrey. Apr. 1, 2010.
Document 0353—Plaintiff Fractus, S. A.'s answer to amended counterclaims of defendant HTC America, Inc. To Fractus's Second Amended Complaint. Susman Godfrey. Apr. 1, 2010.
Document 0354—Plaintiff Fractus, S. A.'s answer to amended counterclaims of defendant LG Electronics Inc., LG Electronics USA, Inc., and LG Electronics Mobilecomm USA Inc's to Fractus's Second Amended Complaint. Susman Godfrey. Apr. 1, 2010.
Document 0415—P.R. 4-3 joint claim construction statement. Susman Godfrey. Jun. 14, 2010.
Document 0423—Fractus SA's Opening Claim Construction Brief with Parties' Proposed and Agreed Constructions in the case of *Fractus SA* v. *Samsung Electornics Co. Ltd. et al.*. Susman Godfrey. Jul. 16, 2010.
Document 0428—Response of defendants Kyocera Communications, Inc; Palm Inc. and UTStarcom, Inc. to plaintiff Fractus SA's opening claim construction brief in "Case 6:09-cv-00203-LED-JDL". Defendants. Jul. 30, 2010.
Document 0429—Declaration of Jeffery D. Baxter—Including Exhibits: J, K, L, M, N, O, P, Q, R, S, T, U, Z, AA, KK, LL. Defendants. Jul. 30, 2010.
Document 0430—Defendants RIM, Samsung, HTC, LG and Pantech's response to plaintiff Fractus SA's opening claim construction brief. Defendants. Jul. 30, 2010.
Document 0430—Defendants RIM, Samsung, HTC, LG and Pantech's response to plaintiff Fractus SA's opening claim construction brief—Exhibit 1—Chart of Agreed Terms and Disputed Terms. Defendants. Jul. 30, 2010.
Document 0430—Defendants RIM, Samsung, HTC, LG and Pantech's response to plaintiff Fractus SA's opening claim construction brief—Exhibit 2—Family Tree of Asserted Patents. Defendants. Jul. 30, 2010.
Document 0430—Defendants RIM, Samsung, HTC, LG and Pantech's response to plaintiff Fractus SA's opening claim construction brief—Exhibit 33—Excerpt from Plaintiff's '868 pat. inf.cont. for Samsung SPH M540. Defendants. Jul. 30, 2010.
Document 0430—Defendants RIM, Samsung, HTC, LG and Pantech's response to plaintiff Fractus SA's opening claim construction brief—Exhibit 34—Excerpts from Plaintiffs '431 patent Infringement Contentions of HTC Diamond. Defendants. Jul. 30, 2010.
Document 0430—Defendants RIM, Samsung, HTC, LG and Pantech's response to plaintiff Fractus SA's opening claim construction brief—Exhibit 41—Demonstrative re: counting segments. Defendants. Jul. 30, 2010.
Document 0430—Defendants RIM, Samsung, HTC, LG and Pantech's response to plaintiff Fractus SA's opening claim construction brief—Exhibit 42—Demonstrative showing how straight segments can be fitted over a curved surface. Defendants. Jul. 30, 2010.
Document 0430—Defendants RIM, Samsung, HTC, LG and Pantech's response to plaintiff Fractus SA's opening claim construction brief—Exhibit 57—Excerpts from Plaintiffs '868 and '762 Pat. Int. cont. for RIM 8310. Defendants. Jul. 30, 2010.
Document 0440—Fractus's opposition to defendants' motion for summary judgement of invalidity based on indefiniteness and lack of written description for certain terms. Susman Godfrey. Aug. 16, 2010.
Document 0440-1—Expert declaration by Dr. D. Jaggard including exhibits (curriculum and datasheets from Cushcraft, Antenova, Ethertronics and Taoglas). Susman Godfrey. Aug. 16, 2010.
Document 0440-2—Declaration of Micah Howe in support of Fractus SA opposition to defendants' motion for summary judgement of invalidity based on indefiniteness and lack of written description for certain terms. Heim, Payne and Chorus LLP. Aug. 16, 2010.
Document 0452—Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q. Defendants. Aug. 30, 2010.
Document 0475—Order. Provisional claim construction and motion for summary judgement. Provisional markman order. Court. Nov. 9, 2010.
Document 0526—Memorandum order and opinion. Court. Dec. 17, 2010.
Document 0575—Fractus 's Objections to claim construction memorandum and order. Susman Godfrey. Jan. 14, 2011.
Document 0582—Memorandum opinion and order. Court. Jan. 20, 2011.
Document 0583—Defendant's notice of compliance regarding second amended invalidity contentions. Defendants. Jan. 21, 2011.
Document 0607—Declaration of Thomas E. Nelson—Exhibit A—Antenna photos. Defendants. Feb. 3, 2011.
Document 0609—Fractus' reply to defendant's motion for reconsideration of, and objections to, magistrate Judge Love's markman order. Susman Godfrey. Feb. 4, 2011.
Document 0611—Report and recommendation of United States magistrate judge. Court. Feb. 8, 2011.
Document 0622—Order adopting report and recommendation of magistrate judge. Court. Feb. 11, 2011.
Document 0624—Notice of compliance with motion practice orders. Susman Godfrey. Feb. 14, 2011.
Document 0641—Defendant HTC America, Inc's second amended answer and counterclaim to plaintiffs second amended complaint. Defendants. Feb. 25, 2011.
Document 0642—Defendant HTC Corporation's second amended answer and counterclaim to plaintiffs second amended complaint. Defendants. Feb. 25, 2011.
Document 0645—Reply brief in support of Defendant's motion for reconsideration of the court's ruling on the term "at least a portion" in the court's Dec. 17, 2010 claim construction order based on newly-available evidence. Defendants. Feb. 25, 2011.
Document 0647—Defendants Samsung Electronics Co LTD (et al) second amended answer and counterclaims to the second amended complaint of plaintiff Fractus SA—Document 647. Defendants. Feb. 28, 2011.
Consent order. Court. Nov. 15, 2011.
Oral and videotaped deposition of Dr. Stuart Long—vol. 1. Mar. 11, 2011.
Oral and videotaped deposition of Dr. Stuart Long—vol. 2. Mar. 13, 2011.
Oral and videotaped deposition of Dr. Stuart Long—vol. 3. Mar. 14, 2011.
Oral and videotaped deposition of Dr. Warren L. Stutzman—vol. 1. Fractus. Mar. 3, 2011.

(56) References Cited

OTHER PUBLICATIONS

Oral and videotaped deposition of Dr. Warren L. Stutzman—vol. 2. Fractus. Mar. 4, 2011.
Claim construction and motion for summary judgement—Markman Hearing—[Defendants]. Defendants. Sep. 2, 2010.
Claimant's notice to admit facts. Hogan Lovells International. Jan. 14, 2011.
Defence. Taylor Wessing. Nov. 10, 2010.
Defendants' invalidity contentions including appendix A and exhibits 1, 2, 3, 4, 5, 10, 11 referenced Multilevel Antenna patent. Defendants. Feb. 24, 2010.
Demonstratives presented by Dr. Steven Best during trial. Defendants. May 19, 2011.
Demonstratives presented by Dr. Stuart Long during trial. Fractus. May 18, 2011.
Document 0001—Complaint for patent infringement. Susman Godfrey. May 5, 2009.
Document 0014—Amended complaint for patent infringement. Fractus. May 6, 2009.
Document 0032—Defendants LG Electronics Mobilecomm USA., Inc.'s answer and counterclaim to complaint. Defendants. Oct. 1, 2009.
Document 0064—Defendant Pantech Wireless, Inc.'s answer, affirmative defenses and counterclaims to Fractus SA's Amended complaint. Defendants. Jun. 4, 2009.
Document 0066—Defendant UTStarcom, Inc's answer affirmative defenses and counterclaims to plaintiff's amended complaint. Defendants. Jun. 8, 2009.
Document 0073—Plaintiff Fractus SA' s answer to defendant Pantech Wireless, Inc's counterclaims. Defendants. Jun. 24, 2009.
Document 0079—Plaintiff Fractus SA's answer to defendant UTStarcom, Inc' s counterclaims. Fractus. Jun. 29, 2009.
Document 0091—Answer, affirmative defenses and counterclaims to the amended complaint for patent infringement on behalf of Defendant Personal Communications Devices Holdings, LLC. Defendants. Jul. 20, 2009.
Document 0099—Defendant Sanyo North America Corporation's partial answer to amended complaint for patent infringement. Defendants. Jul. 20, 2009.
Document 0106—Kyocera Communications Inc's answer, affirmative defenses and counterclaims to plaintiff's amended complaint. Defendants. Jul. 21, 2009.
Document 0107—Kyocera Wireless Corp's answer, affirmative defenses and counterclaims to plaintiff's amended complaint. Defendants. Jul. 21, 2009.
Document 0108—Palm Inc.'s answer, affirmative defenses and counterclaims to plaintiffs amended complaint. Defendants. Jul. 21, 2009.
Document 0111—Civil cover sheet. Susman Godfrey. May 5, 2009.
Document 0175—Defendant HTC Corporation's amended answer and counterclaim to plaintiffs second amended complaint. Defendants. Sep. 25, 2009.
Document 0176—Defendant HTC America Inc's answer and counterclaim to plaintiffs amended complaint. Defendants. Sep. 25, 2009.
Document 0180—Defendants Samsung Electronics Co., Ltd.'s; Samsung Electronics Research Institute's and Samsung Semiconductor Europe GMBS's answer; and Samsung Telecommunications America LLC' s answer and counterclaim. Defendants. Oct. 1, 2009.
Document 0185—Defendants Research in Motion LTD, and Research in Motion Corporation's answers, defenses and counterclaims to plaintiff's amended complaint. Defendants. Oct. 1, 2009.
Document 0187—Defendants LG Electronics Inc., LG Electronics USA, Inc., and LG Electronics Mobilecomm USA Inc. answer and counterclaim to amended complaint. Defendants. Oct. 1, 2009.
Document 0190—Defendant HTC Corporation's First amended answer and counterclaim to plaintiffs amended complaint. Defendants. Oct. 2, 2009.
Document 0191—Defendant HTC America, Inc's first amended answer and counterclaims to plaintiff's amended complaint. Defendants. Oct. 2, 2009.
Document 0217—Defendants Research in Motion LTD, and Research in Motion Corporation's amended answer, defenses and counterclaims to plaintiff's amended complaint. Defendants. Nov. 24, 2009.
Document 0222—Second amended complaint for patent infringement. Susman Godfrey. Dec. 2, 2009.
Document 0227—Second amended complaint for patent infringement—Case 6:09-cv-00203. Fractus. Dec. 8, 2009.
Document 0235—Answer, affirmative defenses and counterclaims to the second amended complaint for patent infringement on behalf of Defendant Personal Communications Devices Holdings, LLC. Defendants. Dec. 17, 2009.
Document 0238—Defendant HTC America, Inc's answer and counterclaims to plaintiffs second amended complaint. Defendants. Dec. 21, 2009.
Document 0239—Defendant HTC Corporation's answer and counterclaims to plaintiffs second amended complaint. Defendants. Dec. 21, 2009.
Document 0241—Defendant Research in Motion LTD and Research in Motion Corporation's second answer, defenses and counterclaims to plaintiffs second amended complaint. Defendants. Dec. 21, 2009.
Document 0242—Defendant Pantech Wireless, Inc's answer, affirmative defenses and counterclaims to Fractus SA's second amended complaint. Defendants. Dec. 21, 2009.
Document 0243—Defendant Sanyo Electric Co. LTD's answer to second amended complaint for patent infringement. Defendants. Dec. 22, 2009.
Document 0244—Defendant Sanyo North America Corporation's answer to second amended complaint for patent infringement. Defendants. Dec. 22, 2009.
Document 0246—Defendant UTStarcom, Inc's answer, affirmative defenses and counterclaims to Fractus SA's second amended complaint. Defendants. Dec. 22, 2009.
Document 0247—Palm, Inc's answer, affirmative defenses and counterclaims to plaintiffs second amended complaint. Defendants. Dec. 22, 2009.
Document 0248—Kyocera Communications, Inc's answer, affirmative defenses and counterclaims to plaintiffs second amended complaint. Defendants. Dec. 22, 2009.
Document 0249—Kyocera Wireless Corp's answer, affirmative defenses and counterclaims to plaintiffs second amended complaint. Defendants. Dec. 22, 2009.
Document 0250—Defendants Samsung Electronics Co., Ltd.'s; Samsung Electronics answer and counterclaim to the second amended complaint of plaintiff Fractus. Defendants. Dec. 23, 2009.
Document 0251—Defendants LG Electronics Inc., LG Electronics USA, Inc., and LG Electronics Mobilecomm USA Inc. answer and counterclaim to second amended complaint. Defendants. Dec. 28, 2009.
Document 0252—Answer of the Sharp Defendants to plaintiffs second amended complaint. Defendants. Dec. 29, 2009.
Document 0255—Plaintiff Fractus, S. A.'s answer to defendant Personal Communications Devices Holdings, LLC's counterclaims to the Second Amended Complaint. Susman Godfrey. Jan. 4, 2010.
U.S. Appl. No. 12/400,888—Notice of allowance dated on Feb. 7, 2011. United States Patent and Trademark Office. Feb. 7, 2011.
U.S. Appl. No. 12/400,888—Notice of allowance dated on Apr. 18, 2011. United States Patent and Trademark Office. Apr. 18, 2011.
U.S. Appl. No. 12/400,888—Notice of allowance dated on Jun. 28, 2011. USPTO. Jun. 28, 2011.
U.S. Appl. No. 13/036,819—Notice of allowance dated on Jun. 27, 2011. USPTO. Jun. 27, 2011.
U.S. Appl. No. 13/036,819—Notice of allowance dated on Sep. 6, 2011. USPTO. Sep. 6, 2011.
U.S. Appl. No. 13/036,819—Notice of allowance dated on Sep. 21, 2011. USPTO. Sep. 21, 2011.
U.S. Appl. No. 13/036,819—Notice of allowance dated on Dec. 28, 2011. USPTO. Dec. 28, 2011.
U.S. Appl. No. 13/036,819—Notice of allowance dated on Feb. 15, 2012. USPTO. Feb. 15, 2012.
U.S. Appl. No. 13/044,189—Office action dated on Aug. 8, 2011. USPTO. Aug. 8, 2011.

(56) References Cited

OTHER PUBLICATIONS

U.S. Appl. No. 13/044,189—Amendment and response to office action dated Aug. 8, 2011. Howison & Arnott. Sep. 1, 2011.
U.S. Appl. No. 13/044,189—Notice of allowance dated on Oct. 11, 2011. USPTO. Oct. 11, 2011.
U.S. Appl. No. 13/044,189—Notice of Allowance dated on Dec. 28, 2011. USPTO. Dec. 28, 2011.
U.S. Appl. No. 13/044,189—Notice of allowance dated on Feb. 15, 2012. USPTO. Feb. 15, 2012.
U.S. Appl. No. 95/000,586—Request for inter partes reexamination of U.S. Pat. No. 7,397,431 including exhibits CC1-CC6. Kyocera Communication Inc.. Nov. 12, 2010.
U.S. Appl. No. 95/000,586, U.S. Appl. No. 95/001,482, U.S. Appl. No. 95/001,497—Office Action in inter partes reexamination dated on May 13, 2011 for the U.S. Pat. No. 7,397,431. USPTO. May 13, 2011.
U.S. Appl. No. 95/000,588—Request for inter partes reexamination of U.S. Pat. No. 7,394,432 including exhibits CC1-CC6. Kyocera Communications Inc.. Nov. 12, 2010.
U.S. Appl. No. 95/000,589—Request for inter partes reexamination of U.S. Pat. No. 7,015,868 including exhibits CC1-CC5. Kyocera Communications Inc.. Nov. 16, 2010.
U.S. Appl. No. 95/000,591—Request for inter partes reexamination of U.S. Pat. No. 7,123,208 including exhibits CC1-CC4. Kyocera Communication Inc.. Nov. 16, 2010.
U.S. Appl. No. 95/000,595—Request for inter partes reexamination of U.S. Pat. No. 7,528,782 including exhibits CC1-CC4. Kyocera Communications Inc.. Nov. 17, 2010.
U.S. Appl. No. 95/000,595, U.S. Appl. No. 95/001,499, U.S. Appl. No. 95/001,455—Decision sua sponte to merge reexamination proceedings of U.S. Pat. No. 7,528,782. USPTO. May 24, 2011.
U.S. Appl. No. 95/001,389—Request for inter partes reexamination of U.S. Pat. No. 7,123,208 including exhibits CC-A—CC-C and OTH-B. Samsung Electronics Co. Ltd.. Jul. 1, 2010.
U.S. Appl. No. 95/001,389—Office Action for the U.S. Pat. No. 7,123,208 dated on Aug. 12, 2010. USPTO. Aug. 12, 2010.
U.S. Appl. No. 95/001,389—Response to the Office Action dated on Aug. 12, 2010. Sterne, Kessler, Goldstein & Fox PLLC. Nov. 12, 2010.
U.S. Appl. No. 95/001,389—Third party requester's replacement comments to patent owner's reply of Nov. 12, 2010 for U.S. Pat. No. 7,123,208. Samsung. Mar. 7, 2011.
U.S. Appl. No. 95/001,389—Corrected patent owner's response to first office action dated on Aug. 12, 2010 with exhibit. Sterne, Kessler, Goldstein & Fox. Apr. 11, 2011.
U.S. Appl. No. 95/001,389—Third party requester's comments to patent owner's reply of Apr. 11, 2011 for U.S. Pat. No. 7,123,208. Samsung. Apr. 29, 2011.
U.S. Appl. No. 95/001,389, U.S. Appl. No. 95/001,501, U.S. Appl. No. 95/000,591—Decision sua sponte to merge reexamination proceedings of U.S. Pat. No. 7,123,208. USPTO. Jun. 1, 2011.
U.S. Appl. No. 95/001,389, U.S. Appl. No. 95/001,501, U.S. Appl. No. 95/000,591—Office action for U.S. Pat. No. 7,123,208 dated on Jul. 1, 2011. USPTO. Jul. 1,2011.
U.S. Appl. No. 95/001,389, U.S. Appl. No. 95/000,591, U.S. Appl. No. 95/001,501—Patent owner's response to first office action dated on Jul. 1, 2011 of U.S. Pat. No. 7,123,208. Sterne Kessler. Oct. 3, 2011.
U.S. Appl. No. 95/001,389—Third party requester's comments to patent owner's reply of Oct. 3, 2011 for U.S. Pat. No. 7,123,208. Defendants. Dec. 19, 2011.
U.S. Appl. No. 95/001,390—Request for inter partes reexamination of U.S. Pat. No. 7,015,868 including exhibits CC-A—CC-G and Oth-A —OTH-B. Samsung Electronics Co. Ltd.. Jul. 2, 2010.
U.S. Appl. No. 95/001,390—Office Action for the U.S. Pat. No. 7,015,868 dated Aug. 19, 2010. USPTO. Aug. 19, 2010.
U.S. Appl. No. 95/001,390—Response to the Office Action for the U.S. Pat. No. 7,015,868 dated on Aug. 19, 2010. Sterne, Kessler, Goldstein & Fox PLLC. Nov. 19, 2010.
U.S. Appl. No. 95/001,390—Third party requester's replacement comments to patent owner's reply of Nov. 19, 2010 for U.S. Pat. No. 7,015,868. Samsung. Mar. 7, 2011.
U.S. Appl. No. 95/001,390—Corrected response to office action dated on Aug. 19, 2010. Sterne Kessler Goldstein & Fox, PLLC; Fractus. Apr. 11, 2011.
U.S. Appl. No. 95/001,390—Corrected response to office action dated on Aug. 19, 2010—Exhibit 1. Sterne Kessler; Fractus. Apr. 11, 2011.
U.S. Appl. No. 95/001,390—Third party requester's comments to patent owner's reply of Apr. 11, 2011 for U.S. Pat. No. 7,015,868. Samsung. May 2, 2011.
U.S. Appl. No. 95/001,390, U.S. Appl. No. 95/001,498, U.S. Appl. No. 95/000,589—Office action for U.S. Pat. No. 7,015,868 dated on Jul. 1, 2011. USPTO. Jul. 1,2011.
U.S. Appl. No. 95/001,390—Exhibits of patent owner's reponse to first office action of U.S. Pat. No. 7,015,868 dated on Jul. 1, 2011. Sterne Kessler. Oct. 3, 2011.
U.S. Appl. No. 95/001,390—Patent owner's reponse to first office action of U.S. Pat. No. 7,015,868 dated on Jul. 1, 2011. Sterne Kessler. Oct. 3, 2011.
U.S. Appl. No. 95/001,390—Third party requester's comments to patent owner's reply of Apr. 11, 2011 for U.S. Pat. No. 7,015,868. Defendants. Dec. 19, 2011.
U.S. Appl. No. 95/001,414—Third party requester's comments to patent owner's reply dated on Jan. 10, 2011 for U.S. Pat. No. 7,202,822. Samsung. Feb. 9, 2011.
U.S. Appl. No. 95/001,455—Request for inter partes reexamination of U.S. Pat. No. 7,528,782 including exhibits CCA-CCN. Samsung Electronics Co. Ltd. Sep. 30, 2010.
U.S. Appl. No. 95/001,455—Office action dated on Nov. 19, 2010. USPTO. Nov. 19, 2010.
U.S. Appl. No. 95/001,455—Response to office action dated on Nov. 19, 2010. Sterne Kessler. Feb. 22, 2011.
U.S. Appl. No. 95/001,455—Response to office action for U.S. Pat. No. 7,528,782 dated on Nov. 19, 2010—Exhibits. Sterne Kessler. Feb. 22, 2011.
U.S. Appl. No. 95/001,455—Third party requester's comments to patent owner's reply of Feb. 22, 2011 for U.S. Pat. No. 7,528,782—. Samsung. Mar. 24, 2011.
U.S. Appl. No. 95/001,455—Corrected patent owner's response to office action dated on Nov. 19, 2010. Sterne Kessler. Apr. 12, 2011.
U.S. Appl. No. 95/001,455—Corrected patent owner's response to office action dated on Nov. 19, 2010—Exhibit 1. Sterne Kessler. Apr. 12, 2011.
U.S. Appl. No. 95/001,455—Third party requester's comments to patent owner's reply of Feb. 22, 2011 for U.S. Pat. No. 7,528,782. Defendants. Apr. 28, 2011.
U.S. Appl. No. 95/001,455, U.S. Appl. No. 95/000,595, U.S. Appl. No. 95/001,499—Office Action for U.S. Pat. No. 7,528,782 dated on Jul. 29, 2011. USPTO. Jul. 29, 2011.
U.S. Appl. No. 95/001,455, U.S. Appl. No. 95/000,595, U.S. Appl. No. 95/001,499—Response to office action dated on Jul. 29, 2011 of U.S. Pat. No. 7,528,782. Fractus. Oct. 31, 2011.
U.S. Appl. No. 95/001455, U.S. Appl. No. 95/000595—Third party requester's comments to patent owner's reply of Oct. 31, 2011 pursant to 37 CFR 1947 for U.S. Pat. No. 7,528,782. Defendants. Feb. 1, 2012.
U.S. Appl. No. 95/001,455, U.S. Appl. No. 95/000,595—Third party requester's comments to patent owner's reply of Oct. 31, 2011 pursant to 37 CFR 1947 for U.S. Pat. No. 7,528,782—Exhibits. Defendants. Feb. 1, 2012.
U.S. Appl. No. 95/001,482—Request for inter partes reexamination of U.S. Pat. No. 7,397,431 including exhibits CC-A—CC-L. Samsung Electronics Co. Ltd. Nov. 11, 2010.
U.S. Appl. No. 95/001,482, U.S. Appl. No. 95/000586, U.S. Appl. No. 95/001,497—Decision sua sponte to merge reexamination proceedings of U.S. Pat. No. 7,397,431. USPTO. May 4, 2011.
U.S. Appl. No. 95/001482, U.S. Appl. No. 95/000586, U.S. Appl. No. 95/001497—Exhibits of response to first office action dated on May 13, 2011 for U.S. Pat. No. 7,397,431. Sterne Kessler. Aug. 15, 2011.

(56) References Cited

OTHER PUBLICATIONS

U.S. Appl. No. 95/001,482, U.S. Appl. No. 95/000,586, U.S. Appl. No. 95/001,497—Response to first office action dated on May 13, 2011 for U.S. Pat. No. 7,397,431. Sterne Kessler. Aug. 15, 2011.
U.S. Appl. No. 95/001,482—Third party requester's comments to patent owner's reply of Aug. 15, 2011 for U.S. Pat. No. 7,397,431. Defendants. Sep. 14, 2011.
U.S. Appl. No. 95/001,482—Action closing prosecution for U.S. Pat. No. 7,397,431 dated on Dec. 1, 2011. USPTO. Dec. 1, 2011.
U.S. Appl. No. 95/001,482, U.S. Appl. No. 95/000,586—Patent owner's response to the Action Closing Prosecution of Dec. 1, 2011 for U.S. Pat. No. 7,397,431. Sterne Kessler. Jan. 3, 2012.
U.S. Appl. No. 95/001,482, U.S. Appl. No. 95/000,586, U.S. Appl. No. 95/001,497—Third party requester's comments to patent owner's reply of Jan. 3, 2012 for U.S. Pat. No. 7,397,431. Defendants. Feb. 2, 2012.
U.S. Appl. No. 95/001,483—Request for inter partes reexamination of U.S. Pat. No. 7,394,432 including exhibits CC-A —CC-L. Samsung Electronics Co. Ltd. Nov. 11, 2010.
U.S. Appl. No. 95/001,483, U.S. Appl. No. 95/000,588, U.S. Appl. No. 95/001,500—Decision sua sponte to merge reexamination proceedings of U.S. Pat. No. 7,394,432. USPTO. Mar. 17, 2011.
U.S. Appl. No. 95/001,483, U.S. Appl. No. 95/000,588, U.S. Appl. No. 95/001,500—Office action in inter partes reexamination for the U.S. Pat. No. 7,394,432. USPTO. Apr. 7, 2011.
U.S. Appl. No. 95/001,483, U.S. Appl. No. 95/000,588, U.S. Appl. No. 95/001,500—Response to office action dated on Apr. 7, 2011 for U.S. Pat. No. 7,394,432. Sterne Kessler. Jul. 7, 2011.
U.S. Appl. No. 95/001,483, U.S. Appl. No. 95/000,588, U.S. Appl. No. 95/001,500—Third party requester's comments to patent owner's reply of Jul. 7, 2011 of U.S. Pat. No. 7,394,432. Samsung. Aug. 8, 2011.
U.S. Appl. No. 95/001,483, U.S. Appl. No. 95/000,588, U.S. Appl. No. 95/001,500—Exhibits from Third party requester's comments to patent owner's reply of Jul. 7, 2011 of U.S. Pat. No. 7,394,432. Defendants. Aug. 8, 2011.
U.S. Appl. No. 95/001,483, U.S. Appl. No. 95/000,588, US001500—Action closing prosecution for U.S. Pat. No. 7,394,432 dated on Nov. 4, 2011. USPTO. Nov. 4, 2011.
U.S. Appl. No. 95/001,483, U.S. Appl. No. 95/000,588—Patent owner's response to the Action Closing Prosecution of Nov. 4, 2011 for U.S. Pat. No. 7,394,432. Sterne Kessler. Jan. 4, 2012.
U.S. Appl. No. 95/001,483, U.S. Appl. No. 95/000,588, U.S. Appl. No. 95/001,500—Third party requester's comments to patent owner's reply of Jan. 4, 2012 pursant to 37 CFR 1947 for U.S. Pat. No. 7,394,432. Defendants. Feb. 3, 2012.
U.S. Appl. No. 95/001,483, U.S. Appl. No. 95/001,500, U.S. Appl. No. 95/000,588—Action closing prosection for U.S. Pat. No. 7,394,432 dated on Mar. 7, 2012.
U.S. Appl. No. 95/001,483, U.S. Appl. No. 95/000,588—Reply to the action closing prosecution dated on Mar. 7, 2012 for the U.S. Pat. No. 7,394,432. Sterne Kessler. Apr. 9, 2012.
U.S. Appl. No. 95/001,497—Request for inter partes reexamination of U.S. Pat. No. 7,397,431 including exhibits C1-05. Htc Corporation—HTC America Inc. Dec. 3, 2010.
U.S. Appl. No. 95/001,498—Request for inter partes reexamination of U.S. Pat. No. 7,015,868 including exhibits C1-C6. HTC Corporation—HTC America Inc. Dec. 3, 2010.
U.S. Appl. No. 95/001,498, U.S. Appl. No. 95/000,589, U.S. Appl. No. 95/001,390—Decision sua sponte to merge reexamination proceedings of U.S. Pat. No. 7,015,868. USPTO. May 23, 2011.
U.S. Appl. No. 95/001,499—Request for inter partes reexamination of U.S. Pat. No. 7,528,782 including exhibits C1-C6. HTC Corporation—HTC America Inc. Dec. 3, 2010.
U.S. Appl. No. 95/001,500—Request for inter partes reexamination of U.S. Pat. No. 7,394,432 including exhibits C1-05. HTC Corporation—HTC America Inc. Dec. 3, 2010.
U.S. Appl. No. 95/001,501—Request for inter partes reexamination of U.S. Pat. No. 7,123,208 including exhibits C1-C7. Htc Corporation—HTC America Inc. Dec. 3, 2010.
Infringement Chart—RIM Blackberry 9630. U.S. Pat. No. 7,015,868. Fractus, 2009.
Infringement Chart—RIM Blackberry 9630. U.S. Pat. No. 7,123,208. Fractus, 2009.
Infringement Chart—RIM Blackberry 9630. U.S. Pat. No. 7,394,432. Fractus, 2009.
Infringement Chart—RIM Blackberry 9630. U.S. Pat. No. 7,397,431. Fractus, 2009.
Infringement Chart—RIM Blackberry Bold 9000.. Fractus, 2009.
Infringement Chart—RIM Blackberry Bold 9000. U.S. Pat. No. 7,015,868. Fractus, 2009.
Infringement Chart—RIM Blackberry Bold 9000. U.S. Pat. No. 7,123,208. Fractus, 2009.
Infringement Chart—RIM Blackberry Bold 9000. U.S. Pat. No. 7,394,432. Fractus, 2009.
Infringement Chart—RIM Blackberry Bold 9000. U.S. Pat. No. 7,528,782. Fractus, 2009.
Infringement Chart—RIM Blackberry Bold 9000. U.S. Pat. No. 7,397,431. Fractus, 2009.
Infringement Chart—RIM Blackberry Pearl 8100. Fractus, 2009.
Infringement Chart—RIM Blackberry Storm 9530. Fractus, 2009.
Infringement Chart—RIM Blackberry Storm 9530. U.S. Pat. No. 7,015,868. Fractus, 2009.
Infringement Chart—RIM Blackberry Storm 9530. U.S. Pat. No. 7,123,208. Fractus, 2009.
Infringement Chart—RIM Blackberry Storm 9530. U.S. Pat. No. 7,394,432. Fractus, 2009.
Infringement Chart—RIM Blackberry Storm 9530. U.S. Pat. No. 7,397,431. Fractus, 2009.
Infringement Chart—RIM Blackberry Storm 9530. U.S. Pat. No. 7,528,782. Fractus, 2009.
Infringement Chart—RIM Blackberry Tour 9630. U.S. Pat. No. 7,528,782. Fractus, 2009.
Infringement Chart—SAMSUNG Blackjack II SGH-i617.. Fractus, 2009.
Infringement Chart—SAMSUNG Blackjack II SGH-i617. U.S. Pat. No. 7,015,868. Fractus, 2009.
Infringement Chart—SAMSUNG Blackjack II SGH-i617. U.S. Pat. No. 7,123,208. Fractus, 2009.
Infringement Chart—SAMSUNG Blackjack II SGH-i617. U.S. Pat. No. 7,394,432. Fractus, 2009.
Infringement Chart—SAMSUNG Blackjack II SGH-i617. U.S. Pat. No. 7,528,782. Fractus, 2009.
Infringement Chart—SAMSUNG Blackjack II SGH-i617. U.S. Pat. No. 7,397,431. Fractus, 2009.
Infringement Chart—SAMSUNG Blast SGH-T729. U.S. Pat. No. 7,015,868. Fractus, 2009.
Infringement Chart—SAMSUNG Blast SGH-T729. U.S. Pat. No. 7,123,208. Fractus, 2009.
Infringement Chart—SAMSUNG Blast SGH-T729. U.S. Pat. No. 7,394,432. Fractus, 2009.
Infringement Chart—SAMSUNG Blast SGH-T729. U.S. Pat. No. 7,528,782. Fractus, 2009.
Infringement Chart—SAMSUNG Blast SGH T729. Fractus, 2009.
Infringement Chart—SAMSUNG Blast SGH T729. U.S. Pat. No. 7,397,431. Fractus, 2009.
Infringement Chart—SAMSUNG EPIX SGH-I907. Fractus, 2009.
Infringement Chart—SAMSUNG FlipShot SCH-U900. Fractus, 2009.
Infringement Chart—SAMSUNG FlipShot SCH-U900. U.S. Pat. No. 7,015,868. Fractus, 2009.
Infringement Chart —SAMSUNG FlipShot SCH-U900. U.S. Pat. No. 7,123,208. Fractus, 2009.
Infringement Chart—SAMSUNG FLipShot SCH-U900. U.S. Pat. No. 7,394,432. Fractus, 2009.
Infringement Chart—SAMSUNG FlipShot SCH-U900. U.S. Pat. No. 7,397,431. Fractus, 2009.
Infringement Chart—SAMSUNG FlipShot SCH-U900. U.S. Pat. No. 7,528,782. Fractus, 2009.
Infringement Chart—SAMSUNG Instinct M800. Fractus, 2009.
Infringement Chart—SAMSUNG Instinct M800. U.S. Pat. No. 7,015,868. Fractus, 2009.

(56) References Cited

OTHER PUBLICATIONS

Infringement Chart—SAMSUNG Instinct M800. U.S. Pat. No. 7,123,208. Fractus, 2009.
Infringement Chart—SAMSUNG Instinct M800. U.S. Pat. No. 7,394,432. Fractus, 2009.
Infringement Chart—SAMSUNG Instinct M800. U.S. Pat. No. 7,397,431. Fractus, 2009.
Infringement Chart—SAMSUNG Instinct M800. U.S. Pat. No. 7,528,782. Fractus, 2009.
Infringement Chart—SAMSUNG M320. Fractus, 2009.
Infringement Chart—SAMSUNG M320. U.S. Pat. No. 7,397,431. Fractus, 2009.
Infringement Chart—SAMSUNG M320. U.S. Pat. No. 7,015,868. Fractus, 2009.
Infringement Chart—SAMSUNG M320. U.S. Pat. No. 7,123,208. Fractus, 2009.
Infringement Chart—SAMSUNG M320. U.S. Pat. No. 7,394,432. Fractus, 2009.
Infringement Chart—SAMSUNG M320. U.S. Pat. No. 7,528,782. Fractus, 2009.
Infringement Chart—SAMSUNG Magnet (SGH-A257). U.S. Pat. No. 7,015,868. Fractus, 2009.
Infringement Chart—SAMSUNG SGH A867. U.S. Pat. No. 7,394,432. Fractus, 2009.
Infringement Chart—SAMSUNG SGH A867. U.S. Pat. No. 7,397,431. Fractus, 2009.
Infringement Chart—SAMSUNG SGH A867. U.S. Pat. No. 7,528,782. Fractus, 2009.
Infringement Chart—SAMSUNG SGH T 919. U.S. Pat. No. 7,397,431. Fractus, 2009.
Infringement Chart—SAMSUNG SGH T229. Fractus, 2009.
Infringement Chart—SAMSUNG SGH T229. U.S. Pat. No. 7,015,868. Fractus, 2009.
Infringement Chart—SAMSUNG SGH T229. U.S. Pat. No. 7,123,208. Fractus, 2009.
Infringement Chart—SAMSUNG SGH T229. U.S. Pat. No. 7,394,432. Fractus, 2009.
Infringement Chart—SAMSUNG SGH T229. U.S. Pat. No. 7,397,431. Fractus, 2009.
Infringement Chart—SAMSUNG SGH T229. U.S. Pat. No. 7,528,782. Fractus, 2009.
Infringement Chart—SAMSUNG SGH T439. Fractus, 2009.
Infringement Chart—SAMSUNG SGH T439. U.S. Pat. No. 7,015,868. Fractus, 2009.
Infringement Chart—SAMSUNG SGH T439. U.S. Pat. No. 7,123,208. Fractus, 2009.
Infringement Chart—SAMSUNG SGH T439. U.S. Pat. No. 7,394,432. Fractus, 2009.
Infringement Chart—SAMSUNG SGH T439. U.S. Pat. No. 7,397,431. Fractus, 2009.
Infringement Chart—SAMSUNG SGH T439. U.S. Pat. No. 7,528,782. Fractus, 2009.
Infringement Chart—SAMSUNG SGH 1459. Fractus, 2009.
Infringement Chart—SAMSUNG SGH 1459. U.S. Pat. No. 7,015,868. Fractus, 2009.
Infringement Chart—SAMSUNG SGH 1459. U.S. Pat. No. 7,123,208. Fractus, 2009.
Infringement Chart—SAMSUNG SGH 1459. U.S. Pat. No. 7,394,432. Fractus, 2009.
Infringement Chart—SAMSUNG SGH 1459. U.S. Pat. No. 7,397,431. Fractus, 2009.
Infringement Chart—SAMSUNG SGH 1459. U.S. Pat. No. 7,528,782. Fractus, 2009.
Infringement Chart—Samsung SGH T919. Fractus, 2009.
Infringement Chart—Samsung SGH T919. U.S. Pat. No. 7,015,868. Fractus, 2009.
Infringement Chart—Samsung SGH T919. U.S. Pat. No. 7,123,208. Fractus, 2009.
Infringement Chart—Samsung SGH T919. U.S. Pat. No. 7,394,432. Fractus, 2009.
Infringement Chart—Samsung SGH T919. U.S. Pat. No. 7,528,782. Fractus, 2009.
Infringement Chart—Samsung Solstice (SGH-A887). U.S. Pat. No. 7,015,868. Fractus, 2009.
Infringement Chart—Samsung Spex R210a. Fractus, 2009.
Infringement Chart—Samsung Spex R210a. U.S. Pat. No. 7,015,868. Fractus, 2009.
Infringement Chart—Samsung Spex R210a. U.S. Pat. No. 7,123,208. Fractus, 2009.
Infringement Chart—Samsung Spex R210a. U.S. Pat. No. 7,394,432. Fractus, 2009.
Infringement Chart—Samsung Spex R210a. U.S. Pat. No. 7,397,431. Fractus, 2009.
Infringement Chart—Samsung Spex R210a. U.S. Pat. No. 7,528,782. Fractus, 2009.
Infringement Chart—Samsung SPH-A523. Fractus, 2009.
Infringement Chart—Samsung SPH-A523. U.S. Pat. No. 7,015,868. Fractus, 2009.
Infringement Chart—Samsung SPH-A523. U.S. Pat. No. 7,123,208. Fractus, 2009.
Infringement Chart—Samsung SGH-A523. U.S. Pat. No. 7,394,432. Fractus, 2009.
Infringement Chart—Samsung SPH-A523. U.S. Pat. No. 7,528,782. Fractus, 2009.
Infringement Chart—Samsung SPH-M550. Fractus, 2009.
Infringement Chart—Samsung SPH-M550. U.S. Pat. No. 7,015,868. Fractus, 2009.
Infringement Chart—Samsung SPH-M550. U.S. Pat. No. 7,123,208. Fractus, 2009.
Infringement Chart—Samsung SPH-M550. U.S. Pat. No. 7,397,431. Fractus, 2009.
Infringement Chart—Samsung SPH-M550. U.S. Pat. No. 7,528,782. Fractus, 2009.
Infringement Chart—Samsung SPH M520. Fractus, 2009.
Infringement Chart—Samsung SPH M520. U.S. Pat. No. 7,528,782. Fractus, 2009.
Infringement Chart—Samsung SPH M520. U.S. Pat. No. 7,015,868. Fractus, 2009.
Infringement Chart—Samsung SPH M520. U.S. Pat. No. 7,123,208. Fractus, 2009.
Infringement Chart—Samsung SPH M520. U.S. Pat. No. 7,394,432. Fractus, 2009.
Infringement Chart—Samsung SGH M520. U.S. Pat. No. 7,397,431. Fractus, 2009.
Infringement Chart—Samsung SPH M540.. Fractus, 2009.
Infringement Chart—Samsung SPH M540. U.S. Pat. No. 7,528,782. Fractus, 2009.
Infringement Chart—Samsung SPH M540. U.S. Pat. No. 7,015,868. Fractus, 2009.
Infringement Chart—Samsung SPH M540. U.S. Pat. No. 7,123,208. Fractus, 2009.
Infringement Chart—Samsung SPH M540. U.S. Pat. No. 7,397,431. Fractus, 2009.
Infringement Chart—Samsung SPH-A523. U.S. Pat. No. 7,397,431. Fractus, 2009.
Infringement Chart—Samsung Sway SCH-U650. Fractus, 2009.
Infringement Chart—Samsung Sway SCH-U650. U.S. Pat. No. 7,015,868. Fractus, 2009.
Infringement Chart—Samsung Sway SCH-U650. U.S. Pat. No. 7,123,208. Fractus, 2009.
Infringement Chart—Samsung Sway SCH-U650. U.S. Pat. No. 7,397,431. Fractus, 2009.
Infringement Chart—Samsung Sway SCH-U650. U.S. Pat. No. 7,528,782. Fractus, 2009.
Infringement Chart—Sanyo Katana II. Fractus, 2009.
Infringement Chart—Sanyo Katana II. U.S. Pat. No. 7,015,868. Fractus, 2009.
Infringement Chart—Sanyo Katana II. U.S. Pat. No. 7,123,208. Fractus, 2009.
Infringement Chart—Sanyo Katana II. U.S. Pat. No. 7,394,432. Fractus, 2009.
Infringement Chart—Sanyo Katana II. U.S. Pat. No. 7,397,431. Fractus, 2009.

(56) References Cited

OTHER PUBLICATIONS

Infringement Chart—Sanyo Katana II. U.S. Pat. No. 7,528,782. Fractus, 2009.
Infringement Chart—Sanyo Katana LX. Fractus, 2009.
Infringement Chart—Sanyo Katana LX. U.S. Pat. No. 7,015,868. Fractus, 2009.
Infringement Chart—Sanyo Katana LX. U.S. Pat. No. 7,123,208. Fractus, 2009.
Infringement Chart—Sanyo Katana LX. U.S. Pat. No. 7,397,431. Fractus, 2009.
Infringement Chart—Sanyo Katana LX. U.S. Pat. No. 7,528,782. Fractus, 2009.
Infringement Chart—Sanyo S1. Fractus, 2009.
Infringement Chart—Sanyo S1. U.S. Pat. No. 7,015,868. Fractus, 2009.
Infringement Chart—Sanyo S1. U.S. Pat. No. 7,123,208. Fractus, 2009.
Infringement Chart—Sanyo S1. U.S. Pat. No. 7,397,431. Fractus, 2009.
Infringement Chart—Sanyo S1. U.S. Pat. No. 7,528,782. Fractus, 2009.
Infringement Chart—Sanyo SCP 2700.. Fractus, 2009.
Infringement Chart—Sanyo SCP 2700. U.S. Pat. No. 7,015,868. Fractus, 2009.
Infringement Chart—Sanyo SCP 2700. U.S. Pat. No. 7,123,208. Fractus, 2009.
Infringement Chart—Sanyo SCP 2700. U.S. Pat. No. 7,397,431. Fractus, 2009.
Infringement Chart—Sanyo SCP 2700. U.S. Pat. No. 7,528,782. Fractus, 2009.
Infringement Chart—Sharp Sidekick 3. Fractus, 2009.
Infringement Chart—Sharp Sidekick 3. U.S. Pat. No. 7,015,868. Fractus, 2009.
Infringement Chart—Sharp Sidekick 3. U.S. Pat. No. 7,123,208. Fractus, 2009.
Infringement Chart—Sharp Sidekick 3. U.S. Pat. No. 7,394,432. Fractus, 2009.
Infringement Chart—Sharp Sidekick 3. U.S. Pat. No. 7,397,431. Fractus, 2009.
Infringement Chart—Sharp Sidekick 3. U.S. Pat. No. 7,528,782. Fractus, 2009.
Infringement Chart—Sharp Sidekick 2008. Fractus, 2009.
Infringement Chart—Sharp Sidekick 2008. U.S. Pat. No. 7,015,868 Fractus, 2009.
Infringement Chart—Sharp Sidekick 2008. U.S. Pat. No. 7,123,208. Fractus, 2009.
Infringement Chart—Sharp Sidekick 2008. U.S. Pat. No. 7,394,432. Fractus, 2009.
Infringement Chart—Sharp Sidekick 2008. U.S. Pat. No. 7,397,431. Fractus, 2009.
Infringement Chart—Sharp Sidekick 2008. U.S. Pat. No. 7,528,782. Fractus, 2009.
Infringement Chart—Sharp Sidekick LX. U.S. Pat. No. 7,015,868. Fractus, 2009.
Infringement Chart—Sharp Sidekick LX 2009.. Fractus, 2009.
Infringement Chart—Sharp Sidekick LX 2009. U.S. Pat. No. 7,015,868. Fractus, 2009.
Infringement Chart—Sharp Sidekick LX 2009. U.S. Pat. No. 7,123,208. Fractus, 2009.
Infringement Chart—Sharp Sidekick LX 2009. U.S. Pat. No. 7,394,432. Fractus, 2009.
Infringement Chart—Sharp Sidekick LX 2009. U.S. Pat. No. 7,397,431. Fractus, 2009.
Infringement Chart—Sharp Sidekick LX 2009. U.S. Pat. No. 7,528,782. Fractus, 2009.
Infringement Chart—Sharp Sidekick LX. U.S. Pat. No. 7,123,208. Fractus, 2009.
Infringement Chart—Sharp Sidekick LX. U.S. Pat. No. 7,148,850. Fractus, 2009.
Infringement Chart—Sharp Sidekick LX. U.S. Pat. No. 7,394,432. Fractus, 2009.
Infringement Chart—Sharp Sidekick LX. U.S. Pat. No. 7,397,431. Fractus, 2009.
Infringement Chart—Sharp Sidekick LX. U.S. Pat. No. 7,528,782. Fractus, 2009.
Infringement Chart—UTStarcom CDM7126. Fractus, 2009.
Infringement Chart—UTStarcom CDM7126. U.S. Pat. No. 7,015,868. Fractus, 2009.
Infringement Chart—UTStarcom CDM7126. U.S. Pat. No. 7,123,208. Fractus, 2009.
Infringement Chart—UTStarcom CDM7126. U.S. Pat. No. 7,394,432. Fractus, 2009.
Infringement Chart—UTStarcom CDM7126. U.S. Pat. No. 7,397,431. Fractus, 2009.
Infringement Chart—UTStarcom CDM7126. U.S. Pat. No. 7,411,556. Fractus, 2009.
Infringement Chart—UTStarcom CDM7126. U.S. Pat. No. 7,528,782. Fractus, 2009.
Infringement Chart—UTStarcom Quickfire GTX75. Fractus, 2009.
Infringement Chart—UTStarcom Quickfire GTX75. U.S. Pat. No. 7,015,868. Fractus, 2009.
Infringement Chart—UTStarcom Quickfire GTX75. U.S. Pat. No. 7,123,208 Fractus, 2009.
Infringement Chart—UTStarcom Quickfire GTX75. U.S. Pat. No. 7,394,432. Fractus, 2009.
Infringement Chart—UTStarcom Quickfire GTX75. U.S. Pat. No. 7,397,431. Fractus, 2009.
Infringement Chart—UTStarcom Quickfire GTX75. U.S. Pat. No. 7,528,782. Fractus, 2009.
Infringement Chart—Samsung SGH A867. U.S. Pat. No. 7,394,432. Fractus. Nov. 5, 2009.
Infringement Chart—Samsung SGH A867. U.S. Pat. No. 7,397,431. Fractus. Nov. 5, 2009.
Infringement Chart—Samsung SGH A867. U.S. Pat. No. 7,528,782. Fractus. Nov. 5, 2009.
Infringement Chart—RIM Blackberry 8110. U.S. Pat. No. 7,394,432. Fractus. Nov. 5, 2009.
Letter from Baker Boils to Howison & Arnott LLP including exhibits. Defendants—Baker Boils. Aug. 5, 2010.
Letter from Baker Boils to Kenyon & Kenyon LLP, Winstead PC and Howison & Arnott LLP including exhibits.. Defendants—Baker Botts. Oct. 28, 2009.
Rebuttal expert report of Dr. Dwight L. Jaggard (redacted version). Fractus. Feb. 16, 2011.
Rebuttal expert report of Dr. Stuart A. Long (redacted version). Fractus. Feb. 16, 2011.
Rebuttal expert report of Dr. Warren L. Stutzman (redacted version). Fractus. Feb. 16, 2011.
The oral and videotaped deposition of Dwight Jaggard. vol. 1. Defendants. Mar. 8, 2011.
The oral and videotaped deposition of Dwight Jaggard. vol. 2. Defendants. Mar. 9, 2011.
The oral and videotaped deposition of Dwight Jaggard. vol. 3. Defendants. Mar. 10, 2011.
Transcript of jury trial before the Honorable Leonard Davis—May 18, 2011—1:00 PM. Court. May 18, 2011.
Transcript of jury trial before the Honorable Leonard Davis—May 18, 2011—8:45 AM. Court. May 18, 2011.
Transcript of jury trial before the Honorable Leonard Davis—May 19, 2011—1:00 PM. Court. May 19, 2011.
Transcript of jury trial before the Honorable Leonard Davis—May 19, 2011—8:45 AM. Court. May 19, 2011.
Transcript of jury trial before the Honorable Leonard Davis—May 20, 2011—12:30 PM. Court. May 20, 2011.
Transcript of jury trial before the Honorable Leonard Davis—May 20, 2011—8:30 AM. Court. May 20, 2011.
Transcript of jury trial before the Honorable Leonard Davis—May 23, 2011—8:55 Am. Court. May 23, 2011.
Transcript of jury trial before the Honorable Leonard Davis US District Judge—May 17, 2011—8:00 AM. Court. May 17, 2011.
Transcript of jury trial before the Honorable Leonard Davis, US District Judge—May 17, 2011—1:10 PM. Court. May 17, 2011.

(56) References Cited

OTHER PUBLICATIONS

Transcript of pretrial hearing before the Honorable Leonard Davis, US District Judge—May 16, 2011—2:00 PM. Court. May 16, 2011.
Adcock, M. D New type feed for high speed conical scanning. Symposium on the USAF Antenna Research and Development Program, 2nd. Aug. 11, 1952.
Addison, P. S. Fractals and Chaos—An illustrated course—Full. Institute of Physics Publising Bristol and Philadelphia. Jan. 1, 1997.
Ali, M.; Hayes, G. J. et al A triple band internal antenna for mobile handheld terminals. Antennas and Propagation Society International Symposium, 2002. IEEE. Jun. 16, 2002.
Andersen, J. B. The handbook of antenna design—Low- and medium-gain microwave antennas. Rudge, A. W. et al—IEE Eletromagnetic Waves Series; Peter Peregrinus Ltd. (2nd ed.). Volumes 1 and 2. pp. 526-543. Jan. 1, 1986.
Ando, A. A novel electromagnetically coupled microstrip antenna with a rotatable patch for personal handy phone system units. Antennas and Propagation, IEEE Transactions on. Jun. 1, 1998.
Anguera, J.; Font, G.; Puente, C.; Borja, C.; Soler, J. Multifrequency microstrip patch antenna using multiple stacked elements. Microwave and Wireless Components Letters. vol. 13. No. 3 Mar. 1, 2003.
Anguera, J.; Puente, C.; Borja, C. A procedure to design stacked microstrip patch antennas on a simple network model. Microwave and Optical Technology Letters. Aug. 1, 2001.
Anguera, J.; Puente, C.; Borja, C. A procedure to design wide-band electromagnetically-coupled stacked microstrip antennas based on a simple network model. Antennas and Propagation Society International Symposium, 1999. IEEE. Jul. 11, 1999.
Anguera, J.; Puente, C.; Borja, C.; Font, G.; Romeu, J. Diseño de antenas impresas de banda ancha alimentadas mediante acoplo capacitivo. XV Simposium Nacional de la Unión Cientifica Internacional de la Radio (URSI) : Zaragoza, 2000. Sep. 1, 2000.
Anguera, J.; Puente, C.; Borja, C.; Montero, R.; Soler, J. Antena microstrip miniatura y de alta directividad basada en el fractal de Sierpinski. XVI Simposium Nacional de la Unión Cientifica Internacional de la Radio (URSI) : Villaviciosa de Odón, 2001. Sep. 1, 2001.
Anguera, J.; Puente, C.; Borja, C.; Romeu, J. Miniature wideband stacked microstrip patch antenna based on the sierpinski fractal geometry. Antennas and Propagation Society International Symposium, 2000. IEEE. vol. 3. pp. 1700-1703. Jul. 1, 2000.
Anguera J.; Puente, C.; Romeu, J. An optimum method to design probe-fed single-layer single-path wideband microstrip antenna. Antennas and Propagation Society International Symposium, 2000. IEEE. Apr. 1, 2000.
Azadegan, R.; Sarabandi, K. Design of miniaturized slot antennas. IEEE Antennas and Propagation Society International Symposium. vol. 4. pp. 565-568. Jul. 8, 2001.
Bach Andersen, J. et al. On closely coupled dipoles in a random field. Antennas and Wireless Propagation Letters, IEEE. Dec. 1, 2006.
Bahar, E.; Son Lee, B. Full wave vertically polarized bistatic radar cross sections for random rough surfaces. Antennas and Propagation, IEEE Transactions on. Feb. 1, 1995.
Balanis, C. Antenna Theory—Analysis and design—Chapter 1.4—Current distribution on the thin wire antenna. John Wiley & Sons. Jan. 1, 2005.
Balanis, Constantine a. Antenna Theory—Analysis and design—Chapter 10—Travelling wave and broadband antennas. Hamilton Printing. pp. 498-502. Jan. 1, 1982.
Balanis, Constantine A. Antenna theory—Analysis and Design—Chapter 9 / Chapter 14—Broadband dipoles and matching techniques / Microstrip antennas. Hamilton Printing. Jan. 1, 1982.
Barnsley, M. Fractals Everywhere. Academic Press Professional. Jan. 1, 1993.
Barreiros, J.; Cameirao, P.; Peixeiro, C. Microstrip patch antenna for gsm 1800 handsets. Antennas and Propagation Society International Symposium, 1999. IEEE. Jul. 11, 1999.
Barrick, W. A helical resonator antenna diplexer. Symposium on the USAF antenna research and development program, 10th. Oct. 3, 1960.
Batson, D. D. et al VHF unfurlable turnstile antennas. Symposium USAF antenna research and development program, 19th. Oct. 14, 1969.
Berizzi, F. Fractal analysis of the signal scattered from the sea surface. Antennas and Propagation, IEEE Transactions on. vol. 47. No. 2. Feb. 1, 1999.
Best, S. On the significance of self-similar fractal geometry in determining the multiband behaviour of the Sierpinski gasket antenna. IEEE Antennas and wireless propagation letters. Jan. 1, 2002.
Best, S. R. The fractal loop antenna : understanding the significance of fractal geometry in determining antenna performance. QEX Magazine. Mar. 1, 2002.
Besthom 1.0 to 21.0 GHz Log-periodic dipole antenna. Symposium on the USAF Antenna Research and Development Program, 18th. Oct. 15, 1968.
Blackband, W. T. The handbook of antenna design—Chapter 18—Coaxial transmisison lines and components. Rudge, A. W. et al.Peter Peregrinus. vol. 1 and vol. 2. pp. 1612-1623. Jan. 1, 1986.
Bokhari, S. A.; archer, J.-F.; Mosig, Juan R. et al a small microstrip patch antenna with a convenient tuning option. Antennas and Propagation, IEEE Transactions on. Nov. 1, 1996.
Borja, C. Fractal microstrip antennas : Antenas fractales microstrip. Universitat Politecnica de Catalunya. Jul. 1, 1997.
Borja, C. High directivity fractal boundary microstrip patch antenna. Electronic Letters. vol. 36. No. 9. Apr. 27, 2000.
Borja, C. Mspk product. Fractus—Telefonica. Jan. 1, 1998.
Borja, C. Panel 01. Fractus—Telefonica. Jan. 1, 1998.
Borja, C.; Puente, C.; Medina, A. Iterative network models to predict the performance of Sierpinski fractal antennas and networks. Electronic Letters. vol. 34. No. 15. pp. 1443-1445. Jul. 23, 1998.
Borja, C.; Puente, C. Iterative network models to predict the performance of Sierpinski fractal antennas and networks. Antennas and Propagation Society International Symposium, 1999. IEEE. Jul. 11, 1999.
Borja, C.; Puente, C.; Anguera, J. et al Estudio experimental del parche de Sierpinski. XIV Simposium Nacional de la Unión Cientifica Internacional de la Radio (URSI) : Santiago de Compostela, 1999. Sep. 1, 1999.
Borja, C.; Puente, C.; Medina, A. et al Modelo sencillo para el estudio de los parametros de entrada de una antena fractal de Sierpinski. Xii Simposium Nacional de la Unión Cientifica Internacional de la Radio (URSI) :Bilbao, 1997. Sep. 1, 1997.
Borja, C.; Puente, C.; Medina, A. et al Traslacion de la propiedad de autosemejanza de los fractales al comportamiento electromagnetico de parches con geometria fractal. XIII Simposium Nacional de la Unión Cientifica Internacional de la Radio (URSI) : Pamplona, 1997. Sep. 1, 1998.
Borja, C.; Puente, C.; Romeu, J, Anguera, J. Fractal multiband patch antenna. Antennas and Propagation Society International Symposium, 2000. IEEE. Apr. 1, 2000.
Borja, C.; Romeu, J. Multiband Sierpinski fractal patch antenna. Antennas and Propagation Society International Symposium, 2000. IEEE. Jul. 16, 2000.
Borja, C.; Romeu, J. Parche de Sierpinski perturbado. XV Simposium Nacional de la Unión Cientifica Internacional de la Radio (URSI) : Zaragoza, 2000. Sep. 13, 2000.
Borowski, E. J. Dictionary of Mathematics. Collins—Case 6:09-cv-00203-LED-JDL.. Jan. 1, 1989.
Boshoff, H. A fast box counting algorithm for determining the fractal dimension of sampled continuous functions. IEEE. Jan. 1, 1992.
Breden, R. et al. Multiband printed antenna for vehicles. University of Kent. Jan. 3, 2000.
Breden, R. et al. Printed fractal antennas. National conference on antennas and propagation. Apr. 1, 1999.
Brown, A. A high-performance integrated K-band diplexer. Transactions on Microwave Theory and Techniques. Aug. 8, 1999.
Buczkowski, Stephane; Kyriacos, Soula; Nekka, Fahima; Cartilier, Louis The modified box-countig method: analysis of some characteristic paramenters. Pattern Recognition—ElServier Science. vol. 31. pp. 411-418(8). Apr. 20, 1998.
Burnett, G. F. Antenna installations on super constellation airbone early warning and control aircraft. Symposium on the USAF antenna research and development program, 4th. Oct. 17, 1954.

(56) References Cited

OTHER PUBLICATIONS

Bushman, F.W The boeing B-52 all flush antenna system. Symposium on the USAF Antenna Reseach and Development Program, 5th. Oct. 16, 1955.
Campi, M. Design of microstrip linear array antennas. Antenna Applications Symposium. Aug. 8, 1981.
Campos, O. Multiband and miniature fractal antennas study : Estudi d'antenes fractal multibanda i en miniatura. Universitat Politecnica de Catalunya. Jan. 1, 1998.
Mayes, P.E. Multi-arm logarithmic spiral antennas. Symposium on the USAF Antenna Research and Development Program, 10th. Oct. 3, 1960.
McCormick, J. A Low-profile electrically small VHF antenna. 15th Annual Symposium on the USAF antenna reserach and development program. Oct. 12, 1965.
McDowell, E. P. Flush mounted X-band beacon antennas for aircraft. Symposium on Usaf antenna Research and Development, 3th. Oct. 18, 1953.
McDowell, E. P. High speed aircraft antenna problems and some specific solutions for MX-1554. Symposium on the USAF Antenna Research and Development Program, 2nd. Oct. 19, 1952.
McSpadden, J. O. Design and experiments of a high-conversion-efficiency 5.8-GHz rectenna. IEEE Transactions on Microwave Theory and Techniques. Dec. 1, 1998.
Mehaute, A. Fractal Geometrics. CRC Press—Case 6:09-cv-00203-LED-JDL.. pp. 3-35. Jan. 1, 1990.
Meier, K.; Burkhard, M.; Schmid, T. et al Broadband calibration of E-field probes in Lossy Media. IEEE Transactions on Microwave Theory and Techniques. vol. 44. No. 10. Oct. 1, 1996.
Meinke, H.; Gundlah, F. V. Radio engineering reference book—vol. 1—Radio components. Circuits with lumped parameters . . . State energy publishing house. Jan. 1, 1961.
Misra, S. Experimental investigations on the impedance and radiation properties of a three-element concentric microstrip square-ring antenna. Microwave and Optical TEchnology Letters. vol. 11. No. 2. Feb. 5, 1996.
Misra, S.; Chowdhury, S. K. Study of impedance and radiation properties of a concentric microstrip triangular-ring antenna and Its modeling techniques using Fdtd method. IEEE Transactions on Antennas and Propagation. vol. 46. No. 4. Apr. 1, 1998.
Moheb, H. Design and development of co-polarized ku-band ground terminal system for very small aperture terminal (VSAT) application. IEEE International Symposium on Antennas and Propagation Digest. Jul. 11, 1999.
Moleiro, Alexandre et al Dual band microstrip patch antenna element with parasitic for gsm. Antennas and Propagation Society International Symposium, 2000. IEEE. Jul. 1, 2000.
Moosavi Bafrooei, Pedram Characteristics of single and double layer microstrip square-ring antennas. Antennas and Propagation, IEEE Transactions on. Oct. 1, 1999.
Morioka, T. et al Slot antenna with parasitic element for dual band operation. Electronic Letters. Dec. 4, 1997.
Munson, R. Antenna Engineering Handbook—Chapter 7—Microstrip Antennas. Johnson, R. C.—McGraw-Hill—Third Edition. Jan. 1, 1993.
Munson, R. Conformal microstrip array for a parabolic dish. Symposium on the USAF Antenna Research and Development Program. Oct. 1, 1973.
Munson, R. Microstrip phased array antennas. Symposium on the USAF Antenna Research and Development Program, 22th. Oct. 11, 1972.
Munson, R. E. Conformal microstrip communication antenna. Symposium on USAF antenna Research and Development, 23th. Oct. 10, 1973.
Mushiake, Yasuto Self-Complementary Antennas : Principle of Self Complementarity for Constant Impedance. Springer-Verlag. pp. 81-86. Jan. 1, 1996.
Nadan, T.; coupez, J. P. Integration of an antenna filter device, using a multi-layer, multi-technology process. European Microwave Conference, 28th. Oct. 1, 1988.
Nagai, K.; Mikuni, Y.; Iwasaki, H. A mobile radio antenna system having a self-diplexing function. IEEE Transactions on Vehicular Technology. Nov. 1, 1979.
Nagy, L. L Antenna engineering handbook—Chapter 39—Automobile antennas. Volakis, J.—McGraw-Hill; 4th edition. Jan. 1, 2007.
Naik, A.; Bathnagar, P. S. Experimental study on stacked ring coupled triangular microstrip antenna. Antenna Applications Symposium, 1994. Sep. 21, 1994.
Nakano; Vichien Dual-frequency square patch antenna with rectangular notch. Electronic Letters. Aug. 3, 1989.
Navarro, M. Original and translation in English of Final Degree Project—Diverse modifications applied to the Sierpinski antenna, a multi-band fractal antenna. Universitat Politecnica de Catalunya. Oct. 1, 1997.
Navarro, M.; Gonzalez, J. M.; Puente, C.; Romeu, J. Comprobacion del comportamiento autosimilar de la distribucion de corrientes sobre la superficie de la antena fractal de Sierpinski mediante termografias de infrarojos. XIII Simposium Nacional de la Unión Cientifica Internacional de la Radio (URSI) : Pamplona, 1997. Sep. 1, 1998.
Navarro, M.; Gonzalez, J. M.; Puente, C.; Romeu, J.; Aguasca, A. Self-similar surface current distribution on fractal Sierpinski antenna verified infra-red thermographs. Antennas and Propagation Society International Symposium, 1999. IEEE. Jul. 11, 1999.
Navarro, M.; Puente, C. et al Modificacion de la antenna de Sierpinski para el ajuste de las bandas operativas—Perturbation of the Sierpinski antenna to allocate operating bands. XII Simposium Nacional de la Unión Cientifica Internacional de la Radio (URSI) :Bilbao, 1997. Sep. 1, 1997.
Nelson, Thomas R.; Jaggard, Dwight L. Fractals in the Imaging Sciences. J. Optical Society AM.. Jan. 1, 1999.
Ng, V. Diagnosis of melanoma with fractal dimesions. IEEE Tencon. Jan. 1, 1993.
Nishikawa, T., Ishikawa, Y., Hattori, J. and Wakino, K. Dielectric receiving filter with Sharp stopband using an active feedback resonator method for cellular base stations. IEEE Transactions on Microwave Theory and Techniques. Dec. 1, 1989.
Nurnberger, M.W.; Volakis, J. L. A new planar feed for slot spiral antennas. Antennas and Propagation, IEEE Transactions on Jan. 1, 1996.
Ollikainen, J. et al. Thin dual resonant stacked shorted patch antenna for mobile communications. Electronic Letters. Mar. 18, 1999.
Omar, Amjad A.; Antar, Y. M. M. A new broad band dual frequency coplanar waveguide fed slot antenna. Antennas and Propagation Society International Symposium, 1999. IEEE. Jul. 11, 1999.
Ou, J. D. An analysis of annular, annular sector, and circular sector microstrip antennas. Antenna Applications Symposium. Sep. 23, 1981.
Palit, S. K.; Hamadi, A.; Tan, D. Design of a wideband dual-frequency notched microstrip antenna. Antennas and Propagation Society International Symposium, 1998. IEEE. Jun. 1, 1998.
Pan, Shang-Chen; Wong, Kin-Lu Dual frequency triangular microstrip antenna with a shorting pin. Antennas and Propagation, IEEE Transactions on. Dec. 1, 1997.
Pan, S. et al. Single-feed dual-frequency microstrip antenna with two patches. Antennas and Propagation Society International Symposium, 1999. IEEE. Aug. 1, 1999.
Papapolymerou, Ioannis; Franklin Drayton, Rhonda; Katehi, Linda P.B. Micromachined patch antennas. Antennas and Propagation, IEEE Transactions on. vol. 46. No. 2. Feb. 1, 1998.
Parker, E. A.; A. N. A. El Sheikh Convoluted array elements and reduced size unit cells for frequency selective surfaces. IEE Proceedings H. pp. 19-22. Feb. 1, 1991.
Parker, S. McGraw-Hill Dictionary of Scientific and Technical Terms (5th ed. 1994). McGraw-Hill—Case 6:09—cv-00203-LED-JDL. p. 1542. Jan. 1, 1994.
Parker, E. A.; A. N. A. El Sheikh Convoluted dipole array elements. Electronic Letters. Feb. 14, 1991.
Paschen, D. A. Broadband microstrip matching techniques. Antenna Applications Symposium. Sep. 21, 1983.
Paschen, D. A. Structural stopband elimination with the monopole-slot antenna. Antenna Applications Symposium. Sep. 22, 1982.
Paschen, D. A.; Olson, S. A crossed-slot antenna with an infinite balun feed. Antenna Applications Symposium, 1995.. Sep. 20, 1995.

(56) References Cited

OTHER PUBLICATIONS

Peitgen & D. Saupe, H The science of fractal images. Springer-Verlag. pp. 1-3, 24-27, 58-61. Jan. 1, 1988.
Peitgen et al, H O Chaos and fractals : new frontiers of science. Springer-Verlag. pp. 22-26, 62-66, 94-105, 212-219, 229-243. Jan. 1, 1992.
Peitgen, Heinz-Otto; Jürgens, Hartmut; Saupe, Dietmar Chaos and fractals. New frontiers of science. Springer-Verlag.. pp. 212-216; 387-388. Feb. 12, 1993.
Penn, A. Fractal dimension of low-resolution medical images. Engineering in Medicine and Biology Society, 1996. Proceedings of the 18th Annual International Conference of the IEEE. Jan. 1, 1996.
Phelan, R. A wide-band parallel-connected balun. Microwave Theory and Techniques, IEEE Transactions on. May 1, 1970.
Sanchez Hernandez, David et al Analysis and design of a dual-band circularly polarized microstrip patch antenna. Antennas and Propagation, IEEE Transactions on. Feb. 1, 1995.
Sanchez Hernandez, David et al Triple band microstrip patch antenna using a spur-line filter and a perturbation segment technique. Electronics Letters. Aug. 19, 1993.
Sandlin, B.; Terzouli, A. J. A genetic antenna desig for improved radiation over earth. Antenna Applications Symposium, Program for 1997—Allerton Conference Proceedings. Sep. 17, 1997.
Sarkar, N. An efficient differential box-counting approach to compute fractal dimension of image. IEEEn Transactions on System, Man and Cybernetics. vol. 24. No. 1. Jan. 3, 1994.
Saunders, S. R. Antennas and Propagation for Wireless Communication Systems—Chapter 4. John Wiley & Sons. Jan. 1, 1999.
Sawaya, K.; Ishizone, T.; Mushiake, Y. A simplified Expression of Dyadic Green's Function for a Conduction Half Sheet vol. AP-29, No. 5 (Sep. 1981). IEEE Transactions on Antennas & Propagation. vol. 29. No. 5. Sep. 1, 1981.
Scharfman, W. Telemetry antennas for high altitude missiles. Symposium on the USAF antenna research and development program, 8th. Oct. 20, 1958.
Schaubert, D. H.; Chang, W. C.; Wunsch, G. J. Measurement of phased array performance at arbitrary scan angles. Antenna Applications Symposium. Sep. 21, 1994.
Sclater, N.; Markus, J. McGraw-Hill Electronics Dictionary. McGraw Hill. pp. 21, 35, 183, 263, 298, 300. Jan. 1, 1997.
Seavey, John C-band paste-on and floating ring reflector antennas. Symposium on the USAF Antenna Research and Development Program, 23th. Oct. 10, 1973.
Serrano-Vaello, A. et al Printed antennas for dual-band GSM/DCS 1800 mobile handsets. Electronic Letters. Jan. 22, 1998.
Shen, Z.; Sze, Chen Tat; Law, Choi Look a circularly polarized microstrip-fed T-slot antenna. Antennas and Propagation Society International Symposium, 2000. IEEE. Jul. 16, 2000.
Shenoy, A. et al. Notebook satcom terminal technology development. International Conference on Digital Satellite Communications, 10th. May 15, 1995.
Shibagaki, N. Saw antenna duplexer module using saw-resonator-coupled filter for PCN system. IEEE Ultrasonics symposium. Oct. 5, 1998.
Shibagaki, N.; Sakiyama, K.; Hikita, M. Miniature saw antenna duplexer module for 1.9GHz PCN systems using saw-resonator-coupled filters. IEEE Ultrasonics Symposium. Oct. 5, 1998.
Shimoda, R. Y. A variable impedance ratio printed circuit balun. Antenna Applications Symposium. Sep. 26, 1979.
Shnitkin, H. Analysis of log-periodic folded dipole array. Antenna Applications Symposium. Sep. 10, 1992.
Sinclair, G. Theory of models of electromagnetic systems. Proceedings of the IRE. Nov. 1, 1948.
Sindou, M. et al Multiband and wideband properties of printed fractal branched antennas. Electronic Letters. Feb. 4, 1999.
Snow, W. L. Ku-band planar spiral antenna. Symposium on The USAF Antenna Research and Development Program, 19th. Oct. 14, 1969.
Snow, W. L. UHF crossed-slot antenna and applications. Symsposium on the USAF Antenna Research and Development program, 19th. Sep. 1, 1963.
So, P. et al Box-counting dimension without boxes—Computing D0 from average expansion rates. Physical Review E. vol. 60. No. 1. Jul. 1, 1999.
Soler, J.; Garcia, D.; Puente, C.; Anguera, J. Novel combined mod-p multiband antenna structures inspired by fractal geometries. Microwave and Optical Technology Letters. vol. 41. No. 5. Jun. 5, 2004.
Soler, J.; Puente, C. Analysis of the Sierpinski fractal multiband antenna using the muitiperiodic traveling wave v model. 24th European Space agency (ESA) Antenna Workshop on Innovative Periodic Antennas.. pp. 53-57. Jun. 1, 2001.
Soler, J.; Puente, C.; Anguera, J. Results on a new extended analytic model to understand the radiation performance of mod-p Sierpinski fractal multiband antennas. Antennas and Propagation Society International Symposium, 2003. IEEE. Jun. 22, 2003.
Soler, J.; Puente, C.; Anguera, J. Solutions to tailor the radiation patterns of 2D and 3D multiband antennas based on the Sierpinski fractal. Antennas and Propagation Society International Symposium, 2003. IEEE. Jun. 22, 2003.
Soler, J.; Puente , C.; Munduate, A. Novel broadband and multiband solutions for planar monople antenas. Antennas and Propagation Society International Symposium, 2002. IEEE. Jun. 16, 2002.
Soler, J.; Romeu, J. Antenas de Sierpinski de modulo-p. XV Simposium Nacional de la Unión Cientifica Internacional de la Radio (URSI) : Zaragoza, 2000. Sep. 1, 2000.
Soler, J.; Romeu, J.; Puente, C. Mod-P Sierpinski fractal multiband antenna. Antennas and Propagation Society International Symposium, 2000. IEEE. Apr. 4, 2000.
Soler Castany, J. Multi-band antennas for wireless communication systems : Antenes multibanda per sistemes de comunicaions inalàmbriques. Universitat Politècnica de Catalunya. Sep. 1, 1999.
Song, C. T. P. et al Sierpinski monopole antenna with controlled band spacing and input impedance. Electronic Letters. Jun. 24, 1999.
Song, C. T. P. et al Triple band planar inverted F antennas for handheld devices. Electronic Letters. Jan. 20, 2000.
Song, C. T. P. Fractal stacked monopole with very wide bandwidth. Electronic Letters. vol. 35. pp. 945-946. Jun. 1, 1999.
Song, C. T. P. Triple-band planar inverted F antenna. Antennas and Propagation Society International Symposium, 1999. IEEE. Jul. 11, 1999.
Srivastava, G. P. et al Dual band tunable microstrip patch antenna. Electronic Letters. Aug. 19, 1999.
Stang, P. F. Balanced flush mounted log-periodic antenna for aerospace vehicles—in Abstracts of the Twelfth Annual Symposium USAF antenna research. Symposium on USAF antenna Research and Development, 12th. Oct. 16, 1962.
Strugatsky, A. et al Multimode multiband antenna. Tactical communications: Technology in transition. Proceedings of the tactical communications conference. Apr. 28, 1992.
Stutzman, W. L.; Thiele, G. Antenna theory and design. John Wiley and Sons.. pp. 18, 36. Jan. 1, 1981.
Stutzman, W. L.; Thiele, G. A. Antenna theory and design. John Wiley and Sons. pp. 8-9, 43-48, 210-219. Jan. 1, 1998.
Stutzman, W. L.; Thiele, G. A. Antenna theory and design—Chapter 5—Resonant Antennas: Wires and Patches. Wiley. Chapter 5 (selected page). p. 210. Jan. 1, 1998.
Sze, Jia-Yi; Wong, Kin-Lu Designs of broadband microstrip antennas with embedded slots. Antennas and Propagation Society International Symposium, 1999. IEEE. Jul. 11, 1999.
Taga, T. Performance analysis of a built-in planar inverted F antenna for 800 MHz band portable radio units. IEEE Journal on Selected Areas in Communications. vol. 5. No. 5. Jan. 1, 1987.
Tai, Chen to; Long, Stuart. Antenna engineering handbook—Chapter 4—Dipoles and Monopoles. Johnson, R. McGraw Hill—(3rd Ed.). pp. 4-26-4-33. Jan. 1, 1993.
Tang, Y. The application of fractal analysis to feature extraction. IEEE. Jan. 1, 1999.
Tanidokoro, Hiroaki; Konishi, Nozomi et al I-wavelength loop dielectric chip antennas. Antennas and Propagation, IEEE Transactions on. Jan. 1, 1998.

(56) References Cited

OTHER PUBLICATIONS

Tanner, R. L.; O'Reilly, G. A. Electronic counter measure antennas for a modern electronic reconnaissance aircraft. Symposium on the USAF antenna research and development program, 4th. Oct. 17, 1954.
Targonski, S. D.; Pozar, David M. Dual band dual polarised printed antenna element. Electronic Letters. vol. 34. pp. 2193-2194. Nov. 1, 1998.
Teeter, W. L.; Bushore, K. R. A variable-ratio microwave power divider and multiplexer. IRE Transactions on microwave theory and techniques. Oct. 1, 1957.
Tehrani, Hooman; Chang, Kai A multifrequency microstrip fed annular slot antenna. Antennas and Propagation Society International Symposium, 2000. IEEE. Jul. 1, 2000.
Terman, F. E. Radio engineering. McGraw-Hill Book Company, Inc . . . pp. 73-74, 690-691, 730. Jan. 1, 1947.
The Glenn L. Martin Company Antennas for USAF B-57 series bombers. Symposium on the USAF antenna research and development program, 2nd. Oct. 19, 1952.
Theiler, J. Estimating fractal dimension. J. Opt. Soc. Am. A. Case 6:09-cv-00203-LED-JDL. vol. 7. No. 6. pp. 1055-1073. Jun. 1, 1990.
Turner, E. M. Broadband passive electrically small antennas for TV application. Proceedings of the 1977 Antenna Applications Symposium. Apr. 27, 1977.
Turner, E. M.; Richard, D. J. Development of an electrically small broadband antenna. Symposium on the USAF antenna research and development program, 18th. Oct. 15, 1968.
Verdura, O. Miniature fractal antenna : Antena fractal miniatura. Universitat Politecnica de Catalunya. Sep. 1, 1997.
Viratelle, D.; Langley, R. J. Dual band Pifa antenna. IEE Proceedings—Microwaves, Antennas and Propagation. Jan. 3, 2000.
Virga, K. L. Low-profile enhanced-bandwidth PIFA antennas for wireless communications packaging. Microwave Theory and Techniques, IEEE Transactions on. Oct. 10, 1997.
Volgov, V. A. Parts and units of radio electronic equipment. Energiya. Jan. 1, 1967.
Walker, G. J. et al Fractal volume antennas. Electronic Letters. Aug. 6, 1998.
Wall, H.; Davies, H. W. Communications antennas for mercury space capsule. Symposium on the USAF antenna research and development program, 11th. Oct. 16, 1961.
Watanabe, T.; Furutani, K.; Nakajima, N. et al Antenna switch duplexer for dualband phone (GSM / DCS) using LTCC multilayer technology. IEEE MTT-S International Microwave Symposium Digest. Jun. 19, 1999.
Waterhouse, R. B. Printed antenna suitable for mobile communication handsets. Electronic Letters. Oct. 23, 1997.
Watson, T.; Friesser, J. A phase shift direction finding technique. Annual Symposium on the USAF antenna research and development program. Oct. 21, 1957.
Weeks, W. L. Antenna engineering. McGraw-Hill Book Company. pp. 167-180. Jan. 1, 1968.
Weeks, W. L. Eletromagnetic theory for engineering applications. John Wiley & Sons. pp. 46-50. Jan. 1, 1964.
Wegner, D. E. B-70 antenna system. Symposium on the USAF antenna research and development program, 13th. Oct. 14, 1963.
Werner, D. H. Fractal antenna engineering—The theory and design of fractal antenna arrays. Antennas and Propagation Magazine, IEEE. Oct. 1, 1999.
Werner, D. H. Frequency independent features of self-similar fractal antennas. Radio Science. Nov. 1, 1996.
Werner, D. H. Radiation characteristics of thin-wire ternary fractal trees. Electronic Letters. Apr. 15, 1999.
Werner, D. H.; Werner, P. L.; Ferrare, A. J. Frequency independent features of self-similar fractal antennas. Antennas and Propagation Society International Symposium, 1996. AP-S. Digest. Jul. 21, 1996.
Werner, D. H. et al On the synthesis of fractal radiation patterns. Radio Science. Feb. 1, 1995.
Werner, D. H. et al. Frontiers in electromagnetics—The theory and design of fractal antenna arrays. IEEE Press. Chapter 3. pp. 94-95. Jan. 1, 1999.
West, B.H. et al. The Prentice-Hall Encyclopedia of Mathematics (1982). Prentice-Hall. pp. 404-405. Jan. 1, 1982.
Wheeler, H. A. Fundamental limitations of small antennas. Proceedings of the I.R.E. Jan. 1, 1947.
Wheeler, H. A. Small antennas. Symposium on the USAF antenna research and development program, 23rd. Oct. 10, 1973.
Wheeler, H. A. The radiansphere around a small antenna. Proceedings of the IRE. Aug. 1, 1959.
Wikka, K. Letter to FCC that will authorize the appointment of MORTON FLOM and/or FLOMASSOCIATES INC to act as their Agent in all FCC matters. Nokia Mobile Phones. Aug. 5, 1999.
Williams, T. et al Dual band meander antenna for wireless telephones. Microwave and Optical Technology Letters. Jan. 20, 2000.
Wong, K. L.; Sze, J. Y. Dual-frequency slotted rectangular microstrip antenna. Electronic Letters. Jul. 9, 1998.
Wong, Kin-Lu Broadband triangular microstrip antenna with U-shaped slot. Electronic Letters. vol. 33. No. 25. Dec. 4, 1997.
Wong, Kin-Lu Modified planar inverted F antenna. Electronic Letters. Jan. 8, 1998.
Wong, Kin-Lu Single-feed small circularly polarised square microstrip antenna. IEEE. Electronics Letters. vol. 33. No. 22. pp. 1833-1834. Oct. 28, 1997.
Wong, Kin-Lu; Chiou, Tzung-Wern Single patch broadband circularly polarized microstrip antennas. Antennas and Propagation Society International Symposium, 2000. IEEE. Jul. 16, 2000.
Wong, Kin-Lu; Yang, Kai-Ping Small dual-frequency microstrip antenna with cross slot. Electronic Letters. vol. 33. No. 23. Nov. 6, 1997.
Wu, Chun-Kun et al. Slot-coupled Meandered Microstrip Antenna for Compact Dual-frequency Operation. Electronics Letters. vol. 34. No. 11. May 28, 1998.
Wu, D. I. Dual-Frequency Microstrip Reflectarray. Antennas and Propagation Society International Symposium, 1995. AP-S. Digest. Jan. 1, 1995.
Yang, Kai-Ping Compact dual-frequency operation of rectangular microstrip antennas. Antennas and Propagation Society International Symposium, 1999. IEEE. Jul. 1, 1999.
Yang, X.; Chiochetti, J.; Papadopoulos, D. et al Fractal antenna elements and arrays. Applied microwave and wireless. May 1, 1999.
Yang, X. H.; Shafai, L. Multifrequency operation technique for aperture coupled microstrip antennas. Antennas and Propagation Society International Symposium, 1994. AP-S. Digest. Jun. 20, 1994.
Zhang, Dawei; Liang, G.C.; Shih, C.F. Narrowband lumped element microstrip filters using capacitively loaded inductors. Microwave Symposium Digest, 1995., IEEE MTT-S International. pp. 379-382. May 16, 1995.
Zhong, Shun-Shi; Cui, Jun-Hai Compact dual frequency microstrip antenna. Antennas and Propagation Society International Symposium, 2000. IEEE. Jul. 16, 2000.
Zurcher, J. F. A compact dual-port dual-frequency SSFIP /PIFA antenna with high decoupling. Microwave and Optical Technology Letters. Sep. 20, 1999.
American Heritage College Dictionary (1997). pp. 340 and 1016. Mifflin Comp. pp. 340, 1016. Jan. 1, 1997.
Collins Dictionary. Collins. p. 608. Jan. 1, 1979.
Digital cellular telecommunications system (Phase 2) : Types of Mobile Stations (MX) (GSM 02.06). ETSI. May 9, 1996.
Digital cellular telecommunications system (Phase 2+); Radio transmission and reception (GSM 05.05). ETSI Jul. 1, 1996.
Digital cellular telecommunications system (Phase2) : Abbreviations and acronyms (GSM01.04) GSM Technical Specification vs. 5.0.0. ETSI. Mar. 1, 1996.
Digital cellular telecommunications system (Phase2). Mobile Station MS Conformance specifiaction Part 1 Conformance Specification GSM11.10-1). ETSI. Mar. 1, 1996.
Digital cellular telecommunications system (Phase2); Mobile Station (MS) conformance specification; Part 1: Conformance specification (GSM 11.10-1 version 4.21.1). ETSI. Aug. 1, 1998.
FCC—United States table of frequency allocations. Federal Communications Commission. pp. 377-538. Oct. 1, 1999.

(56) References Cited

OTHER PUBLICATIONS

U.S. Appl. No. 95/001,389—U.S. Appl. No. 95/000,591—Patent owner's petition requesting continued reexamination for U.S. Pat. No. 7,123,208. Edell, Shpairo & Finnan. Feb. 8, 2013.
U.S. Appl. No. 95/001,390—U.S. Appl. No. 95/000,589—Patent owner's petition requesting continued reexamination for U.S. Pat. No. 7,015,868. Edell, Shapiro & Finnan. Feb. 8, 2013.
U.S. Appl. No. 95/001,455—Patent owner's appeal brief for the U.S. Pat. No. 7,528,782. Edell, Shapiro & Finnan, LLC. Mar. 25, 2013.
U.S. Appl. No. 95/001,455—U.S. Appl. No. 95/000,595—Third party requester's notice of cross-appeal for the U.S. Pat. No. 7,528,782. Samsung—Kyocera. Janaury 24, 2013.
U.S. Appl. No. 95/001,482—U.S. Appl. No. 95/000,586—Corrected patent owner's Appeal Brief for U.S. Pat. No. 7,397,431. Edell, Shapiro & Finnan, LLC. Feb. 22, 2013.
U.S. Appl. No. 95/001,482—U.S. Appl. No. 95/000,586—Third party requester's respondent brief for the U.S. Pat. No. 7,397,431. Samsung—Kyocera. Mar. 8, 2013.
U.S. Appl. No. 95/001,483—U.S. Appl. No. 95/000,586—Third party requester's notice of cross-appeal for the U.S. Pat. No. 7,394,432. Samsung—Kyocera. Jan. 22, 2013.
U.S. Appl. No. 95/001,483—U.S. Appl. No. 95/000,588—Patent owner's petition requesting continued reexamination for U.S. Pat. No. 7,394,432. Edell, Shapiro & Finnan. Feb. 8, 2013.
U.S. Appl. No. 95/,001,482, U.S. Appl. No. 95/000,586, U.S. Appl. No. 95/001,497—Third party requester's comments to patent owner's reply of Jan. 3, 2012 for U.S. Pat. No. 7,397,431. Defendants. Feb. 2, 2012.
U.S. Appl. No. 95/001,483—Request for inter partes reexamination of U.S. Pat. No. 7,394,432 including exhibits CC-A—CC-L. Samsung Electronics Co. Ltd. Nov. 11, 2010.
U.S. Appl. No. 95/001,483, U.S. Appl. No. 95000,588, U.S. Appl. No. 95/001,500—Decision sua sponte to merge reexamination proceedings of U.S. Pat. No. 7,394,432. USPTO. Mar. 17, 2011.
U.S. Appl. No. 95/001,483, U.S. Appl. No. 95/000,588, U.S. Appl. No. 95/001,500—Response to office action dated on Apr. 7, 2011 for U.S. Pat. No. 7,394,432. Sterne Kessler. Jul. 7, 2011.
U.S. Appl. No. 95/001,483, U.S. Appl. No. 95/000,588, U.S. Appl. No. 95/001,500—Action closing prosecution for U.S. Pat. No. 7,394,432 dated on Nov. 4, 2011. USPTO. Nov. 4, 2011.
Gianvittorio, John Paul et al. Fractal element antennas—a compilation of configurations with novel characteristics. Antennas and Propagation Society International Symposium, 2000. IEEE. Jul. 16, 2000.
Gilbert, R.; Pirrung, A.; Kopf, D. et al. Structurally-integrated optically-reconfigurable antenna array. Antenna Applications Symposium. Sep. 20, 1995.
Gillespie, E. S. Glide slope antenna in the nose radome of the F-104 A and B. Symposium on the USAF antenna research and development program, 7th. Oct. 21, 1957.
Gobien, A. T. Investigation of low profile antenna designs for use in hand-held radios—Master of Science. Virginia Polytechnic Institute and State University. Aug. 1, 2007.
Gonzalez, J. M.; Navarro, M.; Puente, C. et al Active zone self-similarity of fractal-sierpinski antenna verified using infra-red thermograms. Electronic Letters. vol. 35. No. 17. Aug. 19, 1999.
Gough, C. E.; Porch, A.; Lancaster, M. J. et al High Tc coplanar resonators for microwave applications and scientific studies. Physics. vol. 282-287. pp. 395-398. Aug. 1, 1997.
Graf, R Modern dictionary of electronics. Butterworth-Heinemann (6th Ed.).. pp. 209, 644. Jan. 1, 1984.
Gray, D.; Lu, J. W.; Thiel, D. V. Electronically steerable Yagi-Uda microstrip patch antenna array. IEEE Transactions on antennas and propagation. May 1, 1998.
Greiser, J. W. And Brown, G. S. A 500:1 scale model of warla : A wide aperture radio location array. Symposium on the USAF Antenna Research and Development Program, 13th. Oct. 14, 1963.
Griffin, D. W.; Parfitt, A. J. Electromagnetic design aspect of packages for monolithic microwave integrated circuit based arrays with integrated antenna elements. Antennas and Propagation, IEEE Transactions on. vol. 43. No. 9. Sep. 1, 1995.
Guo, Y. Dual band slot loaded short circuited patch antenna. Electronic Letters. Feb. 17, 2000.
Guo, Y. X.; Luk, K. F. Lee; Chow, Y. L. Double U-slot rectangular patch antenna. Electronic Letters. Sep. 17, 1998.
Gupta, K. C.; Benalla, A. Microstrip antenna design. Artech House. Jan. 1, 1988.
Gupta, K.C. Broadbanding techniques for microstrip patch antennas—a review. Antenna Applications Sysmposium. Sep. 21, 1988.
Haapala, P.; Vainikainen, P. Helical antennas for multi-mode mobile phones. European Microwave Conference, 1996. 26th. Sep. 9, 1996.
Hagström, P. Novel ceramic antenna filters for GSM / DECT and GSM / PCN network terminals. The 8th IEEE International Symposium on Personal, Indoor and Mobile Radio Communications, 1997. 'Waves of the Year 2000'. PIMRC '97. Sep. 1, 1997.
Hall, P. S. System applications—the challenge for active integrated antennas. AP2000 Millenium conference on antennas and propagation. Apr. 1, 2000.
Halloran, T. W. A dual channel VHF telemetry antenna system for re-entry vehicle applications. Symposium on the USAF Antenna Research and Development Program, 11th. Oct. 16, 1961.
Hammad, H. F. et al Dual band aperture coupled antenna using spur line. Antennas and Propagation Society International Symposium, 1997. AP-S. Digest. Jul. 24, 19973.
Hansen, R. C. Fundamental limitations in antennas. IEEE Proceedings. vol. 69. No. 2. pp. 170-182. Feb. 1, 1981.
Hara Prasad, R. V. Microstrip fractal patch antenna for muitiband communication. IEEE Electromagnetic Letters. vol. 36. No. 14. pp. 1179-1180. Jul. 6, 2000.
Hart, N.; Chalmers, A. Fractal element antennas. Digital Image Computing and Applications 97 in New Zealand. Jun. 2, 1997.
Heberling, D.; Geisser, M. Trends on handset antennas. Microwave Conference, 1999. 29th European. Mar. 3, 1999.
Henderson West, B The Prentice-Hall encyclopedia of mathematics. Prentice-Hall. pp. 404-425. Jan. 1, 1982.
Herscovici, Naftali New considerations in the design of microstrip antennas. Antennas and Propagation, IEEE Transactions on Jun. 1, 1998.
Nikita, M.; Shibagaki, N.; Asal, K. et al New miniature saw antenna duplexer used in GHz-band digital mobile cellular radios. IEEE Ultrasonics Symposium. Nov. 7, 1995.
Hikita ' M. M et al Miniature SAW antenna duplexer for 800-Mhz portable telephone used in cellular radio systems. Microwave Theory and Techniques, IEEE Transactions on Jun. 1, 1988.
Hill, J. E.; Bass, J. F. An integrated strip-transmission-line antenna system for J-band. Symposium on the USAF Antenna Research and Development Program, 23th. Oct. 10, 1973.
Hofer, D. A.; Kesler, Dr. O. B.; Loyet, L. L. A compact multi-polarized broadband antenna. Proceedings of the 1989 antenna applications symposium. Sep. 20, 1989.
Hofmeister, M. The dual-frequency-inverted-F monopole antenna for mobile communications. N/A. Jan. 6, 1999.
Hohlfeld, R. G.; Cohen N. Self-similarity and the geometric requirements for frequency independence in antennae. Fractals. vol. 7. No. 1. pp. 79-84. Jan. 17, 1999.
Holtum, A. G. A dual frequency dual polarized microwave antenna. Symposium on the USAF Antenna Research and Development Program, 16. Oct. 11, 1966.
Holzschuh, D. L. Hardened antennas for atlas and titan missile site communications. Symposium on the USAF Antenna Research and Development Program, 13th. Oct. 14, 1963.
Hong, J. S.; Lancaster, M. J. Compact microwave elliptic function filter using novel microstrip meander open-loop resonators. Electronic Letters. vol. 32. pp. 563-564. Mar. 14, 1996.
Hong, J. S.; Lancaster, M. J. Recent advances in microstrip filters for communications and other applications. Iee Colloquium on Advances in Passive Microwave Components (Digest No. 1997/154). May 22, 1997.
Hsieh, Gui-Bin; Pan, Shan-Cheng Dual-frequency slotted triangular microstrip antenna with an inset microstrip-line feed. Microwave and Optical Technology Letters. vol. 27. No. 5. Dec. 5, 2000.

(56) References Cited

OTHER PUBLICATIONS

Huynh, T; Lee, K. F. Single-layer single-patch wideband microstrip antenna. Electronic Letters. Aug. 3, 1995.
Hyneman, R. F.; Mayes, P. E.; Becker, R. C. Homing antennas for aircraft ( 450-2500 MC ). Symposium on the USAF antenna research and development program, 5th. Oct. 16, 1955.
Ikata, O.; Satoh, Y.; Uchishiba, H. et al Development of small antenna duplexer using saw filters for handheld phones. IEEE Ultrasonics Symposium. Oct. 31, 1993.
Ingerson, P. G.; Mayes, P. E. Asymmetrical feeders for log-periodic antennas. Symposium on the USAF antenna research and development program, 17th. Nov. 14, 1967.
Isbell, D. E. Multiple terminal log-periodic antennas. Symposium on the USAF antenna research and development program, 8th. Oct. 20, 1958.
Isbell, D. E. Non-planar logarithmically periodic antenna structures. Symposium on the USAF antenna research and development program, 7th. Oct. 21, 1957.
Ishikawa, Y.; Hattori, J.; Andoh, M. et al. 800 MHz High Power Bandpass Filter Using TM Dual Mode Dielectric Resonators. European Microwave Conference, 21th. Sep. 9, 1991.
Iwasaki, Hisao; Suzuki, Yasuo Electromagnetically coupled circular patch antenna consisting of multilayered configuration. Antennas and Propagation, IEEE Transactions on. Jun. 1, 1996.
Jaggard, D. Diffraction by Band limited Fractal Screens. Optical Society AM. vol. 4. No. 6. Jun. 1, 1987.
Jaggard, D. L. Fractal electrodynamics and modeling. Directions in electromagnetic wave modeling.. pp. 435-446. Jan. 1, 1991.
James, J. R.; Hall, P. S. Handbook of microstrip antennas. Peter Peregrinus Ltd.. vol. 1. pp. 3-4, 205-207. Jan. 1, 1989.
Johnson, R. C. Antenna engineering handbook—Table of contents. McGraw-Hill. Jan. 1, 1993.
Jones, H. S. Conformal and Small antenna designs. Proceedings of the Antennas Applications Symposium. Aug. 1, 1981.
Katsibas, K. D.; Balanis, C. A.; Panayiotis, A. T.; Birtcher, C. R. Folded loop antenna for mobile hand-held units. IEEE Transactions on antennas and propagation. vol. 46. No. 2. Feb. 1, 1998.
Document 0649—Defendants LG Electronics Inc, LG Electronics USA, and LG Electronics Mobilecomm USA Inc's second amended answer and counterclaim to second amended complaint. Defendants. Feb. 28, 2011.
Document 0657—Defendant Pantech Wireless Inc amended answer, affirmative defenses, and counterclaims to Fractus' second amended complaint. Defendants. Feb. 28, 2011.
Document 0666—Fractus's sur-reply to defendants' motion for reconsideration of the court's december 17, 2010 claim construction order based on newly-available evidence. Susman Godfrey. Mar. 8, 2011.
Document 0670—Order. Court. Mar. 9, 2011.
Document 0678—Plaintiff Fractus SA's answer to second amended counterclaims of defendant HTC Corporation to Fractus's second amended complaint. Susman Godfrey. Mar. 14, 2011.
Document 0680—Plaintiff Fractus SA's answer to second amended counterclaims of defendant HTC to Fractus's second amended complaint. Susman Godfrey. Mar. 14, 2011.
Document 0694—Plaintiff Fractus SA's answer to second amended counterclaims of defendant LG Electronics to Fractus's second amended complaint. Susman Godfrey. Mar. 15, 2011.
Document 0695—Plaintiff Fractus SA's answer to second amended counterclaims of defendant Samsung to Fractus's second amended complaint. Susman Godfrey. Mar. 15, 2011.
Document 0696—Plaintiff Fractus SA's answer to amended counterclaims of defendant Pantech Wireless Inc to Fractus's second amended complaint. Susman Godfrey. Mar. 15, 2011.
Document 0715—Letter to John D. Love—Permission to file a summary judgment motion of no indefiniteness on the issues wher the Court's Report and Recommendation already has held that the claim term is not indefinite. Susman Godfrey. Mar. 18, 2011.
Document 0716—Letter to John D. Love—Permission to file a partial summary judgement motion on infringement.. Susman Godfrey, LLP. Mar. 18, 2011.
Document 0721—Letter to John D. Love—Permission to file a motion for summary judgment of invalidity of the following 7 asserted claims from the MLV, patent family . . . Defendants —Baker Botts, LLP. Mar. 18, 2011.
Document 0768—Fractus, S.A.'s objections to the Court's Mar. 9, 2011, Order. Susman Godfrey. Mar. 25, 2011.
Document 0780—Defendants' opposition to Fractus SA objections to the Court's Mar. 9, 2011 Order. Defendants—Baker Botts, LLP. Mar. 31, 2011.
Document 0783—Order. Court. Apr. 1, 2011.
Document 0841—Stipulation of Dismissal of all Claims and Counterclaims re '850 and '822. Defendants. Apr. 15, 2011.
Document 0843—Joint Motion to Dismiss Claims and Counterclaims re '850 and '822. Defendants. Apr. 15, 2011.
Document 0854—Defendants' Motion to Clarify Claim Construction. Defendants. Apr. 18, 2011.
Document 0868—Order. Court. Apr. 19, 2011.
Document 0876—Fractus's surreply to defendants' Motion for Summary Judgment re publication dates of three references. Susman Godfrey. Apr. 20, 2011.
Document 0887—Fractus's Response to Defendants' Motion to Clarify Claim Construction. Susman Godfrey. Apr. 25, 2011.
Document 0889—Reply in support of defendants' motion to clarify claim construction. Defendants. Apr. 27, 2011.
Document 0893—Fractus SA's surreply to defendant's motion to clarify claim construction. Susman Godfrey. Apr. 29, 2011.
Document 0900—Order. Court. Apr. 29, 2011.
Document 0901—Report and recommendation of United States Magistrate Judge. Court. May 2, 2011.
Document 0902—Fractus Sa's objections to defendants' prior art notice. Susman Godfrey. May 2, 2011.
Document 0915—Defendants' response to plaintiff's objections to defendants notice of prior art. Defendants. May 5, 2011.
Document 0933—Defendants' motion for reconsideration of, and objections to, the May 2, 2011 report and recommendation clarifying claim construction. Defendants. May 9, 2011.
Document 0939—Fractus's response to defendants' motion for reconsideration of and objections to the May 2, 2011, report and recommendations clarifying claim construction. Susman Godfrey. May 10, 2011.
Document 0968—Order. Court. May 13, 2011.
Document 0971—Order. Court. May 13, 2011.
Document 1082—Joint motion to dismiss HTC. Susman Godfrey LLP. Sep. 13, 2011.
Document 1083—Order—Final consent judgement HTC. Court. Sep. 15, 2011.
Document 1088—Samsung's motion to determine intervening rights in view of new Federal Circuit case law or, in the alternative, to stay the case pending the outcome of reexamination. Defendants. Oct. 19, 2011.
Document 1091—Fractus's response to Samsung's motion to determine intervening rights or to stay the case pending the outcome of reexamination. Susman Godfrey LLC. Nov. 2, 2011.
Document 1092—Samsung's reply in support of its motion to determine intervening rights in view of new Federal Circuit case law or, in the alternative, to stay the case pending the outcome of reexamination. Defendants. Nov. 14, 2011.
Expert report of Dr. Warren L. Stutzman (redacted)—expert witness retained by Fractus. Fractus. Feb. 23, 2011.
Expert report of Dwight L. Jaggard (redacted)—expert witness retained by Fractus. Fractus. Feb. 23, 2011.
Expert report of Stuart Long (redacted)—expert witness retained by Fractus. Fractus. Feb. 23, 2011.
Fractus' Claim Construction Presentation—Markman Hearing. Fractus. Sep. 2, 2010.
Grounds of Invalidity. Hogan Lovells International LLP. Sep. 15, 2010.
U.S. Appl. No. 95/001,389, U.S. Appl. No. 95/000,591—Action closing prosecution for the U.S. Pat. No. 7,123,208. USPTO. Apr. 27, 2012.

(56) References Cited

OTHER PUBLICATIONS

U.S. Appl. No. 95/001,390, U.S. Appl. No. 95/000,589—Action closing prosecution for the U.S. Pat. No. 7,015,868. USPTO. Apr. 26, 2012.
U.S. Appl. No. 95/001,455, U.S. Appl. No. 95/000,595—Action closing prosecution for the U.S. Pat. No. 7,528,782. USPTO. Apr. 26, 2012.
FractalComs web—www.tsc.upc.es/fractalcoms/. Univeritat Politecnica de Catalunya.
Fractus web—www.fractus.com/main/fractus/corporate/. Fractus SA. Oct. 7, 2010.
GSM Technical specification and related materials. ETSI. Mar. 1, 1996.
Hagenuk mobile phone—Antenna photo—Technical specs—User manual. Hagenuk Telecom GmbH. Jan. 1, 1996.
IEEE Standard definitions of terms for antennas, IEEE Std. 145-1983. Antenna Standards Committee of the IEEE Antennas and Propagation Group, USA;. Jun. 22, 1983.
IEEE Standard Definitions of Terms for Antennas, IEEE Std. 145-1993 (1993). The Institute of Electrical and Electronics Engineers—Case 6:09-cv-00203-LED-JDL. Mar. 18, 1993.
IEEE Standard Dictionary of Electrical and Electronics Terms. IEEE Press (6th ed.). pp. 359, 688, and 878. Jan. 1, 1996.
IEEE Standard dictionary of electrical and electronics terms. IEEE Standard (6th ed.). pp. 229, 431, 595, 857. Jan. 1, 1996.
Int'l Electro-Technical Commission IEV No. 712-01-04—Electropedia : the world's online electrotechnical vocabulary. Electropedia—Commission Electrotechnique Internationale—http://www.electropedia.org. Apr. 1, 1998.
Letter to FCC—Application form 731 and Engineering Test Report by Nokia Mobile Phones for FCC ID: LJPNSW-6NX. M. Flom Associates. Apr. 1, 1999.
Merriam-Webster's Collegiate Dictionary (1993)—Declaration of J. Baxter—Exhibit CC. Merriam-Webster's. Case 6:09- cv-00203-LED-JDL. p. 863. Jan. 1, 1993.
Motorola 2000x pager. Motorola. Jun. 13, 1997.
Motorola Advisor Elite mobile phone—Antenna photos—User manual. Motorola. Jan. 1, 1997.
Motorola Advisor Gold FLX pager. Motorola, Inc. Aug. 1, 1996.
Motorola Bravo Plus pager. Motorola. Mar. 3, 1995.
Motorola P935. Motorola. Aug. 13, 1997.
Nokia 3210. Nokia. Jan. 1, 1999.
Nokia 3360. Nokia. May 3, 2001.
Nokia 8210. Nokia. Jan. 1, 1999.
Nokia 8260. Nokia. Sep. 8, 2000.
Nokia 8260—FCC ID GMLNSW-4DX. Nokia. Apr. 1, 1999.
Nokia 8265. Nokia. Mar. 4, 2002.
Nokia 8810. Nokia. Jan. 1, 1998.
Nokia 8850. Nokia. Jan. 1, 1999.
Nokia 8860—External photos—OET Exhibits list for FCC ID: LJPNSW-6NX. Federal Communications Commission—FCC. Jul. 8, 1999.
Nokia 8860—Internal photos—FCC ID: LJPNSW-6NX. Nokia and Federal Communications Commission ( FCC ). Jun. 24, 1999.
Research in Motion receives FCC approval for the new Inter(at)ctive Pager 850. PR Newswire. Jul. 12, 1999.
RIM 950 product—Photos of. RIM. Jun. 30, 1998.
Rockwell B-1B Lancer. <http://home.att.net/~jbaugher2/newb1_2.html>. Oct. 12, 2001.
Software—Box counting dimension [electronic]. http://www.sewanee.edu/Physics/PHYSICS123/BOX%20COUNTING%20DIMENSION.html. Apr. 1, 2002.
The American Century Dictionary. Oxford University Press. pp. 376, 448. Jan. 1, 1995.
The American Heritage College Dictionary. Houghton Mifflin Comp.—3d ed.—Case 6:09-cv-00203-LED-JDL. pp. 684 and 1060. Jan. 1, 1997.
The American Heritage Dictionary. Morris—William—(Second College edition)—Case 6:09-cv-00203-LED-JDL. pp. 817, 961. Jan. 1, 1982.
The American Heritage Dictionary. New College ed. (2nd ed. ). pp. 311, 1208. Jan. 1, 1982.
The handbook of antenna design—Index. Rudge, A. W. et al.—Peter Peregrinus—Institution of Electrical Engineers. vol. 1-3. Jan. 1, 1986.
The Random House Dictionary. Random House. pp. 1029, 1034. Jan. 1, 1984.
United States Table of Frequency allocations—The Radio Spectrum. United States Department of Commerce. Mar. 1, 1996.
User's guide. Nokia. Jun. 7, 1998.
User's Guide RIM 950 Wireless Handheld. RIM. Version 1.7. Jan. 1, 1997.
Webster's New Collegiate Dictionary. G & C Merriam Co.. pp. 60, 237, 746. Jan. 1, 1981.

* cited by examiner 6.1

6.2

6.3

6.4

6.5

6.6

6.7

6.8

6.9

7.1

7.2

7.3

7.4

7.5

7.6

7.7

7.8

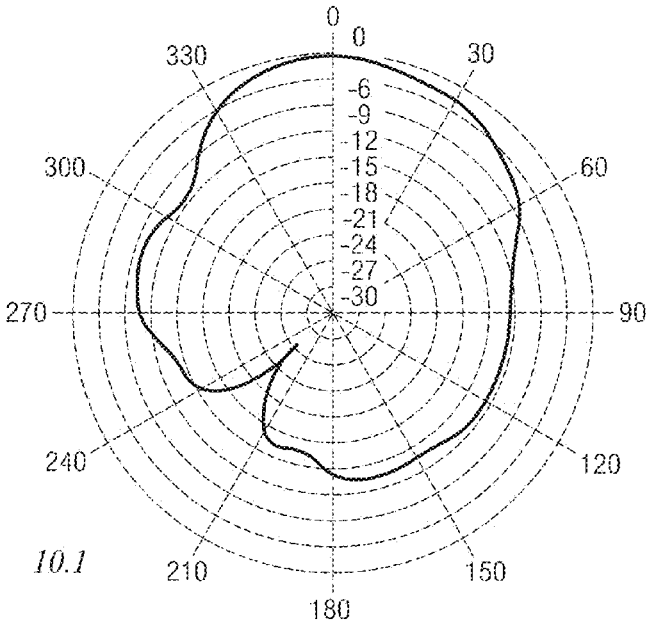
FIG. 10A
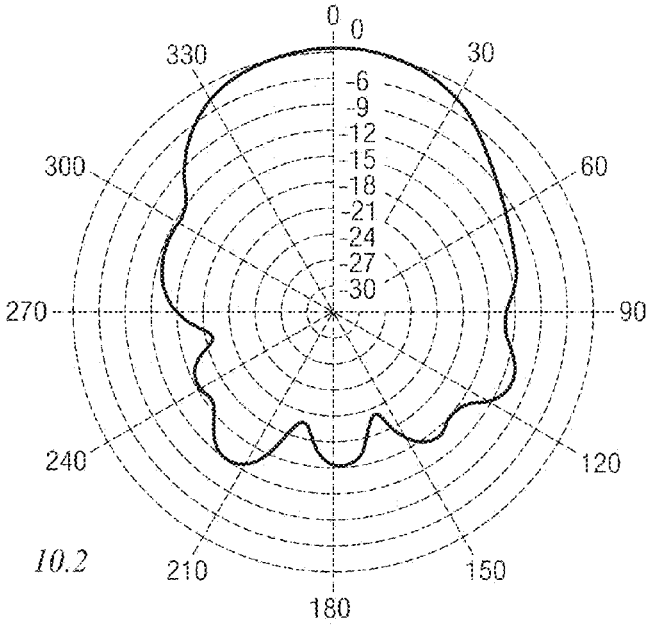

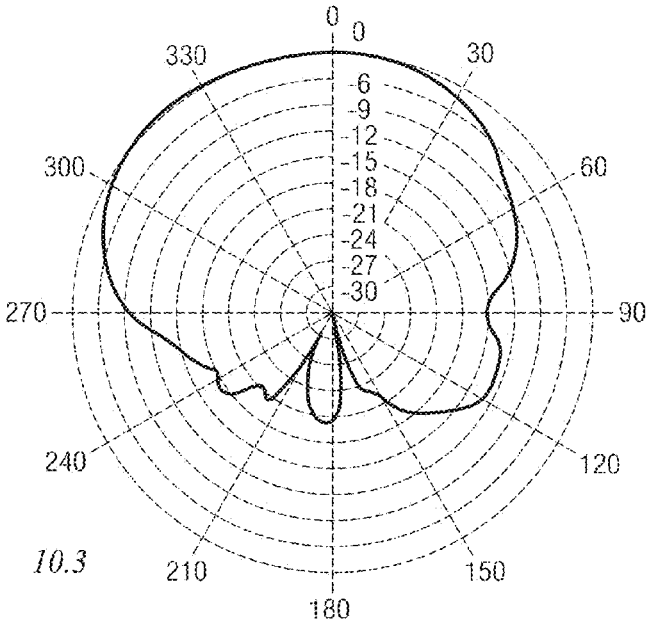
FIG. 10B
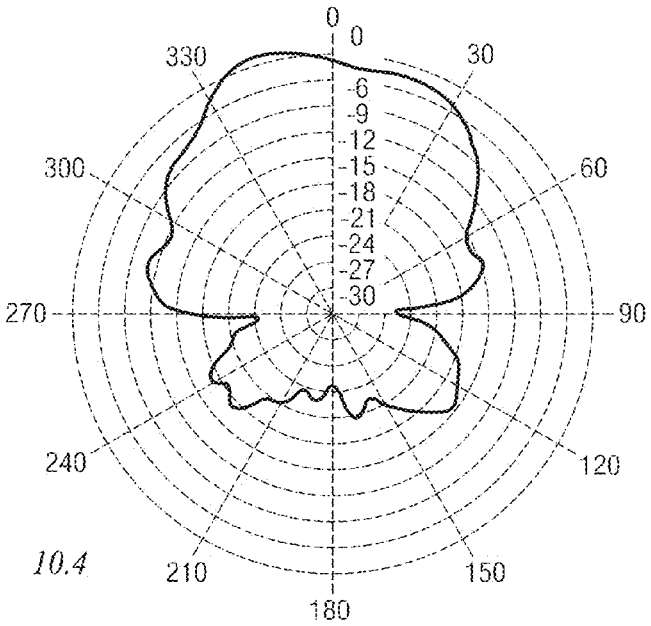

MULTILEVEL ANTENNAE

CROSS-REFERENCE TO RELATED APPLICATIONS

This application is a Continuation Application of U.S. patent application Ser. No. 13/732,743, filed Jan. 2, 2013, entitled MULTILEVEL ANTENNAE, which is a Continuation Application of U.S. patent Ser. No. 13/669,916, filed Nov. 6, 2012, entitled MULTILEVEL ANTENNAE, which is a Continuation Application of U.S. patent application Ser. No. 13/411,212, filed Mar. 2, 2012, entitled MULTILEVEL ANTENNAE, now U.S. Pat. No. 8,330,659, issued on Dec. 11, 2012, which is a Continuation Application of U.S. patent application Ser. No. 13/044,189, filed on Mar. 9, 2011, entitled MULTILEVEL ANTENNAE, now U.S. Pat. No. 8,154,463, issued on Apr. 10, 2012, which is a Continuation Application of U.S. patent application Ser. No. 12/400,888, filed on Mar. 10, 2009, entitled MULTILEVEL ANTENNAE, now U.S. Pat. No. 8,009,111, issued on Aug. 30, 2011, which is a Continuation Application of U.S. patent application Ser. No. 11/780,932, filed on Jul. 20, 2007, entitled MULTILEVEL ANTENNAE, now U.S. Pat. No. 7,528,782, issued on May 5, 2009, which is a Continuation Application of U.S. patent application Ser. No. 11/179,257, filed on Jul. 12, 2005, entitled MULTILEVEL ANTENNAE, now U.S. Pat. No. 7,397,431, issued on Jul. 8, 2008, which is a Continuation Application of U.S. patent application Ser. No. 11/102,390, filed on Apr. 8, 2005, entitled MULTILEVEL ANTENNAE, now U.S. Pat. No. 7,123,208, issued on Oct. 17, 2006, which is a Continuation Application of U.S. patent application Ser. No. 10/963,080, filed on Oct. 12, 2004, entitled MULTILEVEL ANTENNAE, now U.S. Pat. No. 7,015,868, issued on Mar. 21, 2006, which is a Continuation Application of U.S. patent application Ser. No. 10/102,568, filed Mar. 18, 2002, entitled MULTILEVEL ANTENNAE, now abandoned, which is a National Phase Application of PCT/ES99/00296, filed on Sep. 20, 1999, entitled MULTILEVEL ANTENNAE, the specifications of each of which are incorporated herein by reference.

OBJECT OF THE INVENTION

The present invention relates to antennae formed by sets of similar geometrical elements (polygons, polyhedrons electro magnetically coupled and grouped such that in the antenna structure may be distinguished each of the basic elements which form it.

More specifically, it relates to a specific geometrical design of said antennae by which two main advantages are provided: the antenna may operate simultaneously in several frequencies and/or its size can be substantially reduced.

The scope of application of the present invention is mainly within the field of telecommunications, and more specifically in the field of radio-communication.

BACKGROUND

Antennae were first developed towards the end of the past century, when James C. Maxwell in 1864 postulated the fundamental laws of electromagnetism. Heinrich Hertz may be attributed in 1886 with the invention of the first antenna by which transmission in air of electromagnetic waves was demonstrated. In the mid forties were shown the fundamental restrictions of antennae as regards the reduction of their size relative to wavelength, and at the start of the sixties the first frequency-independent antennae appeared. At that time helixes, spirals, logoperiodic groupings, cones and structures defined solely by angles were proposed for construction of wide band antennae.

In 1995 were introduced the fractal or multifractal type antennae (U.S. Pat. No. 9,501,019), which due to their geometry presented a multifrequency behavior and in certain cases a small size. Later were introduced multitriangular antennae (U.S. Pat. No. 9,800,954) which operated simultaneously in bands GSM 900 and GSM 1800.

The antennae described in the present patent have their origin in fractal and multitriangular type antennae, but solve several problems of a practical nature which limit the behavior of said antennae and reduce their applicability in real environments.

From a scientific standpoint strictly fractal antennae are impossible, as fractal objects are a mathematical abstraction which include an infinite number of elements. It is possible to generate antennae with a form based on said fractal objects, incorporating a finite number of iterations. The performance of such antennae is limited to the specific geometry of each one. For example, the position of the bands and their relative spacing is related to fractal geometry and it is not always possible, viable or economic to design the antennae maintaining its fractal appearance and at the same time placing the bands at the correct area of the radioelectric spectrum. To begin, truncation implies a clear example of the limitations brought about by using a real fractal type antenna which attempts to approximate the theoretical behavior of an ideal fractal antenna. Said effect breaks the behavior of the ideal fractal structure in the lower band, displacing it from its theoretical position relative to the other bands and in short requiring a too large size for the antenna which hinders practical applications.

In addition to such practical problems, it is not always possible to alter the fractal structure to present the level of impedance of radiation diagram which is suited to the requirements of each application. Due to these reasons, it is often necessary to leave the fractal geometry and resort to other types of geometries which offer a greater flexibility as regards the position of frequency bands of the antennae, adaptation levels and impedances, polarization and radiation diagrams.

Multitriangular structures (U.S. Pat. No. 9,800,954) were an example of non-fractal structures with a geometry designed such that the antennae could be used in base stations of GSM and DCS cellular telephony. Antennae described in said patent consisted of three triangles joined only at their vertices, of a size adequate for use in bands 890 MHz-960 MHz and 1710 MHz-1880 MHz. This was a specific solution for a specific environment which did not provide the flexibility and versatility required to deal with other antennae designs for other environments.

Multilevel antennae solve the operational limitations of fractal and multitriangular antennae. Their geometry is much more flexible, rich and varied, allowing operation of the antenna from two to many more bands, as well as providing a greater versatility as regards diagrams, band positions and impedance levels, to name a few examples. Although they are not fractal, multilevel antennae are characterized in that they comprise a number of elements which may be distinguished in the overall structure. Precisely because they clearly show several levels of detail (that of the overall structure and that of the individual elements which make it up), antennae provide a multiband behavior and/or a small size. The origin of their name also lies in said property.

The present invention consists of an antenna whose radiating element is characterized by its geometrical shape, which basically comprises several polygons or polyhedrons of the same type. That is, it comprises for example triangles, squares, pentagons, hexagons or even circles and ellipses as a limiting case of a polygon with a large number of sides, as well as tetrahedra, hexahedra, prisms, dodecahedra, etc. coupled to each other electrically (either through at least one point of contact or through a small separation providing a capacitive coupling) and grouped in structures of a higher level such that in the body of the antenna can be identified the polygonal or polyhedral elements which it comprises. In turn, structures generated in this manner can be grouped in higher order structures in a manner similar to the basic elements, and so on until reaching as many levels as the antenna designer desires.

Its designation as multilevel antenna is precisely due to the fact that in the body of the antenna can be identified at least two levels of detail: that of the overall structure and that of the majority of the elements (polygons or polyhedrons) which make it up. This is achieved by ensuring that the area of contact or intersection (if it exists) between the majority of the elements forming the antenna is only a fraction of the perimeter or surrounding area of said polygons or polyhedrons.

A particular property of multilevel antennae is that their radioelectric behavior can be similar in several frequency bands. Antenna input parameters (impedance and radiation diagram) remain similar for several frequency bands (that is, the antenna has the same level of adaptation or standing wave relationship in each different band), and often the antenna presents almost identical radiation diagrams at different frequencies. This is due precisely to the multilevel structure of the antenna, that is, to the fact that it remains possible to identify in the antenna the majority of basic elements (same type polygons or polyhedrons) which make it up. The number of frequency bands is proportional to the number of scales or sizes of the polygonal elements or similar sets in which they are grouped contained in the geometry of the main radiating element.

In addition to their multiband behavior, multilevel structure antennae usually have a smaller than usual size as compared to other antennae of a simpler structure. (Such as those consisting of a single polygon or polyhedron). This is because the path followed by the electric current on the multilevel structure is longer and more winding than in a simple geometry, due to the empty spaces between the various polygon or polyhedron elements. Said empty spaces force a given path for the current (which must circumvent said spaces) which travels a greater distance and therefore resonates at a lower frequency. Additionally, its edge-rich and discontinuity-rich structure simplifies the radiation process, relatively increasing the radiation resistance of the antenna and reducing the quality factor Q, i.e., increasing its bandwidth.

Thus, the main characteristic of multilevel antennae are the following:

- A multilevel geometry comprising polygon or polyhedron of the same class, electromagnetically coupled and grouped to form a larger structure. In multilevel geometry most of these elements are clearly visible as their area of contact, intersection or interconnection (if these exist) with other elements is always less than 50% of their perimeter.
- The radioelectric behavior resulting from the geometry: multilevel antennae can present a multiband behavior (identical or similar for several frequency bands) and/or operate at a reduced frequency, which allows to reduce their size.

In specialized literature it is already possible to find descriptions of certain antennae designs which allow to cover a few bands. However, in these designs the multiband behavior is achieved by grouping several single band antennae or by incorporating reactive elements in the antennae (concentrated elements as inductors or capacitors or their integrated versions such as posts or notches) which force the apparition of new resonance frequencies. Multilevel antennae on the contrary base their behavior on their particular geometry, offering a greater flexibility to the antenna designer as to the number of bands (proportional to the number of levels of detail), position, relative spacing and width, and thereby offer better and more varied characteristics for the final product.

A multilevel structure can be used in any known antenna configuration. As a nonlimiting example can be cited: dipoles, monopoles, patch or microstrip antennae, coplanar antennae, reflector antennae, wound antennae or even antenna arrays. Manufacturing techniques are also not characteristic of multilevel antennae as the best suited technique may be used for each structure or application. For example: printing on dielectric substrate by photolithography (printed circuit technique); dieing on metal plate, repulsion on dielectric, etc.

Publication WO 97/06578 discloses a fractal antenna, which has nothing to do with a multilevel antenna being both geometries essentially different.

BRIEF DESCRIPTION OF THE DRAWINGS

Further characteristics and advantages of the invention will become apparent in view of the detailed description which follows of a preferred embodiment of the invention given for purposes of illustration only and in no way meant as a definition of the limits of the invention, made with reference to the accompanying drawings, in which:

FIGS. 10*a* and 10*b* show radiation diagrams for the multilevel antenna of FIG. 8: horizontal and vertical planes;

DETAILED DESCRIPTION

In the detailed description which follows of a preferred embodiment of the present invention permanent reference is made to the figures of the drawings, where the same numerals refer to the identical or similar parts.

The present invention relates to an antenna which includes at least one construction element in a multilevel structure form. A multilevel structure is characterized in that it is formed by gathering several polygon or polyhedron of the same type (for example triangles, parallelepipeds, pentagons, hexagons, etc., even circles or ellipses as special limiting cases of a polygon with a large number of sides, as well as tetrahedra, hexahedra, prisms, dodecahedra, etc. coupled to each other electromagnetically, whether by proximity or by direct contact between elements. A multilevel structure or figure is distinguished from another conventional figure precisely by the interconnection (if it exists) between its component elements (the polygon or polyhedron). In a multilevel structure at least 75% of its component elements have more than 50% of their perimeter (for polygons) not in contact with any of the other elements of the structure. Thus, in a multilevel structure it is easy to identify geometrically and individually distinguish most of its basic component elements, presenting at least two levels of detail: that of the overall structure and that of the polygon or polyhedron elements which form it. Its name is precisely due to this characteristic and from the fact that the polygon or polyhedron can be included in a great variety of sizes. Additionally, several multilevel structures may be grouped and coupled electromagnetically to each other to form higher level structures. In a multilevel structure all the component elements are polygons with the same number of sides or polyhedron with the same number of faces. Naturally, this property is broken when several multilevel structures of different natures are grouped and electromagnetically coupled to form meta-structures of a higher level.

In this manner, in FIGS. 1 to 7 are shown a few specific examples of multilevel structures.

Figure 1:
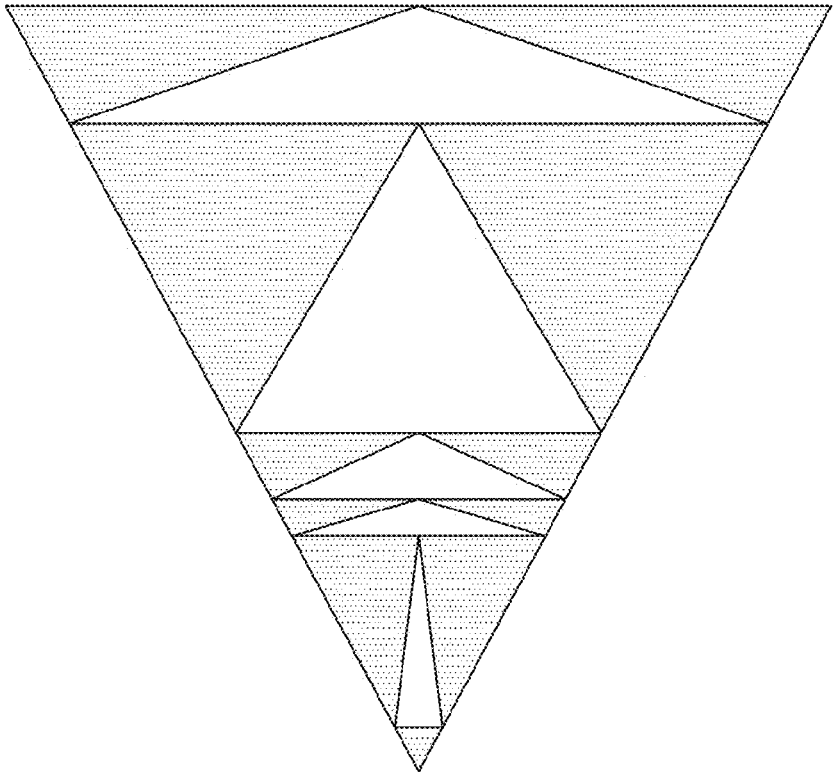
FIG. 1 shows a specific example of a multilevel element comprising only triangular polygons.

FIG. 1 shows a multilevel element exclusively consisting of triangles of various sizes and shapes. Note that in this particular case each and every one of the elements (triangles, in black) can be distinguished, as the triangles only overlap in a small area of their perimeter, in this case at their vertices.

Figure 2:
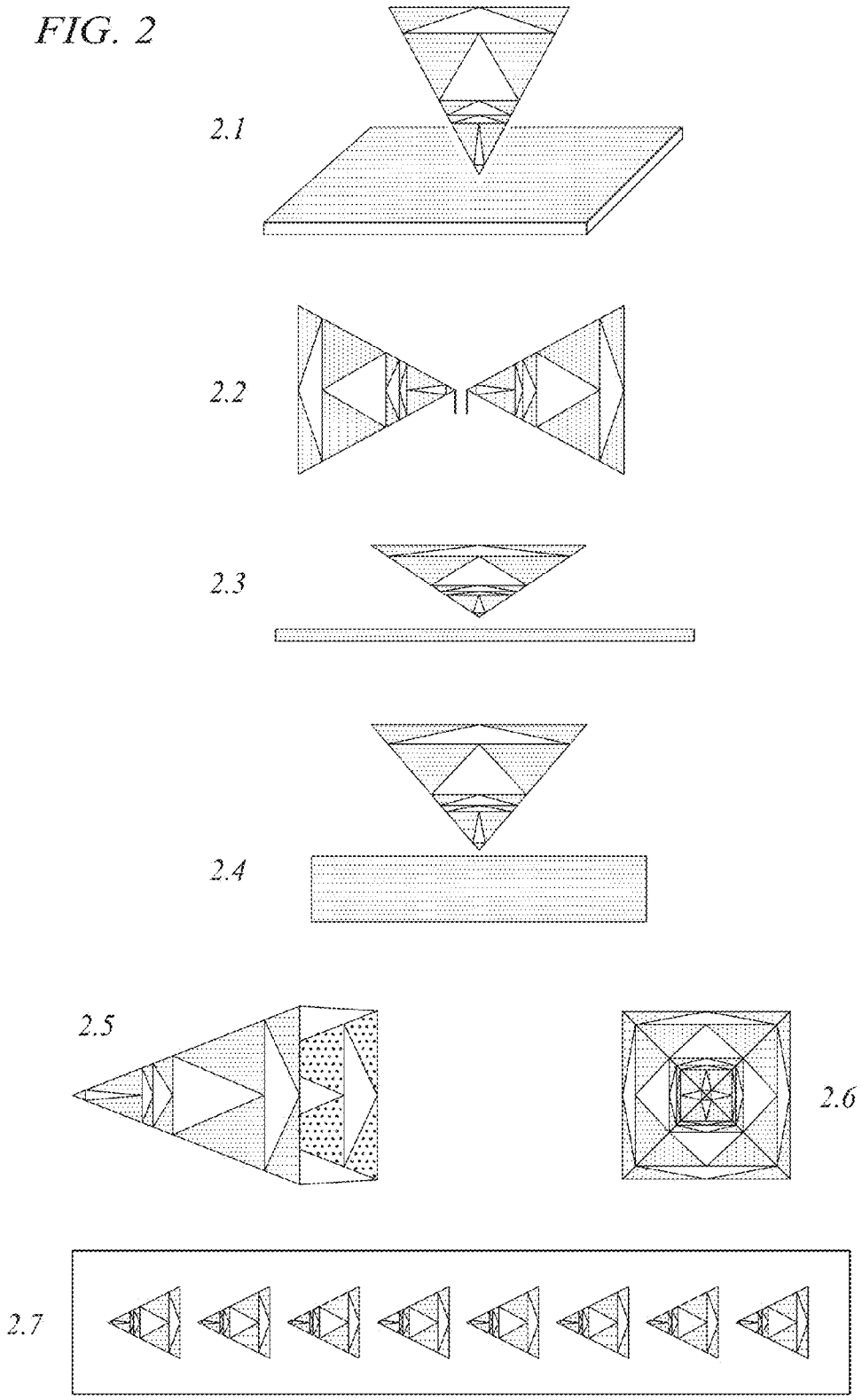
FIG. 2 shows examples of assemblies of multilevel antennae in several configurations: monopole (2.1), dipole (2.2), patch (2.3), coplanar antennae (2.4), horn (2.5-2.6) and array (2.7)

FIG. 2 shows examples of assemblies of multilevel antennae in various configurations: monopole (21), dipole (22), patch (23), coplanar antennae (24), coil in a side view (25) and front view (26) and array (27). With this it should be remarked that regardless of its configuration the multilevel antenna is different from other antennae in the geometry of its characteristic radiant element.

Figure 3:
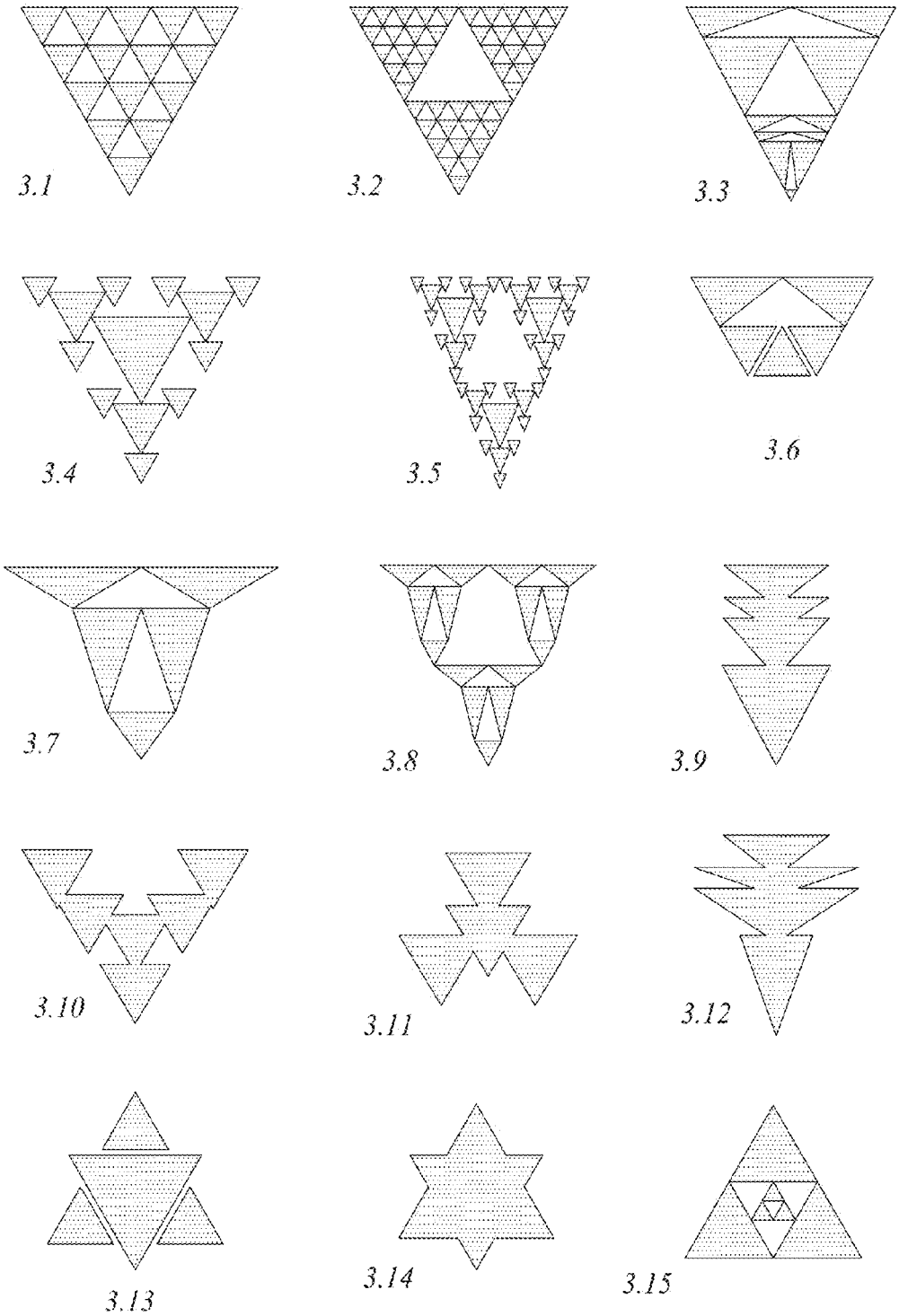
FIG. 3 shows examples of multilevel structures based on triangles.

FIG. 3 shows further examples of multilevel structures (3.1-3.15) with a triangular origin, all comprised of triangles. Note that case (3.14) is an evolution of case (3.13); despite the contact between the 4 triangles, 75% of the elements (three triangles, except the central one) have more than 50% of the perimeter free.

Figure 4:
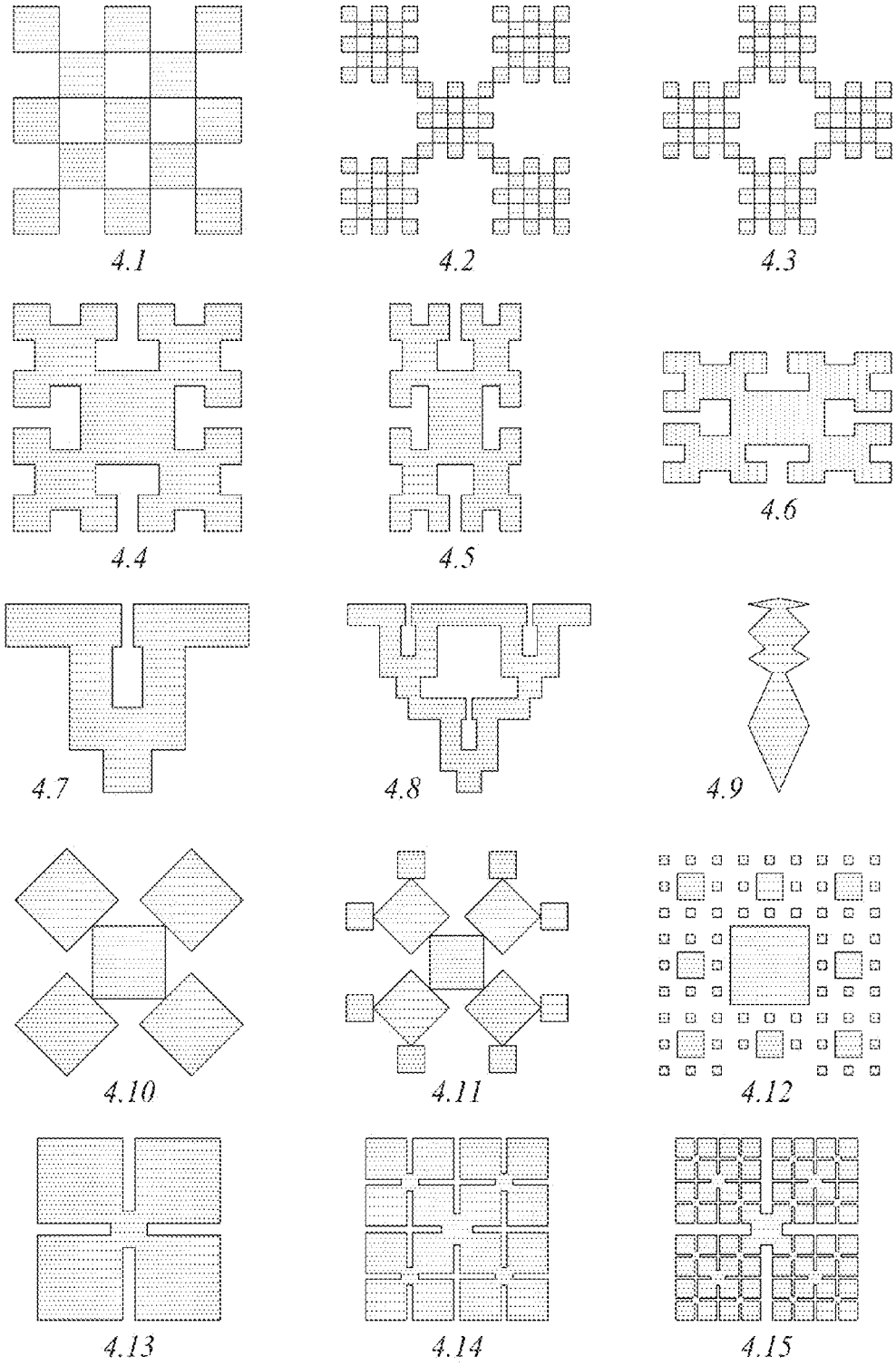
FIG. 4 shows examples of multilevel structures based on parallelepipeds.

FIG. 4 describes multilevel structures (4.1-4.14) formed by parallelepipeds (squares, rectangles, rhombi . . . ). Note that the component elements are always individually identifiable (at least most of them are). In case (4.12), specifically, said elements have 100% of their perimeter free, without there being any physical connection between them (coupling is achieved by proximity due to the mutual capacitance between elements).

Figure 5:
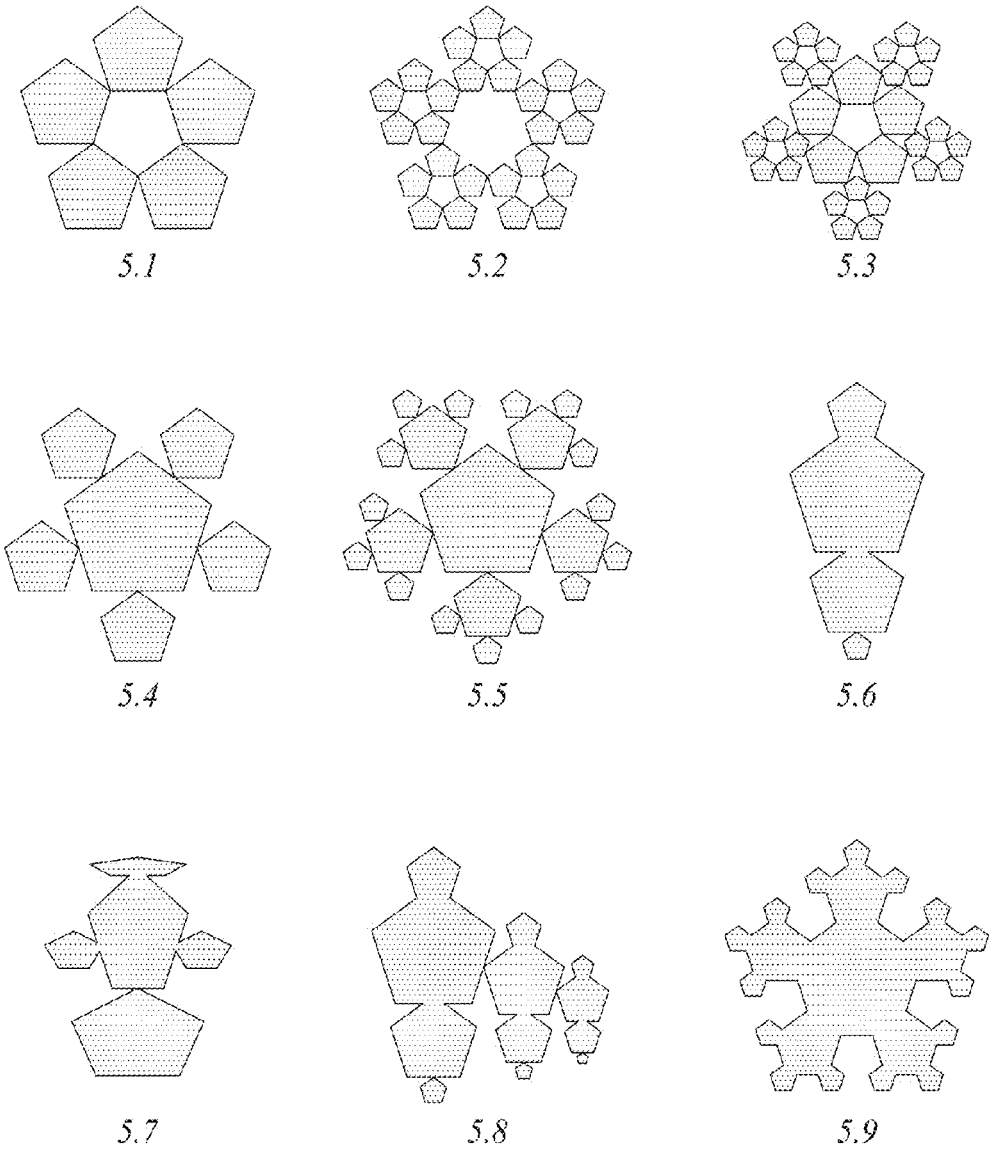
FIG. 5 examples of multilevel structures based on pentagons.
Figure 6:
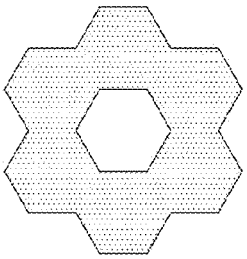
FIG. 6 shows of multilevel structures based on hexagons.
Figure 6:
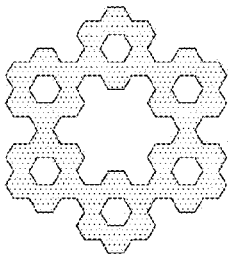
Figure 6:
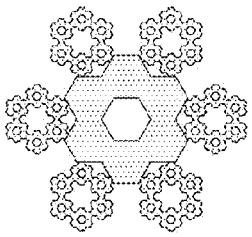
Figure 6:
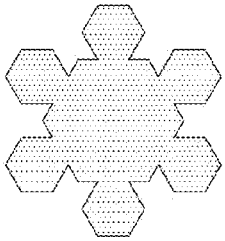
Figure 6:
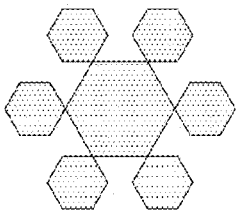
Figure 6:
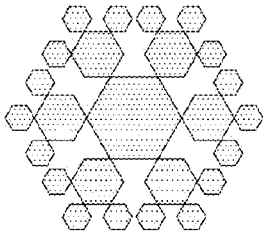
Figure 6:
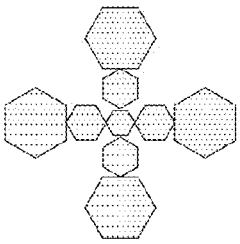
Figure 6:
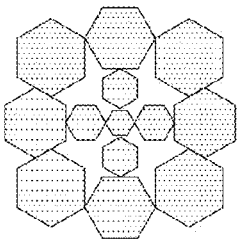
Figure 6:
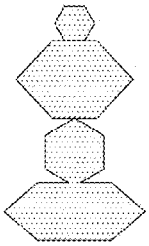
Figure 7:
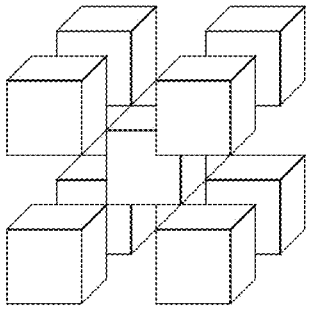
FIG. 7 shows of multilevel structures based on polyhedrons.
Figure 7:
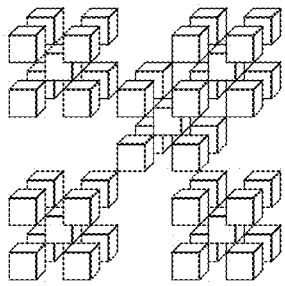
Figure 7:
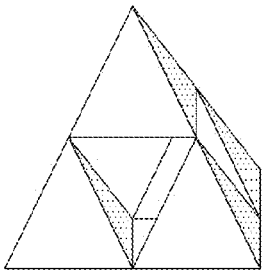
Figure 7:
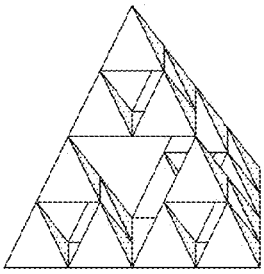
Figure 7:
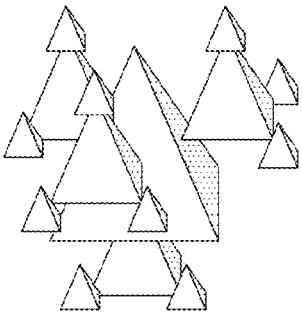
Figure 7:
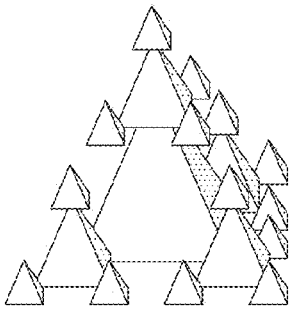
Figure 7:
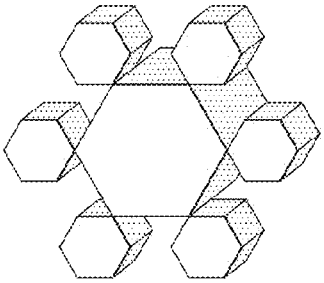
Figure 7:
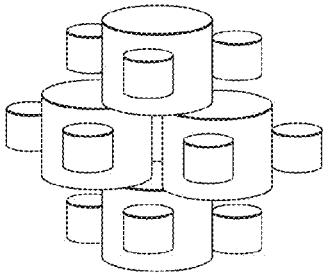

FIGS. 5, 6 and 7 show non-limiting examples of other multilevel structures based on pentagons, hexagons and polyhedron respectively.

It should be remarked that the difference between multilevel antennae and other existing antennae lies in the particular geometry, not in their configuration as an antenna or in the materials used for construction. Thus, the multilevel structure may be used with any known antenna configuration, such as for example and in a non-limiting manner: dipoles, monopoles, patch or microstrip antennae, coplanar antennae, reflector antennae, wound antennae or even in arrays. In general, the multilevel structure forms part of the radiative element characteristic of said configurations, such as the arm, the mass plane or both in a monopole, an arm or both in a dipole, the patch or printed element in a microstrip, patch or coplanar antenna; the reflector for an reflector antenna, or the conical section or even antenna walls in a horn type antenna. It is even possible to use a spiral type antenna configuration in which the geometry of the loop or loops is the outer perimeter of a multilevel structure. In all, the difference between a multilevel antenna and a conventional one lies in the geometry of the radiative element or one of its components, and not in its specific configuration.

As regards construction materials and technology, the implementation of multilevel antennae is not limited to any of these in particular and any of the existing or future techniques may be employed as considered best suited for each application, as the essence of the invention is found in the geometry used in the multilevel structure and not in the specific configuration. Thus, the multilevel structure may for example be formed by sheets, parts of conducting or superconducting material, by printing in dielectric substrates (rigid or flexible) with a metallic coating as with printed circuits, by imbrications of several dielectric materials which form the multilevel structure, etc. always depending on the specific requirements of each case and application. Once the multilevel structure is formed the implementation of the antenna depends on the chosen configuration (monopole, dipole, patch, horn, reflector . . . ). For monopole, spiral, dipole and patch antennae the multisimilar structure is implemented on a metal support (a simple procedure involves applying a photolithography process to a virgin printed circuit dielectric plate) and the structure is mounted on a standard microwave connector, which for the monopole or patch cases is in turn connected to a mass plane (typically a metal plate or case) as for any conventional antenna. For the dipole case two identical multilevel structures form the two arms of the antenna; in an opening antenna the multilevel geometry may be part of the metal wall of a horn or its cross section, and finally for a reflector the multisimilar element or a set of these may form or cover the reflector.

The most relevant properties of the multilevel antennae are mainly due to their geometry and are as follows: the possibility of simultaneous operation in several frequency bands in a similar manner (similar impedance and radiation diagrams) and the possibility of reducing their size compared to other conventional antennae based exclusively on a single polygon or polyhedron. Such properties are particularly relevant in the field of communication systems. Simultaneous operation in several freq bands allows a single multilevel antenna to integrate several communication systems, instead of assigning an antenna for each system or service as is conventional. Size reduction is particularly useful when the antenna must be concealed due to its visual impact in the urban or rural landscape, or to its unaesthetic or unaerodynamic effect when incorporated on a vehicle or a portable telecommunication device.

An example of the advantages obtained from the use of a multiband antenna in a real environment is the multilevel antenna AM1, described further below, used for GSM and DCS environments. These antennae are designed to meet radioelectric specifications in both cell phone systems. Using a single GSM and DCS multilevel antenna for both bands (900 MHz and 1800 MHz) cell telephony operators can reduce costs and environmental impact of their station networks while increasing the number of users' (customers) supported by the network.

It becomes particularly relevant to differentiate multilevel antennae from fractal antennae. The latter are based on fractal geometry, which is based on abstract mathematical concepts which are difficult to implement in practice. Specialized scientific literature usually defines as fractal those geometrical objects with a non-integral Haussdorf dimension. This means that fractal objects exist only as an abstraction or a concept, but that said geometries are unthinkable (in a strict sense) for a tangible object or drawing, although it is true that antennae based on this geometry have been developed and widely described in the scientific literature, despite their geometry not being strictly fractal in scientific terms. Nevertheless some of these antennae provide a multiband behavior (their impedance and radiation diagram remains practically constant for several freq bands), they do not on their own offer all of the behavior required of an antenna for applicability in a practical environment. Thus, Sierpinski's antenna for example has a multiband behavior with N bands spaced by a factor of 2, and although with this spacing one could conceive its use for communications networks GSM 900 MHz and GSM 1800 MHz (or DCS), its unsuitable radiation diagram and size for these frequencies prevent a practical use in a real environment. In short, to obtain an antenna which in addition to providing a multiband behavior meets all of the specifications demanded for each specific application it is almost always necessary to abandon the fractal geometry and resort for example to multilevel geometry antennae. As an example, none of the structures described in FIGS. 1, 3, 4, 5 and 6 are fractal. Their Hausdorff dimension is equal to 2 for all, which is the same as their topological dimension. Similarly, none of the multilevel structures of FIG. 7 are fractal, with their Hausdorff dimension equal to 3, as their topological dimension.

In any case multilevel structures should not be confused with arrays of antennae. Although it is true that an array is formed by sets of identical antennae, in these the elements are electromagnetically decoupled, exactly the opposite of what is intended in multilevel antennae. In an array each element is powered independently whether by specific signal transmitters or receivers for each element, or by a signal distribution network, while in a multilevel antenna the structure is excited in a few of its elements and the remaining ones are coupled electromagnetically or by direct contact (in a region which does not exceed 50% of the perimeter or surface of adjacent elements). In an array is sought an increase in the directivity of an individual antenna o forming a diagram for a specific application; in a multilevel antenna the object is to obtain a multiband behavior or a reduced size of the antenna, which implies a completely different application from arrays.

Below are described, for purposes of illustration only, two non-limiting examples of operational modes for Multilevel Antennae (AM1 and AM2) for specific environments and applications.

Mode AM1

Figure 8:
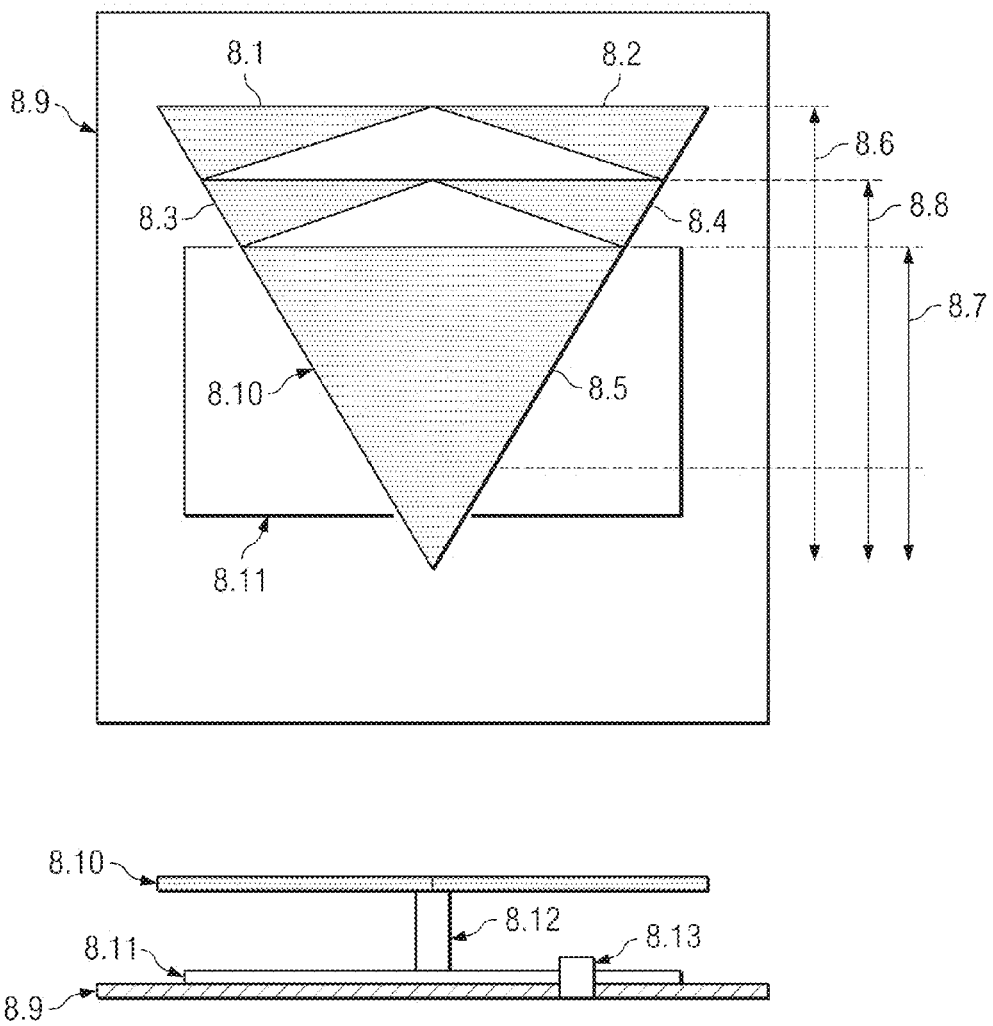
FIG. 8 shows an example of a specific operational mode for a multilevel antenna in a patch configuration for base stations of GSM (900 MHz) and DCS (1800 MHz) cellular telephony.

This model consists of a multilevel patch type antenna, shown in FIG. 8, which operates simultaneously in bands GSM 900 (890 MHz-960 MHz) and GSM 1800 (1710 MHz-1880 MHz) and provides a sector radiation diagram in a horizontal plane. The antenna is conceived mainly (although not limited to) for use in base stations of GSM 900 and 1800 mobile telephony.

The multilevel structure (8.10), or antenna patch, consists of a printed copper sheet on a standard fiberglass printed circuit board. The multilevel geometry consists of 5 triangles (8.1-8.5) joined at their vertices, as shown in FIG. 8, with an external perimeter shaped as an equilateral triangle of height 13.9 cm (8.6). The bottom triangle has a height (8.7) of 8.2 cm and together with the two adjacent triangles form a structure with a triangular perimeter of height 10.7 cm (8.8).

The multilevel patch (8.10) is mounted parallel to an earth plane (8.9) of rectangular aluminum of 22.times.18.5 cm. The separation between the patch and the earth plane is 3.3 cm, which is maintained by a pair of dielectric spacers which act as support (8.12).

Connection to the antenna is at two points of the multilevel structure, one for each operational band (GSM 900 and GSM 1800). Excitation is achieved by a vertical metal post perpendicular to the mass plane and to the multilevel structure, capacitively finished by a metal sheet which is electrically coupled by proximity (capacitive effect) to the patch. This is a standard system in patch configuration antennae, by which the object is to compensate the inductive effect of the post with the capacitive effect of its finish.

At the base of the excitation post is connected the circuit which interconnects the elements and the port of access to the antenna or connector (8.13). Said interconnection circuit may be formed with microstrip, coaxial or strip-line technology to name a few examples, and incorporates conventional adaptation networks which transform the impedance measured at the base of the post to so ohms (with a typical tolerance in the standing wave relation (SWR) usual for these application under 1.5) required at the input/output antenna connector. Said connector is generally of the type N or SMA for microcell base station applications.

In addition to adapting the impedance and providing an interconnection with the radiating element the interconnection network (8.11) may include a diplexor allowing the antenna to be presented in a two connector configuration (one for each band) or in a single connector for both bands.

For a double connector configuration in order to increase the insulation between the GSM 900 and GSM 1800 (DCS) terminals, the base of the DCS and excitation post may be connected to a parallel stub of electrical length equal to half a wavelength, in the central DCS wavelength, and finishing in an open circuit. Similarly, at the base of the GSM 900 lead can be connected a parallel stub ending in an open circuit of electrical length slightly greater than one quarter of the wavelength at the central wavelength of the GSM band. Said stub introduces a capacitance in the base of the connection which may be regulated to compensate the residual inductive effect of the post. Furthermore, said stub presents a very low impedance in the DCS band which aids in the insulation between connectors in said band.

Figure 9:
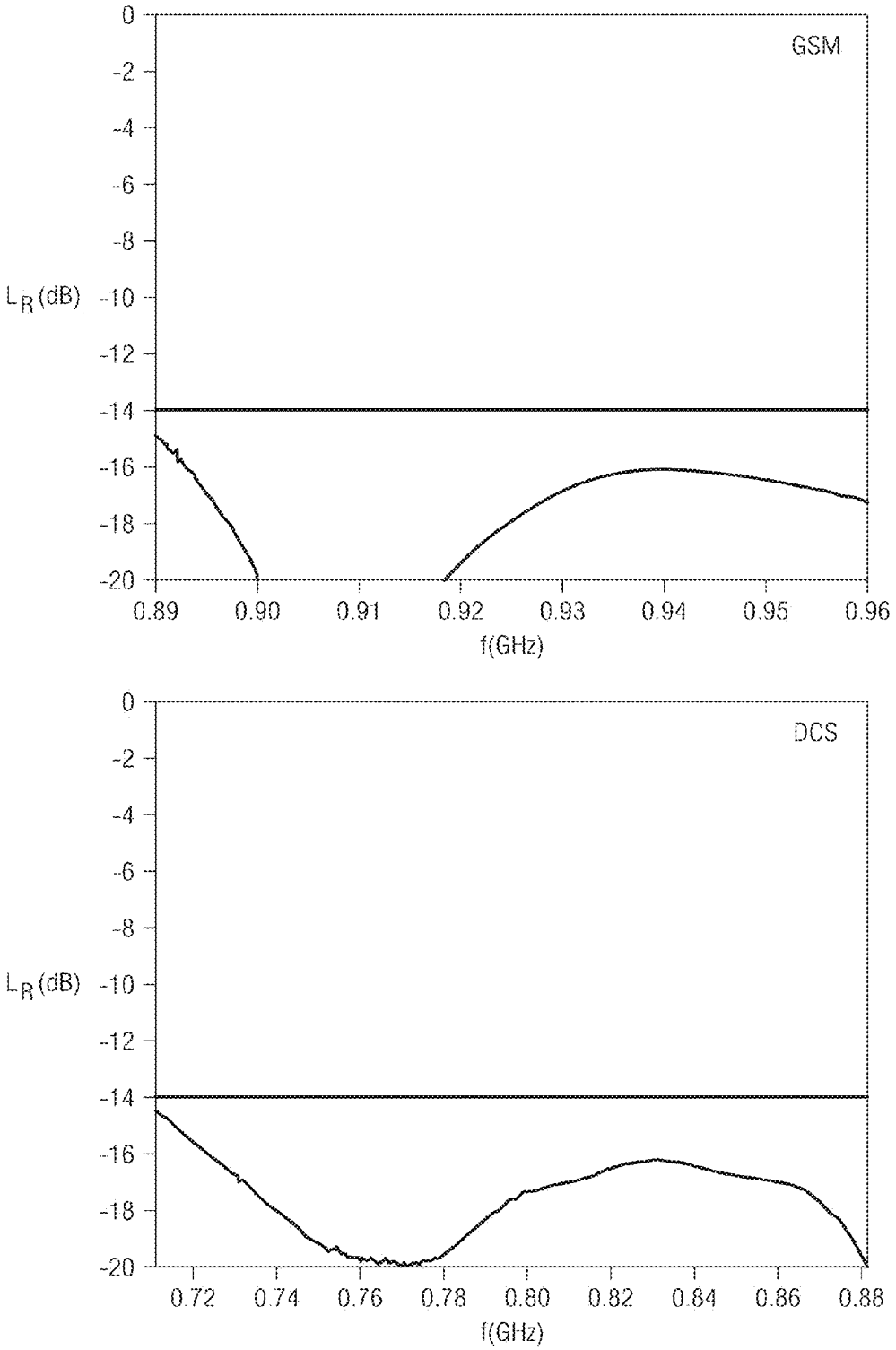
FIG. 9 shows input parameters (return loss on 50 ohms) for the multilevel antenna described in the previous figure.

In FIGS. 9, 10*a* and 10*b* are shown the typical radioelectric behavior for this specific embodiment of a dual multilevel antenna.

FIG. 9 shows return losses ($L_r$) in GSM (9.1) and DCS (9.2), typically under −14 dB (which is equivalent to SWR<1.5), so that the antenna is well adapted in both operation bands (890 MHz-960 MHz and 1710 MHz-1880 MHz).

Radiation diagrams in the vertical (10.1 and 10.3) and the horizontal plane (10.2 and 10.4) for both bands are shown in FIG. 10. It can be seen clearly that both antennae radiate using a main lobe in the direction perpendicular to the antenna (10.1 and 10.3), and that in the horizontal plane (10.2 and 10.4) both diagrams are sectorial with a typical beam width at 3 dB of 65°. Typical directivity (d) in both bands is d>7 Db.

Mode AM2

Figure 11:
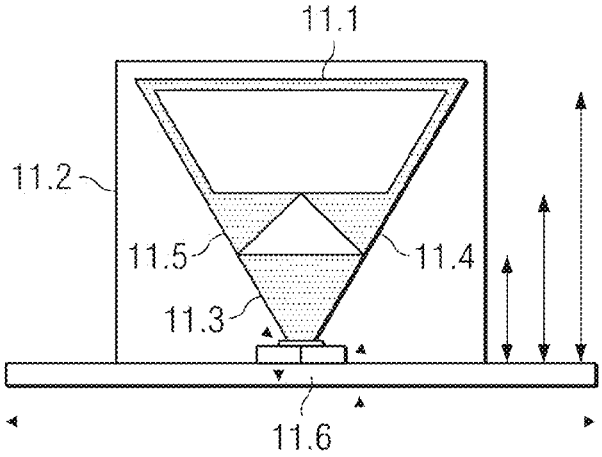
FIG. 11 shows an example of a specific operation mode for a multilevel antenna in a monopole construction for indoors wireless communication systems or in radio-accessed local network environments.

This model consists of a multilevel antenna in a monopole configuration, shown in FIG. 11, for wireless communications systems for indoors or in local access environments using radio.

The antenna operates in a similar manner simultaneously for the bands 1880 MHz-1930 MHz and 3400 MHz-3600 MHz, such as in installations with the system DECT. The multilevel structure is formed by three or five triangles (see FIGS. 11 and 3.6) to which may be added an inductive loop (11.1). The antenna presents an omnidirectional radiation diagram in the horizontal plane and is conceived mainly for (but not limited to) mounting on roof or floor.

The multilevel structure is printed on a Rogers® RO4003 dielectric substrate (11.2) of 5.5 cm width, 4.9 cm height and 0.8 mm thickness, and with a dielectric permittivity equal to 3.38. The multilevel element consists of three triangles (11.3-11.5) joined at the vertex; the bottom triangle (11.3) has a height of 1.82 cm, while the multilevel structure has a total height of 2.72 cm. In order to reduce the total size f the antenna the multilevel element is added an inductive loop (11.1) at its top with a trapezoidal shape in this specific application, so that the total size of the radiating element is 4.5 cm.

The multilevel structure is mounted perpendicularly on a metallic (such as aluminum) earth plane (11.6) with a square or circular shape about 18 cm in length or diameter. The bottom vertex of the element is placed on the center of the mass plane and forms the excitation point for the antenna. At this point is connected the interconnection network which links the radiating element to the input/output connector. Said interconnection network may be implemented as a microstrip, strip-line or coaxial technology to name a few examples. In this specific example the microstrip configuration was used. In addition to the interconnection between radiating element and connector, the network can be used as an impedance transformer, adapting the impedance at the vertex of the multilevel element to the 50 Ohms ($L_r$<−14 dB, SWR<1.5) required at the input/output connector.

Figure 12:
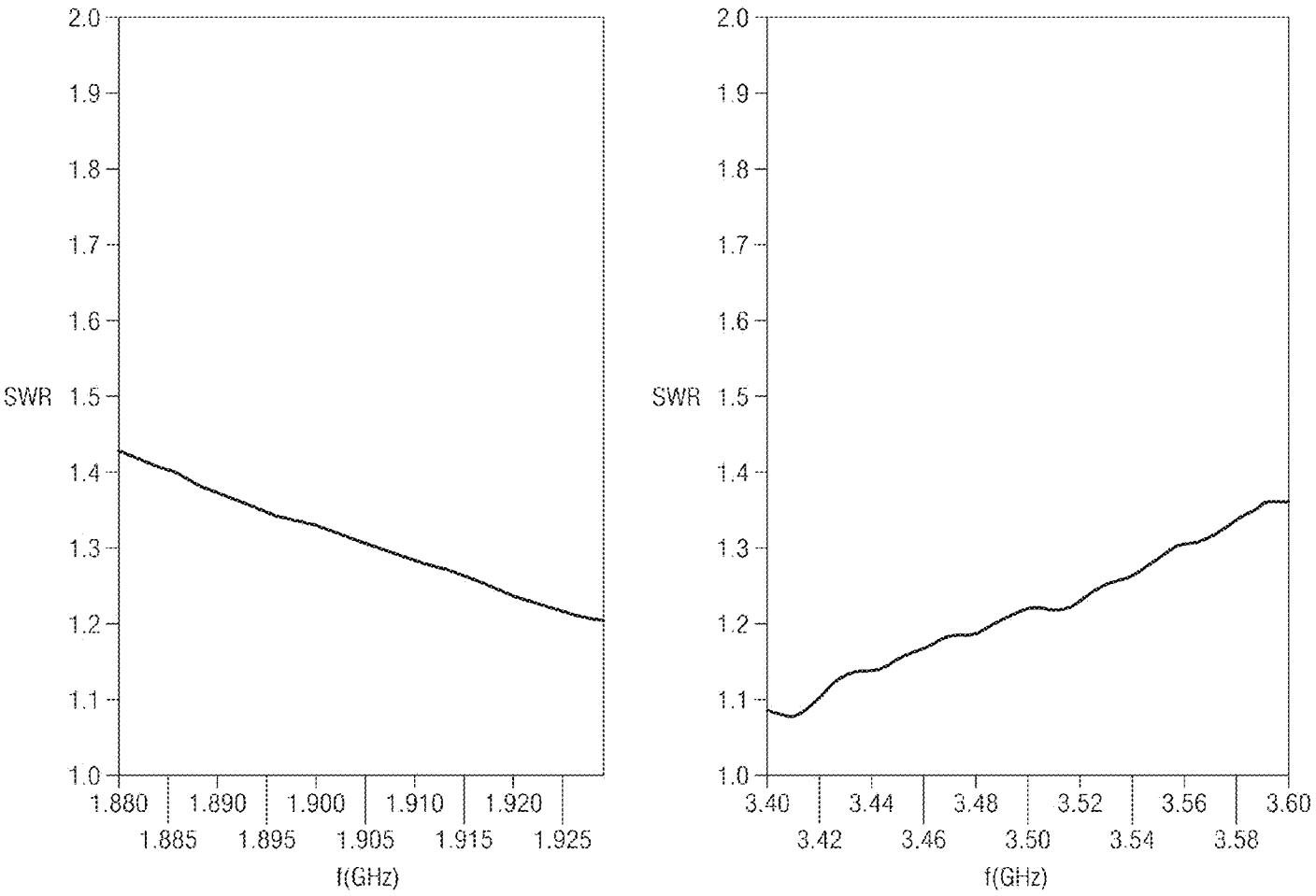
FIG. 12 shows input parameters (return loss on so ohms) for the multilevel antenna of the previous figure.
Figure 13A:
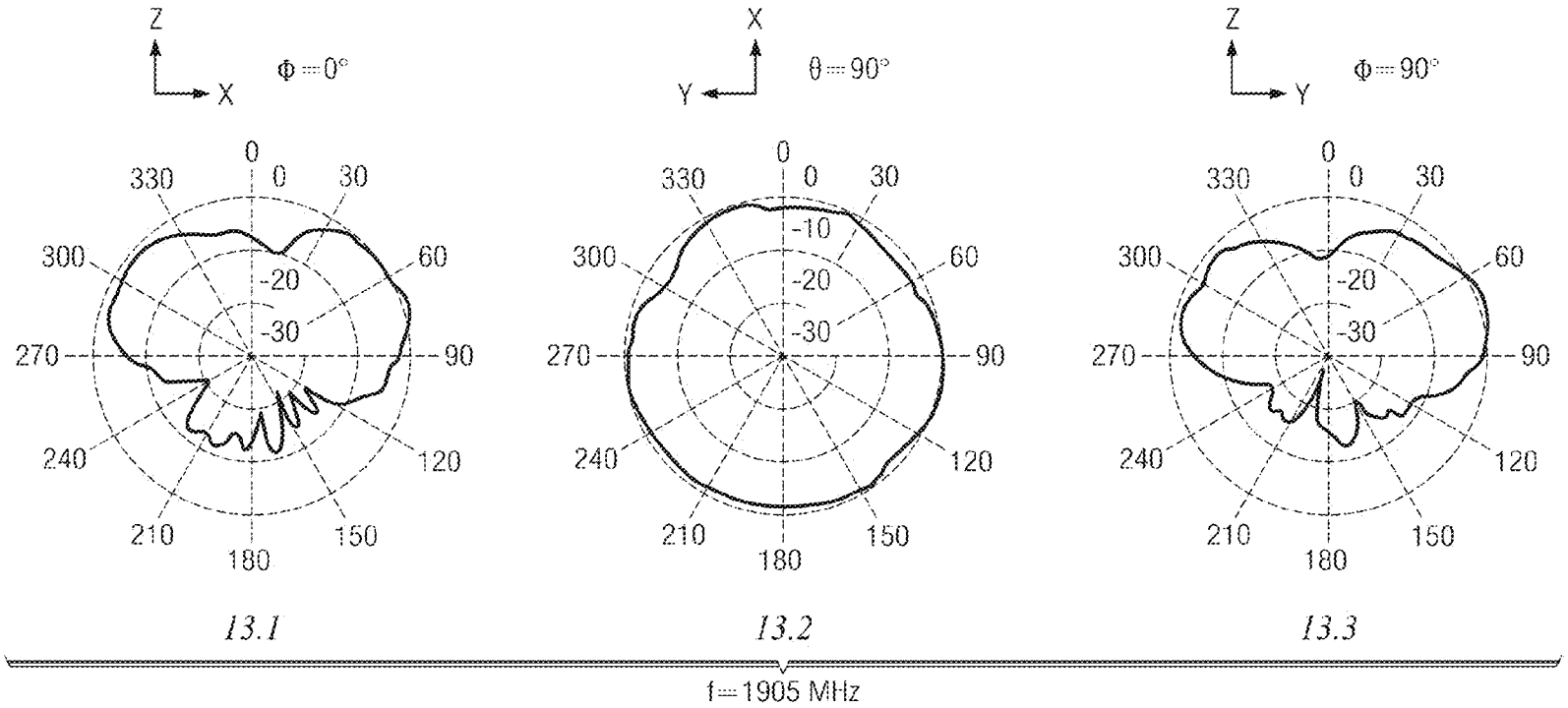
FIGS. 13*a* and 13*b* show radiation diagrams for the multilevel antenna of FIG. 11.
Figure 13B:
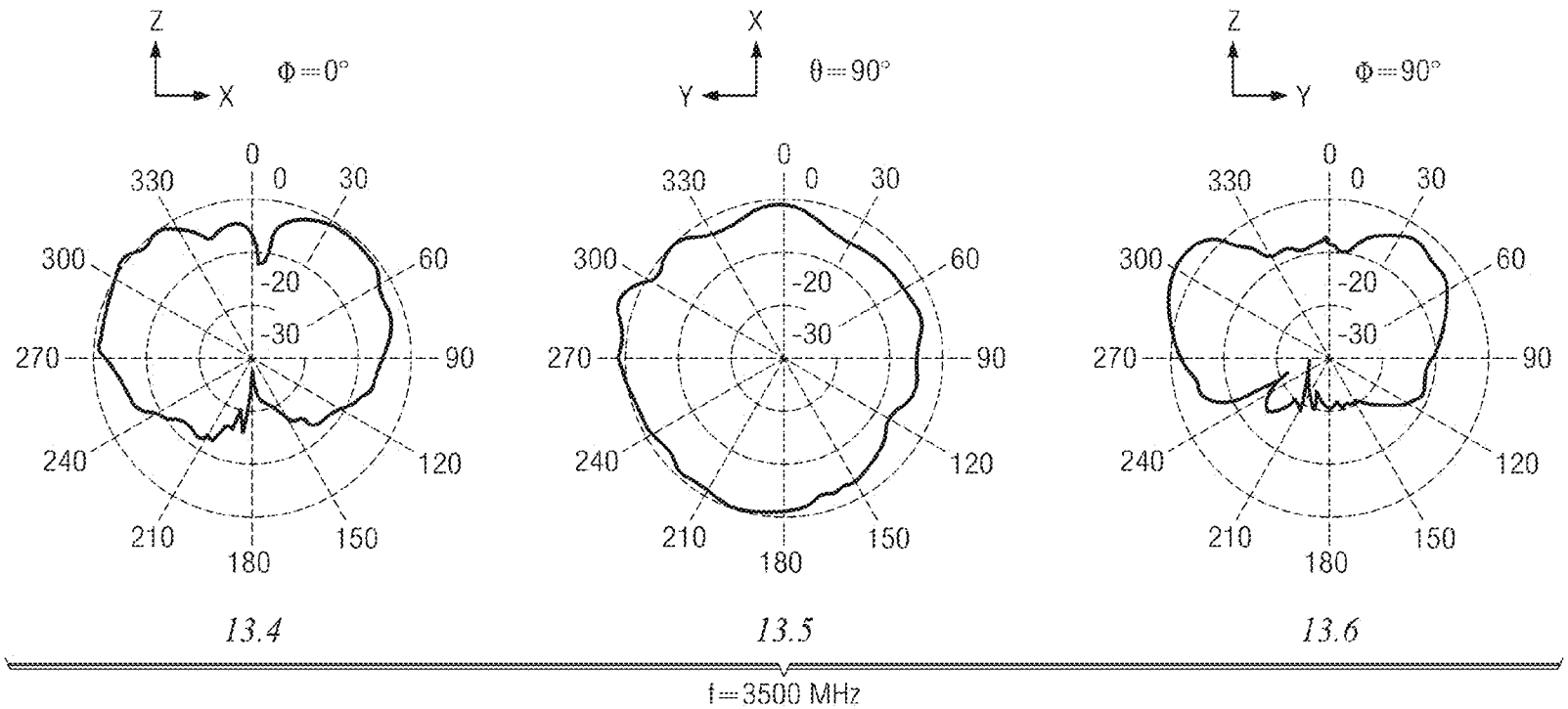

FIGS. 12, 13*a* and 13*b* summarize the radioelectric behavior of antennae in the lower (1900) and higher bands (3500).

FIG. 12 shows the standing wave ratio (SWR) for both bands: FIG. 12.1 for the band between 1880 and 1930 MHz, and FIG. 12.2 for the band between 3400 and 3600 MHz. These show that the antenna is well adapted as return losses are under 14 dB, that is, SWR<1.5 for the entire band of interest.

FIGS. 13*a* and 13*b* show typical radiation diagrams. Diagrams (13.1), (13.2) and (13.3) at 1905 MHz measured in the vertical plane, horizontal plane and antenna plane, respectively, and diagrams (13.4), (13.5) and (13.6) at 3500 MHz measured in the vertical plane, horizontal plane and antenna plane, respectively.

One can observe an omnidirectional behavior in the horizontal plane and a typical bilobular diagram in the vertical plane with the typical antenna directivity above 4 dBi in the 1900 band and 6 dBi in the 3500 band.

In the antenna behavior it should be remarked that the behavior is quite similar for both bands (both SWR and in the diagram) which makes it a multiband antenna.

Both the AM1 and AM2 antennae will typically be coated in a dielectric radome which is practically transparent to electromagnetic radiation, meant to protect the radiating element and the connection network from external aggression as well as to provide a pleasing external appearance.

It is not considered necessary to extend this description in the understanding that an expert in the field would be capable of understanding its scope and advantages resulting thereof, as well as to reproduce it.

However, as the above description relates only to a preferred embodiment, it should be understood that within this essence may be introduced various variations of detail, also protected, the size and/or materials used in manufacturing the whole or any of its parts.

What is claimed is:

1. A multi-band antenna including:

at least one structure for the multi-band antenna useable at three ranges of frequencies, each of the three ranges of frequencies extending between two limiting frequencies, the at least one structure including at least two levels of detail, wherein one level of detail makes up another level of detail, the at least two levels of detail being composed of closed figures bounded by the same number of sides, the sides comprising one or more of straight lines, portions of circles and portions of ellipses; and the at least one structure including at least three portions, a first portion having a first geometry configured to operate at a range of frequencies of the three ranges of frequencies, a second portion located substantially within the first portion and having a second geometry configured to operate at a range of frequencies of the three ranges of frequencies and a third portion located substantially within the first portion and having a third geometry configured to operate at a range of frequencies of the three ranges of frequencies, the first portion comprises substantially all of the at least one structure, wherein each of the closed figures is directly or proximately linked to at least one other of the closed figures such that electromagnetic power is exchanged between the closed figures either directly through at least one point of contact or through a small separation providing coupling, wherein, for at least 75% of the closed figures, the region or area of contact, intersection, or interconnection between the closed figures is less than 50% of their perimeter or area, and wherein not all of the closed figures have the same size and the perimeter of the at least one structure has a different number of sides than the closed figures that compose the at least one structure.

2. The multi-band antenna of claim 1, wherein the multi-band antenna is concealed within a portable communication device.

3. The multi-band antenna of claim 2, wherein the second portion is smaller than the first portion.

4. The multi-band antenna of claim 3, wherein the multi-band antenna provides a substantially similar combined amount of resistance and reactance measured at the input/output connector and radiation pattern in the three ranges of frequencies.

5. The multi-band antenna of claim 4, further comprising an interconnection circuit that links the multi-band antenna to an input/output connector and that is configured to incorporate adaptation networks for impedances, filters or diplexers.

6. A multi-band antenna including:

at least one structure for the multi-band antenna useable at multiple ranges of frequencies, each of the multiple ranges of frequencies extending between two limiting frequencies and included in a portable communication device, the at least one structure including at least two levels of detail, wherein one level of detail makes up another level of detail, the at least two levels of detail being composed of closed figures bounded by the same number of sides, the sides comprising one or more of straight lines, portions of circles and portions of ellipses;

the at least one structure including at least two portions, a first portion having a first geometry configured to operate at a range of frequencies of the multiple ranges of frequencies, and a second portion located substantially within the first portion and having a second geometry configured to operate at a range of frequencies of the multiple ranges of frequencies, the first portion comprises substantially all of the at least one structure;

wherein each of the closed figures is directly or proximately linked to at least one other of the closed figures such that electromagnetic power is exchanged between the closed plane figures either directly through at least one point of contact or through a small separation providing coupling, wherein, for at least 75% of the closed figures, the region or area of contact, intersection, or interconnection between the closed figures is less than 50% of their perimeter or area, wherein not all of the closed figures have the same size and the perimeter of the at least one structure has a different number of sides than the closed figures that compose the at least one structure, wherein the multi-band antenna provides a substantially similar combined amount of resistance and reactance measured at an input/output connector and radiation pattern in the multiple ranges of frequencies, and wherein the multi-band antenna is configured to operate at the multiple ranges of frequencies and wherein at least one of the multiples ranges of frequencies is within the 890 MHz-3600 MHz frequency range.

7. The multi-band antenna of claim 6, wherein the second portion is smaller than the first portion.

8. The multi-band antenna of claim 7, wherein the multi-band antenna is configured to operate in at least three frequency bands.

9. The multi-band antenna of claim 8, wherein the multi-band antenna provides a substantially similar combined amount of resistance and reactance measured at an input/output connector and radiation pattern in the at least three frequency bands.

10. The multi-band antenna of claim 9, wherein the at least three frequency bands are cellular frequency bands, and the antenna element is configured to transmit and receive wireless signals over an entirety of the cellular frequency bands.

11. A multi-band antenna including:

at least one structure for the multi-band antenna useable at multiple ranges of frequencies, each of the multiple ranges of frequencies extending between two limiting frequencies, the at least one structure including at least two levels of detail, wherein one level of detail makes up another level of detail, the at least one structure including at least one antenna region comprising a set of closed figures bounded by the same number of sides, the sides comprising one or more of straight lines, portions of circles and portions of ellipses, the at least one structure including at least two portions, a first portion having a first geometry configured to operate at a first range of frequencies of the multiple ranges of frequencies, and a second portion located substantially within the first portion and having a second geometry configured to operate at a second range of frequencies of the multiple ranges of frequencies, the second portion being smaller than the first portion and substantially overlapping within the first portion, wherein each of the closed figures in the antenna region is directly or proximately linked to at least one other of the closed figures such that electromagnetic power is exchanged between the closed figures in the antenna region either directly through at least one point of contact or through a small separation providing coupling, wherein for at least 75% of the closed figures, the region or area of contact between the closed figures is less than 50% of their perimeter or area, wherein not all of the closed figures have the same size and the perimeter of the at least one structure has a different number of sides than the closed figures that compose the antenna region, and wherein each of a plurality of the closed plane figures of the antenna region is generally identifiable as a closed plane figure defined by a free perimeter thereof and a projection of ones of the longest exposed perimeters thereof to define the least number of closed plane figures within the region necessary to form the generally distinguishable closed plane figures where the closed plane figures perimeters are interconnected.

12. The multi-band antenna of claim 11, wherein the first range of frequencies is in a 1710-2170 MHz frequency range.

13. The multi-band antenna of claim 12, wherein the multi-band antenna is concealed within a portable communication device.

14. The multi-band antenna of claim 13, wherein the first portion comprises substantially all of the at least one structure.

15. The multi-band antenna of claim 14, wherein the multi-band antenna is configured to operate in at least four frequency bands, two of the at least four frequency bands being the first range of frequencies and the second range of frequencies and the multi-band antenna is shared by four or more cellular services.

16. The multi-band antenna of claim 15, wherein the multi-band antenna provides a substantially similar combined amount of resistance and reactance measured at an input/output connector and radiation pattern in the at least four frequency bands.

17. A multi-band antenna including:

at least one structure for the multi-band antenna useable at least three ranges of frequencies, each of the at least three ranges of frequencies extending between two limiting frequencies, the at least one structure being included in a portable communication device and including at least two levels of detail, wherein one level of detail makes up another level of detail, the at least one structure including at least one antenna region comprising a set of closed figures bounded by the same number of sides, the sides comprising one or more of straight lines, portions of circles and portions of ellipses, the at least one structure including at least three portions, a first portion having a first geometry configured to operate at a range of frequencies of the three ranges of frequencies, a second portion located substantially within the first portion and having a second geometry configured to operate at a range of frequencies of the three ranges of frequencies and a third portion located substantially within the first portion and having a third geometry configured to operate at a range of frequencies of the three ranges of frequencies, the second and third portions substantially overlap with the first portion, wherein each of the closed figures in the antenna region is directly or proximately linked to at least one other of the closed figures such that electromagnetic power is exchanged between the closed figures in the antenna region either directly through at least one point of contact or through a small separation providing coupling, wherein for at least 75% of the closed figures, the region or area of contact between the closed figures is less than 50% of their perimeter or area, wherein not all of the closed figures have the same size and the perimeter of the at least one structure has a different number of sides than the closed figures that compose the antenna region, wherein each of a plurality of the closed figures of the antenna region is generally identifiable as a closed figure defined by a free perimeter thereof and a projection of ones of the longest exposed perimeters thereof to define the least number of closed figures within the region necessary to form the generally distinguishable closed figures where the closed figures perimeters are interconnected, and wherein the multi-band antenna is configured to operate at the at least three ranges of frequencies and wherein at least one of the at least three ranges of frequencies is within the 800 MHz-3600 MHz frequency range.

18. The multi-band antenna of claim 17, wherein the at least three ranges of frequencies includes a first frequency band in a 1710-2170 MHz frequency range.

19. The multi-band antenna of claim 18, wherein the first portion comprises substantially all of the at least one structure.

20. The multi-band antenna of claim 19, wherein the third portion is smaller than the first portion.

21. The multi-band antenna of claim 20, wherein the multi-band antenna provides a substantially similar combined amount of resistance and reactance measured at an input/output connector and radiation pattern in the at least three ranges of frequencies.

* * * * *